US010641141B2

(12) United States Patent
Okamoto

(10) Patent No.: US 10,641,141 B2
(45) Date of Patent: May 5, 2020

(54) VALVE GEAR FOR ENGINE

(71) Applicant: YAMAHA HATSUDOKI KABUSHIKI KAISHA, Iwata-shi, Shizuoka (JP)

(72) Inventor: Yasuo Okamoto, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 804 days.

(21) Appl. No.: 15/321,262

(22) PCT Filed: Jun. 23, 2015

(86) PCT No.: PCT/JP2015/068011
§ 371 (c)(1),
(2) Date: Dec. 22, 2016

(87) PCT Pub. No.: WO2015/199066
PCT Pub. Date: Dec. 30, 2015

(65) Prior Publication Data

US 2017/0159515 A1 Jun. 8, 2017

(30) Foreign Application Priority Data

Jun. 26, 2014 (JP) ..... 2014-131010

(51) Int. Cl.
*F01L 13/00* (2006.01)
*F01L 1/26* (2006.01)
(Continued)

(52) U.S. Cl.
CPC ..... *F01L 13/0005* (2013.01); *F01L 1/047* (2013.01); *F01L 1/053* (2013.01); *F01L 1/08* (2013.01);
(Continued)

(58) Field of Classification Search
CPC ..... F01L 13/005; F01L 2013/001; F01L 13/0021; F01L 13/036; F01L 1/047;
(Continued)

(56) References Cited

U.S. PATENT DOCUMENTS 4,656,977 A 4/1987 Nagahiro et al.
5,129,407 A * 7/1992 Phillips ..... F01L 13/0036 123/90.18
(Continued)

FOREIGN PATENT DOCUMENTS

JP 60-62613 A 4/1985
JP 61-31610 A 2/1986
(Continued)

OTHER PUBLICATIONS

Official Communication issued in International Patent Application No. PCT/JP2015/068011, dated Aug. 25, 2015.

*Primary Examiner* — Mark A Laurenzi
*Assistant Examiner* — Loren C Edwards
(74) *Attorney, Agent, or Firm* — Keating & Bennett, LLP

(57) ABSTRACT

A valve gear for an engine includes a camshaft including a valve drive cam, a rocker arm, a synchronous cam that rotates in synchronism with the valve drive cam, and a switching mechanism that switches a drive mode of an intake valve or an exhaust valve in a period defined by the synchronous cam. The switching mechanism includes a switch and a driver. The switch switches the drive mode by moving elements which define a valve gear system from the valve drive cam to the rocker arm. The driver includes a cam follower that is pushed by the synchronous cam and drives the elements of the valve gear system in directions to switch the drive mode by a force received from the cam follower.
(Continued)

A period when the synchronous cam pushes the cam follower is a period when the intake valve or the exhaust valve is kept closed.

12 Claims, 44 Drawing Sheets

(51) Int. Cl.

| | |
|---|---|
| ***F01L 1/08*** | (2006.01) |
| ***F01L 1/047*** | (2006.01) |
| ***F01L 1/053*** | (2006.01) |
| ***F01L 1/18*** | (2006.01) |
| ***F01L 1/24*** | (2006.01) |
| ***F01L 1/46*** | (2006.01) |

(52) U.S. Cl.
CPC ..... *F01L 1/18* (2013.01); *F01L 1/24* (2013.01); *F01L 1/267* (2013.01); *F01L 1/462* (2013.01); *F01L 13/00* (2013.01); *F01L 13/0036* (2013.01); *F01L 2001/0537* (2013.01); *F01L 2013/001* (2013.01)

(58) Field of Classification Search
CPC ..... F01L 1/053; F01L 2001/0537; F01L 1/18; F01L 2001/186; F01L 1/24; F01L 1/462; F01L 1/267; F01L 1/46
USPC ..... 123/90.16, 90.39
See application file for complete search history.

(56) References Cited

U.S. PATENT DOCUMENTS

| | | | | |
|---|---|---|---|---|
| 2008/0236531 | A1 | 10/2008 | Yamamoto et al. | |
| 2012/0222635 | A1* | 9/2012 | Sunada ..... | F01L 1/185 123/90.15 |

FOREIGN PATENT DOCUMENTS

| | | | |
|---|---|---|---|
| JP | 61-201804 | A | 9/1986 |
| JP | 2008-248872 | A | 10/2008 |
| JP | 2009-264199 | A | 11/2009 |

* cited by examiner

VALVE GEAR FOR ENGINE

BACKGROUND OF THE INVENTION

1. Field of the Invention

The present invention relates to a valve gear for an engine, which includes a switching mechanism that switches a drive mode of an intake valve or an exhaust valve of the engine.

2. Description of the Related Art

A valve gear capable of switching the drive mode of the intake valve or the exhaust valve of an engine is conventionally described in, for example, Japanese Patent Laid-Open No. 2009-264199. The valve gear for an engine disclosed in Japanese Patent Laid-Open No. 2009-264199 includes two types of rocker arms that convert the rotation of the cams of a camshaft into a reciprocating motion and transmit it to an intake valve or an exhaust valve, and a switching mechanism that switches the drive mode of the intake valve or the exhaust valve. The cams include a first cam having a relatively large valve lift amount, and a second cam having a relatively small valve lift amount.

The two types of rocker arms include a first rocker arm that swings when pushed by the first cam, and a second rocker arm swingably provided at a position so as to be pushed by the second cam. The second rocker arm includes a pusher that pushes the intake valve or the exhaust valve.

The switching mechanism includes a slide pin that selectively connects the above-described two types of rocker arms, an actuator that applies an oil pressure to the slide pin, a return spring that returns the slide pin into one rocker arm, and the like. The switching mechanism switches between a mode in which the first rocker arm and the second rocker arm are connected to each other and integrally swing, and a mode in which the two rocker arms are disconnected.

Pin holes that receive the slide pin are provided in the rocker arms. The pin holes extend in the axial direction of the swing shafts of the rocker arms. The pin hole of the first rocker arm and the pin hole of the second rocker arm are located at positions at which the pin holes are aligned on the same axis in a state in which the positions of the two rocker arms match in the swing direction.

When pushed by the oil pressure, the slide pin moves inside the above-described pin hole in the axial direction of the swing shaft of the rocker arm against the spring force of the return spring. When the oil pressure is canceled, the slide pin pushed by the oil pressure is returned into the one rocker arm by the spring force of the return spring.

The first rocker arm and the second rocker arm are connected to each other when the slide pin moves to a connecting position across the two rocker arms. The connected state is canceled when the slide pin is moved by the spring force of the return spring to a non-connecting position at which the slide pin is housed in the one rocker arm.

When the slide pin is located at the connecting position, a driving force is transmitted from the first cam to the intake valve or the exhaust valve via the first rocker arm and the second rocker arm. On the other hand, when the slide pin is located at the non-connecting position, the driving force is not transmitted from the first rocker arm to the second rocker arm. Instead, the driving force is transmitted from the second cam to the intake valve or the exhaust valve via the second rocker arm. Hence, in this valve gear for an engine, the drive mode of the intake valve or the exhaust valve is switched by changing the position of the slide pin.

In the valve gear described in Japanese Patent Laid-Open No. 2009-264199, to set the first rocker arm and the second rocker arm in the connected state, an oil pressure to press the slide pin is applied to the slide pin. The period when the slide pin moves is the period when the swing angle of the first rocker arm equals that of the second rocker arm, and the pin holes of the two arms are aligned on the same axis. During the period when the pin holes are shifted, the slide pin cannot move, and the two arms are not connected. The period when the swing angles of the two arms are equal is the period when the intake valve or the exhaust valve is kept closed.

On the other hand, in a state in which the slide pin moves to the connecting position, and the driving force is transmitted from the first rocker arm to the second rocker arm, the slide pin is pushed against the inner wall surfaces of the pin holes by a force equivalent to the driving force. If a frictional force generated in the contact portion between the slide pin and the inner wall surfaces of the pin holes in the drive state is large, the movement of the slide pin is regulated by the frictional force. Even if the oil pressure is canceled in the drive state in which the large frictional force acts on the slide pin to return the slide pin to the non-connecting position by the spring force of the return spring, the slide pin cannot be moved from the connecting position to the non-connecting position.

In the valve gear described in Japanese Patent Laid-Open No. 2009-264199, to cancel the connected state between the first rocker arm and the second rocker arm, first, the oil pressure applied to the slide pin at the connecting position is canceled. In a case in which, for example, the driving force is transmitted from the first rocker arm to the second rocker arm, and the above-described frictional force is relatively large, the slide pin does not move even if the oil pressure is released. However, there is a certain period when the frictional force becomes small depending on conditions in the swinging of the two arms. This period is the period when, for example, the intake valve or the exhaust valve is lifted a little. In this case, the reaction of the valve spring is small, and therefore, the frictional force is small, too. Even in a period close to the maximum lift of the intake valve or the exhaust valve, the frictional force is small because a negative acceleration acts on the rocker arms. When the frictional force decreases, and the slide pin can be moved by the spring force of the return spring, the slide pin moves from the connecting position to the non-connecting position.

In the drive device disclosed in Japanese Patent Laid-Open No. 2009-264199, a so-called "flick phenomenon" may occur in the process of canceling the connected state between the first rocker arm and the second rocker arm and the process of shifting from the non-connected state to the connected state. The flick phenomenon is a phenomenon in which the connected state between the rocker arms is canceled in a state in which the intake valve or the exhaust valve is not closed, and the second rocker arm and the intake valve or the exhaust valve are abruptly returned to the closed position by the spring force of the valve spring.

Probably, there are two causes of the flick phenomenon, as will be described below. As the first cause, when the rocker arms shift from the non-connected state to the connected state, they swing in a state in which the slide pin is insufficiently fitted. More specifically, when the rocker arms shift from the non-connected state to the connected state, they are pushed by the cams and start swinging in the period when the slide pin is fitted a little. If a load is applied to the slide pin fitting portion in a state in which the intake valve or the exhaust valve is open, the fitting is canceled, and the flick phenomenon occurs.

As the second cause, probably, when the rocker arms shift from the connected state to the non-connected state, the frictional force acting on the slide pin decreases during the period when the intake valve or the exhaust valve is open, and the fitting of the slide pin is canceled by the spring force of the return spring.

When the flick phenomenon occurs, an impact load is applied to the second rocker arm, the intake valve, or the exhaust valve. If the flick phenomenon frequently occurs, the second rocker arm, the intake valve, or the exhaust valve may suffer damage.

For this reason, a conventional valve gear of this type for an engine is required to prevent occurrence of the above-described flick phenomenon.

SUMMARY OF THE INVENTION

Preferred embodiments of the present invention satisfy the above requirement, and provide a valve gear for an engine in which the period when an intake valve or an exhaust valve is kept closed synchronizes with the period when a member that switches the drive mode of the intake valve or the exhaust valve is driven.

According to a preferred embodiment of the present invention, a valve gear for an engine includes a camshaft including a valve drive cam that drives one of an intake valve and an exhaust valve, a rocker arm that converts a rotation of the valve drive cam into a reciprocating motion and transmits the reciprocating motion to one of the intake valve and the exhaust valve, a synchronous cam that rotates in synchronism with the valve drive cam, and a switching mechanism that switches a drive mode of one of the intake valve and the exhaust valve to one of a predetermined first drive mode and a predetermined second drive mode in a period defined by the synchronous cam, wherein the switching mechanism includes a switch that switches the drive mode by moving some of the elements which define a valve gear system from the valve drive cam to the rocker arm, and a driver including a cam follower that is pushed by the synchronous cam, and that drives some of the elements which define the valve gear system in directions to switch the drive mode by a force received from the cam follower, and a period when the synchronous cam pushes the cam follower is a period when one of the intake valve and the exhaust valve is kept closed.

In a valve gear for an engine according to a preferred embodiment of the present invention, the synchronous cam pushes the cam follower, and the pushing force is transmitted to the switch of the switching mechanism to switch the drive mode of the intake valve or the exhaust valve in the period when the intake valve or the exhaust valve is kept closed. It is therefore possible to provide a valve gear for an engine in which the switching mechanism is not driven in the period when the intake valve or the exhaust valve is open, unlike the related art, and a so-called flick phenomenon as in the related art does not occur. In the period when the intake valve or the exhaust valve is kept closed, the driving force is not transmitted to the elements which define the valve gear system from the valve drive cam to the rocker arm. When some of the elements move, the resistance is considerably small, and the elements always smoothly move.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

A valve gear for an engine according to a first preferred embodiment of the present invention will now be described in detail with reference to FIGS. 1 to 16.

Figure 1:
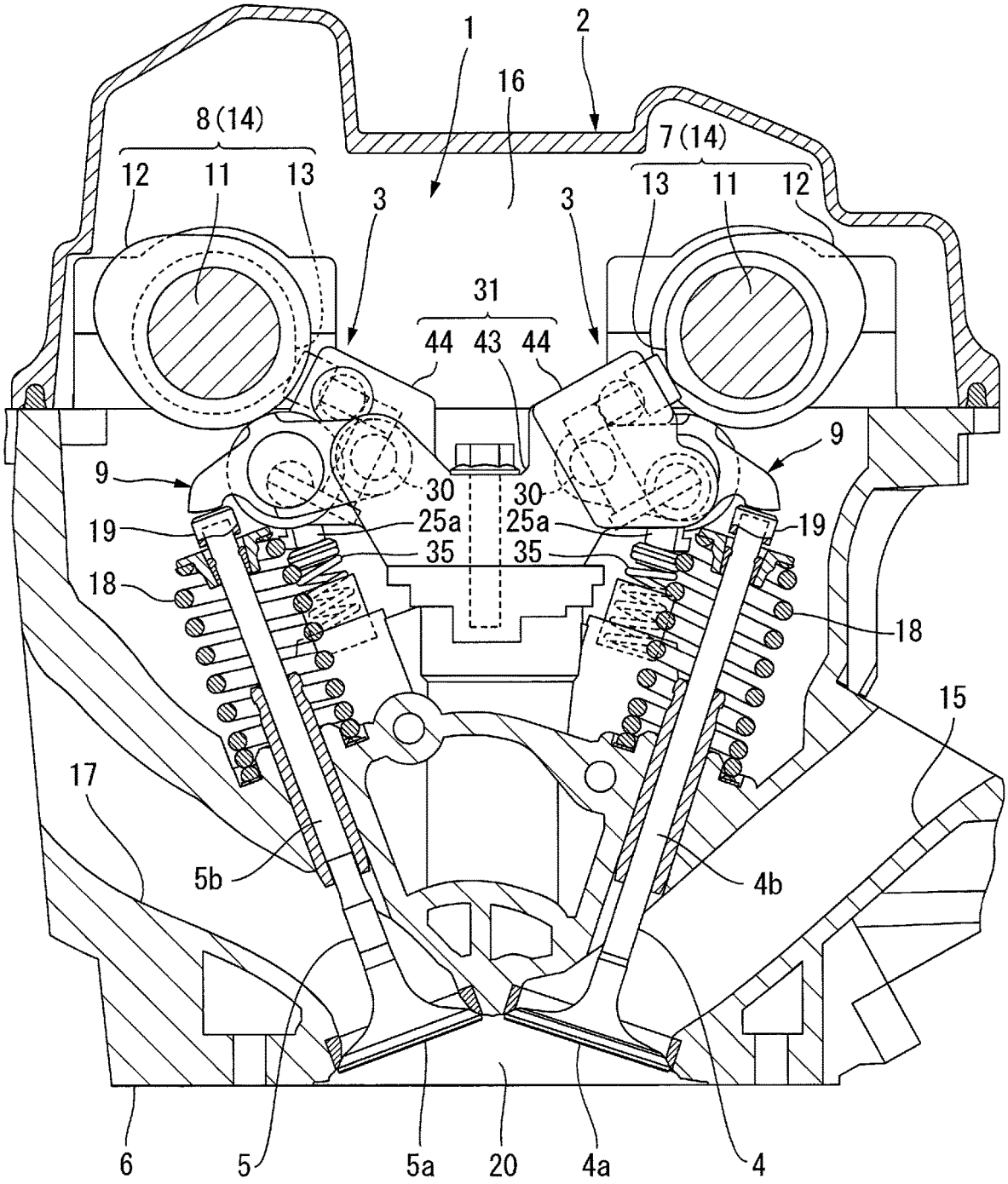
FIG. 1 is a sectional view of a valve gear for an engine according to a first preferred embodiment of the present invention.

A valve gear 1 shown in FIG. 1 is mounted on, for example, a DOHC four-cylinder engine 2 included in a vehicle (not shown). The valve gear 1 includes a switching mechanism 3 to switch between a full cylinder operation in which the four cylinders are operated as usual and a partial cylinder operation (rest mode) in which two of the four cylinders are at rest.

The switching mechanisms 3 are provided on two of the four cylinders, as will be described below in detail. The switching mechanisms 3 may be provided on, for example, the first and fourth cylinders located at the ends of the cylinder train or on the second and third cylinders located at the center of the cylinder train.

As shown in FIG. 1, the switching mechanisms 3 according to this preferred embodiment define a portion of the valve gear 1, and are provided on both a first side where an intake valve 4 is located and a second side where an exhaust valve 5 is located. In the above-described operation modes, the valve gear 1 converts the rotations of an intake camshaft 7 and an exhaust camshaft 8 provided in a cylinder head 6 into reciprocating motions by rocker arms 9, thus driving the intake valve 4 and the exhaust valve 5.

In the valve gear 1, a portion that drives the intake valve 4 and a portion that drives the exhaust valve 5 preferably have the same structure. For this reason, as for members that have the same structure on the side of the intake valve 4 and on the side of the exhaust valve 5, the member on the side of the exhaust valve 5 will be described below. The member on the side of the intake valve 4 is denoted by the same reference numeral, and a description thereof will be omitted.

Each of the intake camshaft 7 and the exhaust camshaft 8 includes a camshaft main body 11 rotatably supported in the cylinder head 6, and a valve drive cam 12 and a synchronous cam 13 both provided on the camshaft main body 11. Note that the intake camshaft 7 and the exhaust camshaft 8 will generally simply be referred to as camshafts 14 hereinafter.

Figure 5:
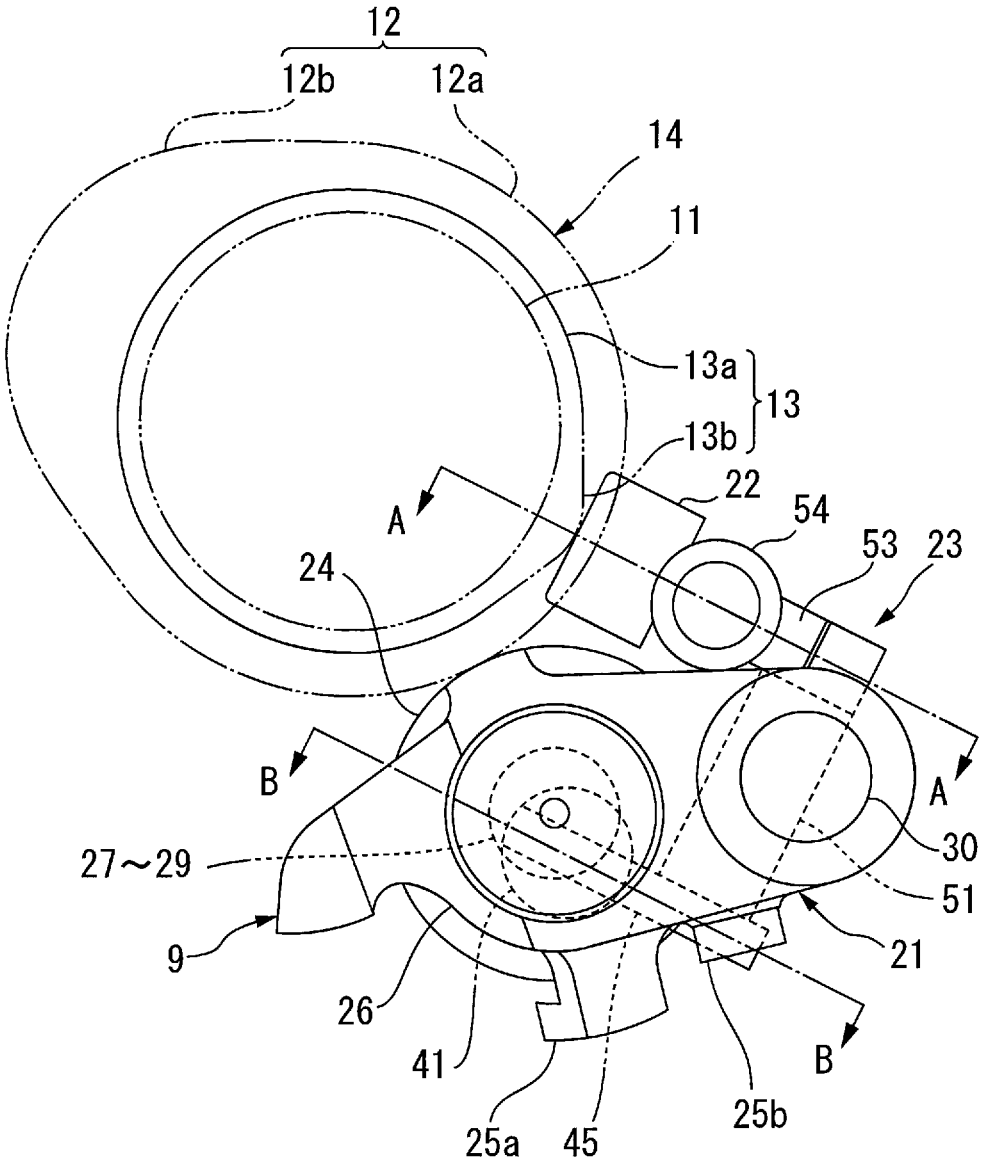
FIG. 5 is a side view of main portion according to the first preferred embodiment of the present invention.

The camshaft main body 11 preferably has a rod shape with a circular or substantially circular cross-section. As shown in FIG. 5, the valve drive cam 12 includes a circular base 12*a* and a nose 12*b*. The circular base 12*a* has a shape that is a portion of a column located on the same axis as the camshaft main body 11, and has a size that brings the valve lift amount of the intake valve 4 or the exhaust valve 5 to zero. The nose 12*b* has a shape that projects outward in the radial direction from the circular base 12*a* by a predetermined projection amount so as to have a mountain-shaped section.

The synchronous cam 13 defines the period when the switching mechanism 3 performs a switching operation and also defines and functions as a power source. As shown in FIG. 5, the synchronous cam 13 includes a circular base 13*a* and a nose 13*b*, and is located adjacent to the valve drive cam 12. The synchronous cam 13 rotates in synchronism with the valve drive cam 12. The circular base 13*a* of the synchronous cam 13 has a shape that is a portion of the column located on the same axis as the camshaft main body 11. The nose 13*b* of the synchronous cam 13 has a shape that projects outward in the radial direction from the circular base 13*a* by a predetermined projection amount so as to have a mountain-shaped section.

The positional relationship between the valve drive cam 12 and the synchronous cam 13 with respect to the rotation direction of the camshaft 14 is set such that the synchronous cam 13 makes the switching mechanism 3 work during the period when the valve drive cam 12 keeps the intake valve or the exhaust valve closed. That is, the positional relationship is set such that when the camshaft main body 11 is viewed from the axial direction, as shown in FIG. 5, the nose 13*b* makes the switching mechanism 3 work at a certain timing during the period when the circular base 12*a* of the valve drive cam 12 is in contact with the rocker arm 9.

The intake valve 4 and the exhaust valve 5 each preferably include two valves per cylinder, and each valve is movably supported in the cylinder head 6. The two intake valves 4 are spaced apart at a predetermined interval in the axial direction of the intake camshaft 7. The two exhaust valves 5 are spaced apart at a predetermined interval in the axial direction of the exhaust camshaft 8.

The intake valve 4 includes a valve body 4*a* that opens/closes an intake port 15 of the cylinder head 6, and a valve shaft 4*b* extending from the valve body 4*a* into a valve chamber 16 of the cylinder head 6. The exhaust valve 5 includes a valve body 5*a* that opens/closes an exhaust port 17 of the cylinder head 6, and a valve shaft 5*b* extending from the valve body 5*a* into the valve chamber 16 of the cylinder head 6. A valve spring 18 that biases the intake valve 4 or the exhaust valve 5 in a direction to close the valve is provided between the cylinder head 6 and the distal end of each of the valve shafts 4*b* and 5*b*. A cap-shaped shim 19 is provided at the distal end of each of the valve shafts 4*b* and 5*b*.

The upstream end of the intake port 15 is open to one side of the cylinder head 6. The downstream end of the intake port 15 is open to a combustion chamber 20 provided for each cylinder. The upstream end of the exhaust port 17 is open to the combustion chamber 20. The downstream end of the exhaust port 17 is open to the other side of the cylinder head 6. A spark plug (not shown) is provided at the center of the combustion chamber 20.

Figure 4:
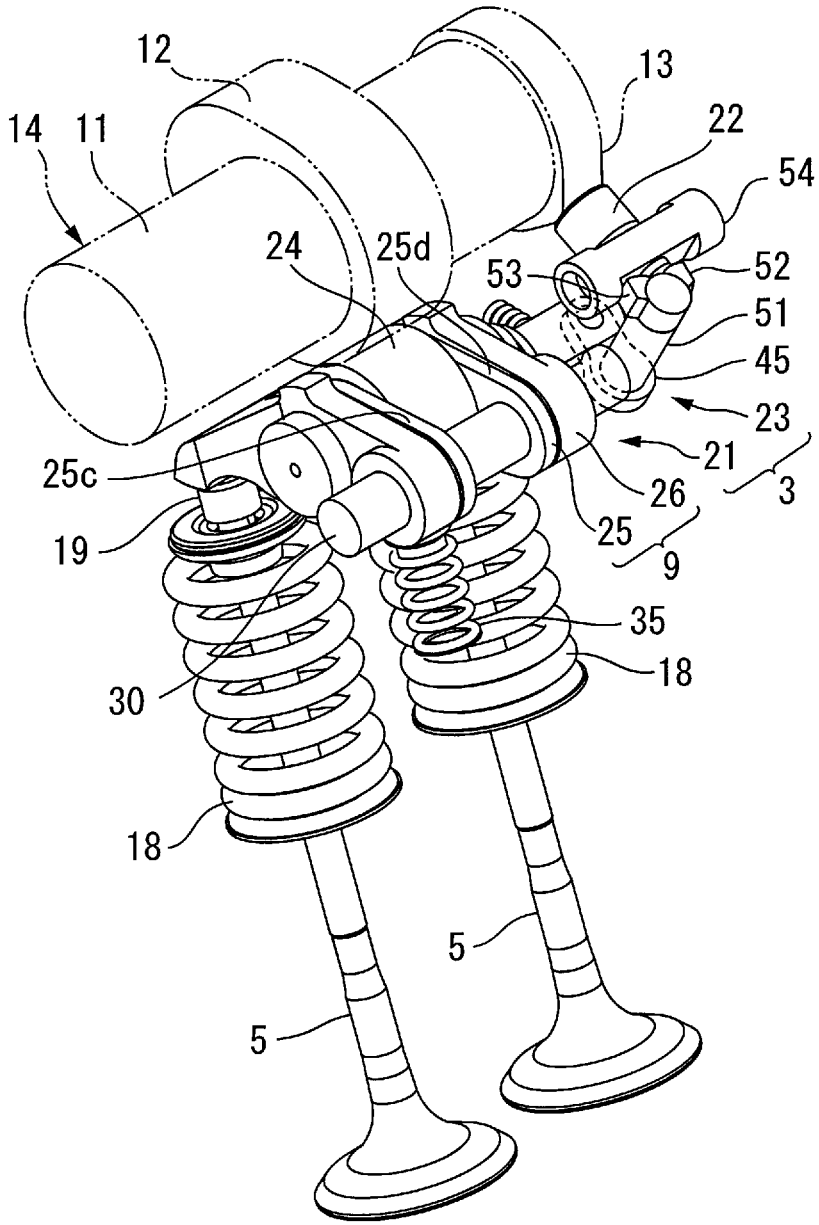
FIG. 4 is a perspective view of a main portion according to the first preferred embodiment of the present invention.

As shown in FIG. 4, the switching mechanism 3 according to this preferred embodiment includes a switch 21 including the rocker arm 9 that drives the intake valve 4 or the exhaust valve 5, and a driver 23 including a cam follower 22 that is pushed by the synchronous cam 13 to move. The switch 21 switches the drive mode of the intake valve 4 or the exhaust valve 5 by moving some of the elements which define a valve gear system (to be described below). The driver 23 drives some of the elements which define the above-described valve gear system in directions to switch the drive mode by a force received from the cam follower 22, as will be described below in detail.

Figure 2:
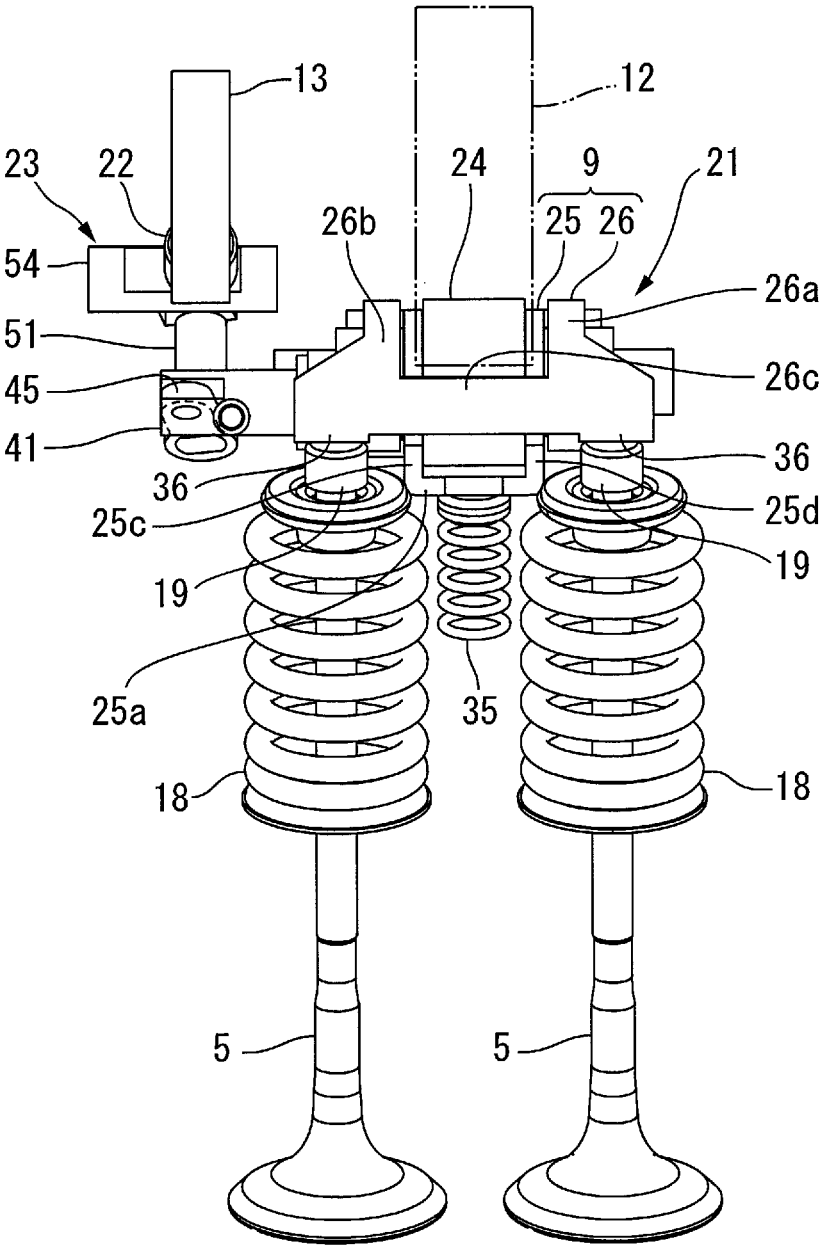
FIG. 2 is a front view of a main portion according to the first preferred embodiment of the present invention.
Figure 3:
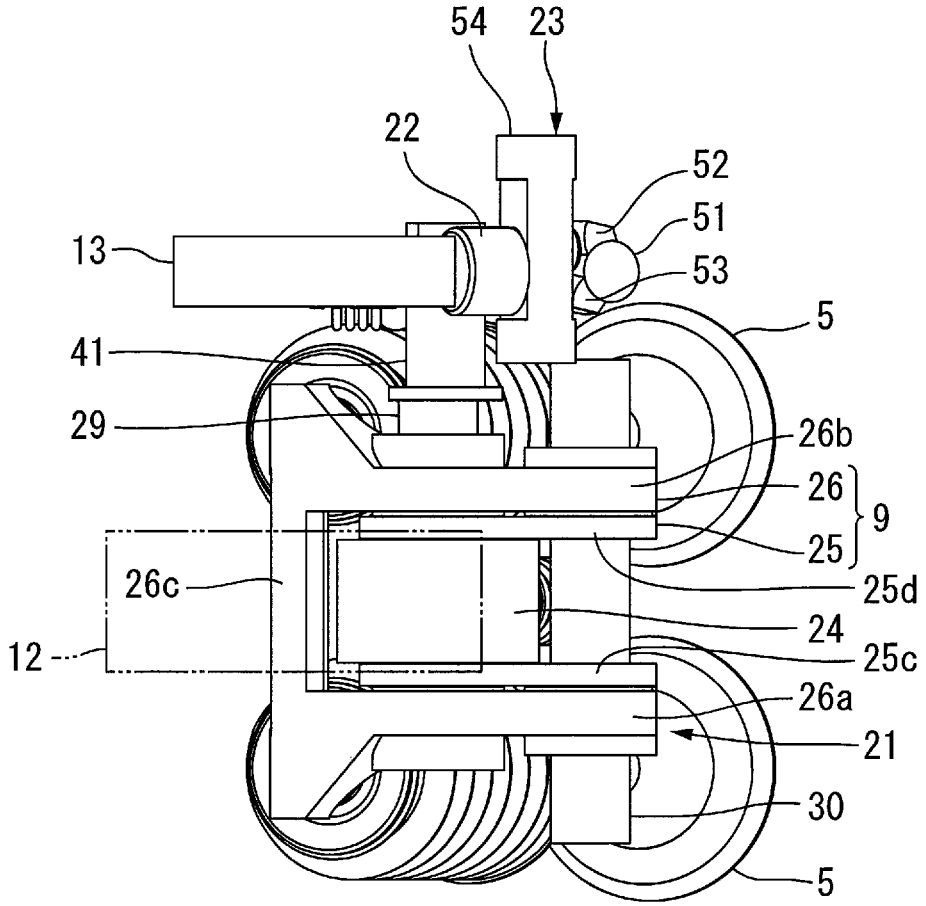
FIG. 3 is a plan view of a main portion according to the first preferred embodiment of the present invention.

The rocker arm 9 includes a plurality of members, as shown in FIGS. 2 to 4. The plurality of members include a first rocker arm 25 including a roller 24 that contacts the valve drive cam 12, a second rocker arm 26 located adjacent to the first rocker arm 25 in the axial direction of the camshaft 14, and first to third switch pins 27 to 29 (see FIGS. 6 and 7) that selectively connect the first rocker arm 25 and the second rocker arm 26.

Figure 6:
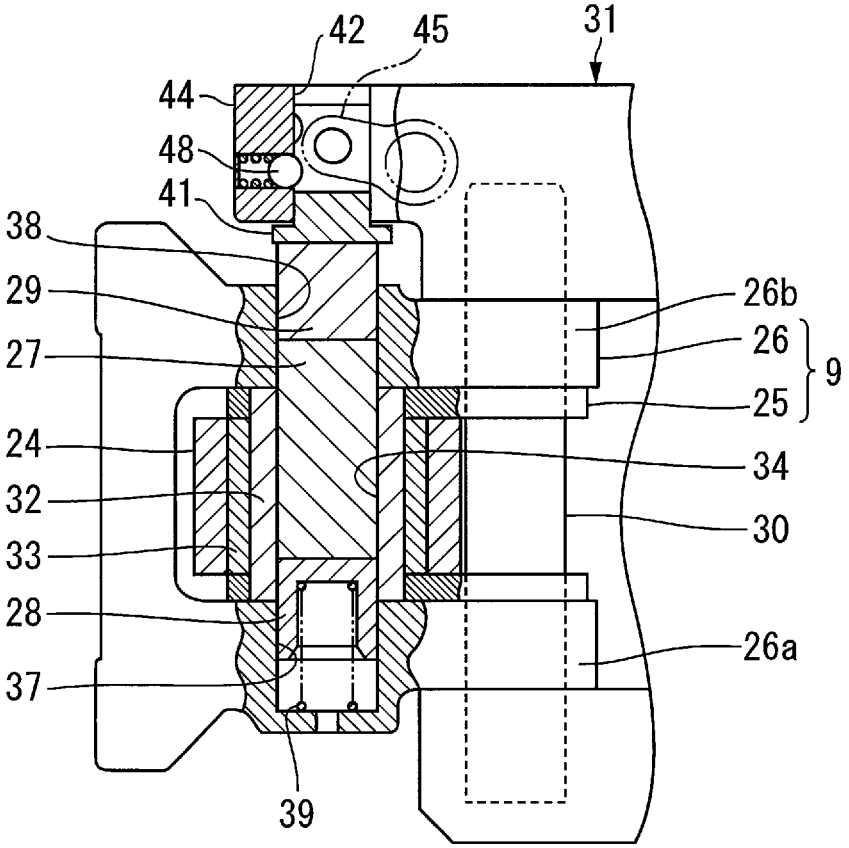
FIG. 6 is a sectional view of rocker arms according to the first preferred embodiment of the present invention, which shows a connected state in which a first rocker arm and a second rocker arm are connected.
Figure 7:
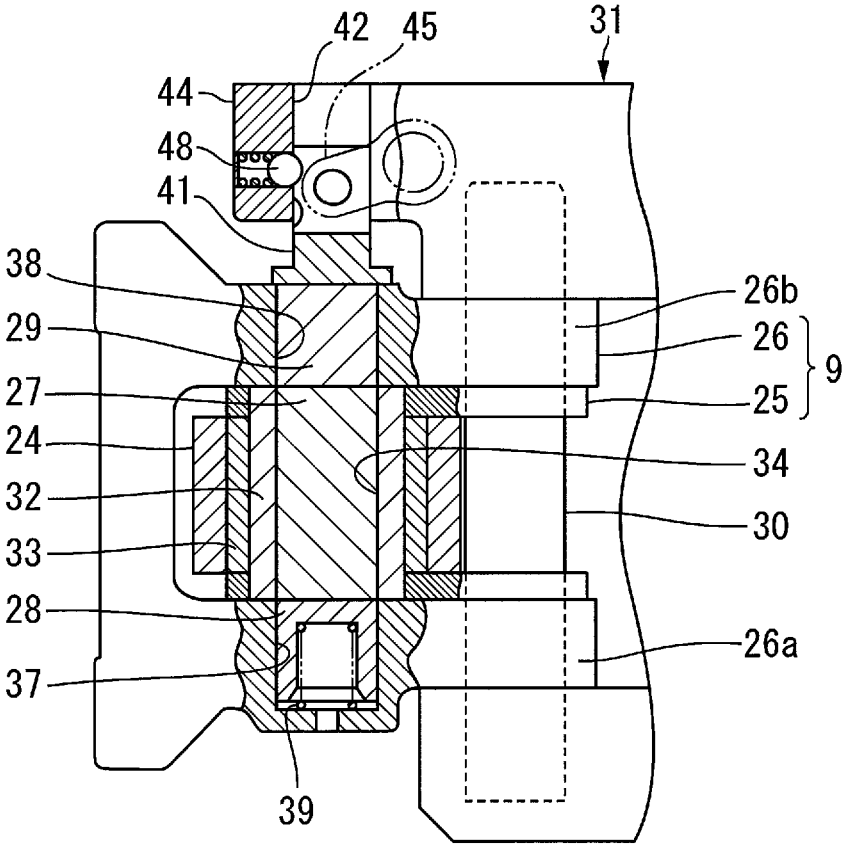
FIG. 7 is a sectional view of the rocker arms according to the first preferred embodiment of the present invention, which shows a non-connected state in which the first rocker arm and the second rocker arm are not connected.

As shown in FIGS. 1 to 5, the first rocker arm 25 includes a left arm 25*c* and a right arm 25*d* which are connected by two connectors 25*a* and 25*b* (see FIG. 5) so as to define a U-shape in a front view (see FIG. 2). One end of the first rocker arm 25 is swingably supported by a rocker shaft 30. The rocker shaft 30 is mounted on a support member 31 (see FIG. 1) of the cylinder head 6 so as to be parallel or substantially parallel to the camshaft 14. The swinging end of the first rocker arm 25 includes a tubular shaft 32, as shown in FIGS. 6 and 7, and supports the roller 24 via the tubular shaft 32. The axis of the tubular shaft 32 is parallel or substantially parallel to the axis of the rocker shaft 30. The roller 24 is rotatably supported on the tubular shaft 32 by a bearing 33.

The hollow portion of the tubular shaft 32 extends across the first rocker arm 25 in the axial direction of the camshaft 14. The first switch pin 27 is movably fitted in the hollow portion. The hollow portion of the tubular shaft 32 will be referred to as a first pin hole 34 hereinafter. In this preferred embodiment, the length of the first switch pin 27 equals the length of the first pin hole 34. However, the first switch pin 27 may be either longer or shorter than the first pin hole 34 as long as it avoids fitting in a pin hole that comes next to the first switch pin 27 in a non-connected state.

A return spring member 35 is provided between the cylinder head 6 and the connectors 25*a* and 25*b* that connect the left arm 25*c* and the right arm 25*d* as the swinging ends of the first rocker arm 25 so as to define a U-shape in the front view, as shown in FIGS. 1 and 2. The spring member 35 biases the first rocker arm 25 in a direction in which the roller 24 is pushed against the valve drive cam 12. For this reason, when pushed by the valve drive cam 12, the first rocker arm 25 swings against the spring force of the spring member 35.

As shown in FIG. 3, the second rocker arm 26 includes a first arm main body 26*a* and a second arm main body 26*b* which are located on both sides of the first rocker arm 25, and a connector 26*c* that connects the swinging ends of the first arm main body 26*a* and the second arm main body 26*b*. The first arm main body 26*a* and the second arm main body 26*b* each include one end swingably supported by the rocker shaft 30. As shown in FIG. 2, the connector 26*c* preferably extends in the axial direction of the camshaft 14. Pushers 36 that push the shims 19 of the intake valves 4 or the exhaust valves 5 are provided at two ends of the connector 26*c* in the longitudinal direction. The second rocker arm 26 simultaneously pushes the two intake valves 4 or the exhaust valves 5 per cylinder.

As shown in FIGS. 6 and 7, a second pin hole 37 is provided in the middle of the first arm main body 26*a*. A third pin hole 38 is provided in the middle of the second arm main body 26*b*. The second pin hole 37 and the third pin hole 38 extend across the first arm main body 26*a* and the second arm main body 26*b* in the axial direction of the camshaft 14. The distance between the axis of the rocker shaft 30 and the center line of the second pin hole 37 and the third pin hole 38 matches the distance between the axis of the rocker shaft 30 and the center line of the first pin hole 34 of the first rocker arm 25. That is, the first pin hole 34, the second pin hole 37, and the third pin hole 38 are located on the same axis in a state in which the swing angle of the first rocker arm 25 and the swing angle of the second rocker arm 26 are predetermined angles. The predetermined angles are angles when the intake valve 4 or the exhaust valve 5 is kept closed. For this reason, when the valve lift amount of the intake valve 4 or the exhaust valve 5 is 0 degrees, the second pin hole 37 and the third pin hole 38 are located on the same axis as the first pin hole 34.

The hole diameter of the second pin hole 37 and the third pin hole 38 matches the hole diameter of the first pin hole 34. The second switch pin 28 is movably fitted in the second pin hole 37. In addition, a spring member 39 that biases the second switch pin 28 toward the first rocker arm 25 is provided in the second pin hole 37.

The third switch pin 29 is movably fitted in the third pin hole 38. The length of the third switch pin 29 is equal or substantially equal to the length of the third pin hole 38. However, the third switch pin 29 may be either longer or shorter than the third pin hole 38 as long as it avoids fitting in a pin hole that comes next to the third switch pin 29 in a non-connected state. An end of the third switch pin 29 on the opposite side of the first rocker arm 25 faces a pushing element 41 of the driver 23 (to be described below). The driver 23 pushes the third switch pin 29 toward the first rocker arm 25 using the pushing element 41.

When the first to third pin holes 34, 37, 38 are arranged on the same axis in a state in which the pushing element 41 does not push the third switch pin 29, the first to third switch pins 27 to 29 are pushed by the spring force of the spring member 39 and move to connecting positions, as shown in FIG. 6. The connecting positions are positions at which the first switch pin 27 and the second switch pin 28 are located across the first rocker arm 25 and the second rocker arm 26.

When the first switch pin 27 and the second switch pin 28 move to the connecting positions, one end of the third switch pin 29 projects from the second arm main body 26*b* and abuts against the pushing element 41. When the first to third switch pins 27 to 29 move to the connecting positions, the first rocker arm 25 and the second rocker arm 26 are connected and integrally swing. That is, the rotation of the valve drive cam 12 is converted into a reciprocating motion by the first rocker arm 25 and the second rocker arm 26, and the intake valves 4 or the exhaust valves 5 are driven. In this case, the cylinders with the switching mechanisms 3 change to the operation mode. At this time, the third switch pin 29 is pushed against the pushing element 41 and moves along with the swing of the second rocker arm 26 in this state.

On the other hand, when the pushing element 41 pushes the third switch pin 29, the first switch pin 27 and the second switch pin 28 move to non-connecting positions at which the first switch pin 27 and the second switch pin 28 are not located across the first rocker arm 25 and the second rocker arm 26, and the connected state between the first rocker arm 25 and the second rocker arm 26 is canceled, as shown in FIG. 7. In this case, the first rocker arm 25 and the second rocker arm 26 individually swing. Hence, only the first rocker arm 25 is pushed by the valve drive cam 12 and swings, and the second rocker arm 26 does not swing. Since the intake valves 4 or the exhaust valves 5 are kept closed, the cylinders with the switching mechanisms 3 change to the rest mode.

In this preferred embodiment, the first to third switch pins 27 to 29 define "some of the elements which define a valve gear system from the valve drive cam to the rocker arm."

The driver 23 of the switching mechanism 3 is defined by a combination of a plurality of members, and provided at a position adjacent to the rocker arm 9 in the axial direction of the rocker shaft 30, as shown in FIGS. 3 and 4. In the driver 23 shown in FIGS. 2 to 5, only the members that operate are illustrated for easy understanding of the structure.

As shown in FIGS. 6 and 7, the pushing element 41 that transmits power from the driver 23 to the switch 21 preferably has a columnar shape and is movably fitted in a shaft hole 42 of the support member 31. As shown in FIG. 1, the support member 31 includes a base 43 through which the rocker shaft 30 extends, and a housing 44 for a driver, which projects from the base 43. The shaft hole 42 is provided in the housing 44.

One end of the pushing element 41 which is opposite to the third switch pin 29 preferably has a disc shape having a predetermined size. The end surface at this end which is opposite to the third switch pin 29 is preferably flat such that it swings integrally with the second arm main body 26*b* in a state in which the third switch pin 29 contacts the end surface. This end has a such a size that always faces the third switch pin 29 swinging integrally with the second arm main body 26*b*.

Figure 9:
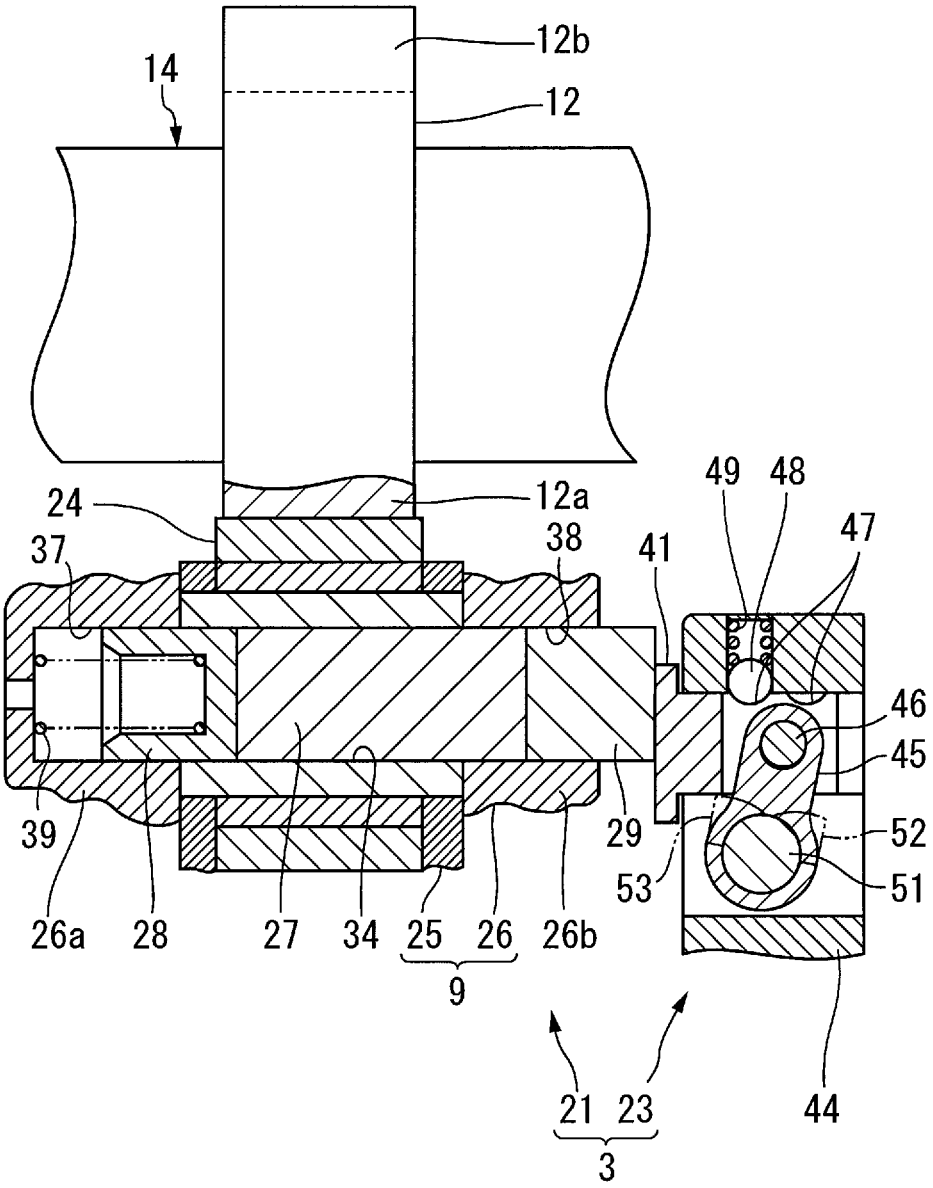
FIG. 9 is a sectional view of the driver according to the first preferred embodiment of the present invention, which is a sectional view of the driver taken along a line B-B in FIG. 5.

As shown in FIG. 9, a drive lever 45 (to be described below) of the driver 23 is pivotally connected to the pushing element 41 via a connecting pin 46. When the drive lever 45 swings, the pushing element 41 moves forward or backward with respect to the second arm main body 26*b*. For this reason, the pushing element 41 reciprocally moves between an advance position shown in FIG. 7 and a retreat position shown in FIG. 6.

As shown in FIG. 9, a plurality of concave portions 47 are provided in the outer surface of the pushing element 41. The concave portions 47 have a shape capable of engaging with a ball 48 and are arranged in the axial direction of the pushing element 41. The ball 48 is held in the housing 44 and pushed against the pushing element 41 by the spring force of a compression coil spring 49 so as to engage with the concave portion 47. The pushing element 41 is temporarily held at the above-described advance position or retreat position by engaging the ball 48 with the concave portion 47.

As shown in FIGS. 4 and 5, the drive lever 45 connected to the pushing element 41 is fixed to one end of a pivot shaft 51 (to be described below). When the pivot shaft 51 pivots, the drive lever 45 swings in synchronism with the pivotal operation of the pivot shaft 51. In addition, the pushing element 41 moves in the axial direction of the camshaft 14 and moves to the advance position or the retreat position. In this preferred embodiment, the drive lever 45 and the pushing element 41 define a "transmission."

The pivot shaft 51 is located at a position where the pivot shaft 51 overlaps the rocker shaft 30 when viewed from the axial direction of the camshaft 14, as shown in FIG. 5, and faces the cam surface of the synchronous cam 13 across the constituent members of the driver 23 (to be described below), as shown in FIGS. 2 and 3. The pivot shaft 51 is pivotally supported by the housing 44.

Figure 8:
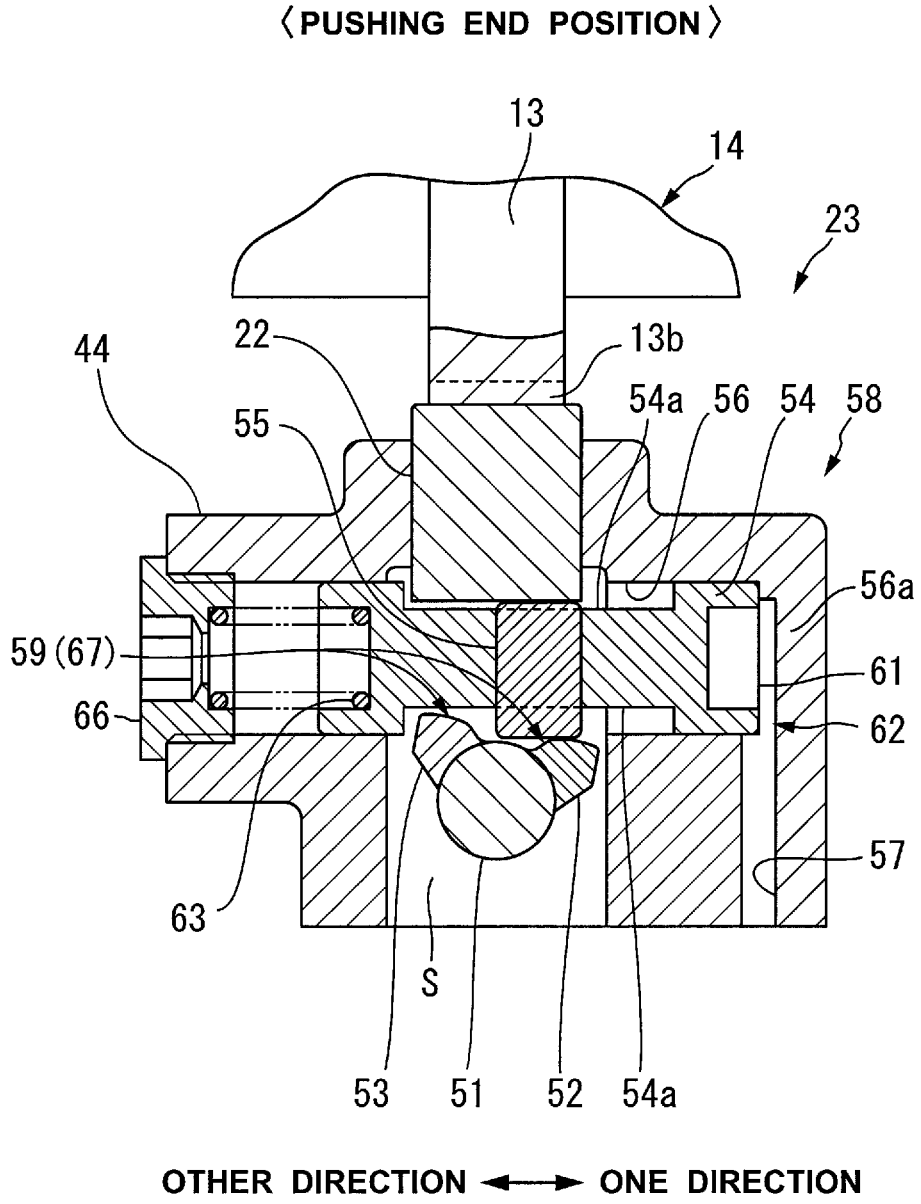
FIG. 8 is a sectional view of a driver according to the first preferred embodiment of the present invention, which is a sectional view of the driver taken along a line A-A in FIG. 5.

As shown in FIGS. 4 and 8, a first projection 52 and a second projection 53 are provided at the other end of the pivot shaft 51. The first projection 52 projects from the pivot shaft 51 in a direction perpendicular or substantially perpendicular to the axial direction of the pivot shaft 51. The second projection 53 projects from the pivot shaft 51 in another direction opposite to the first projection 52.

Figure 16:
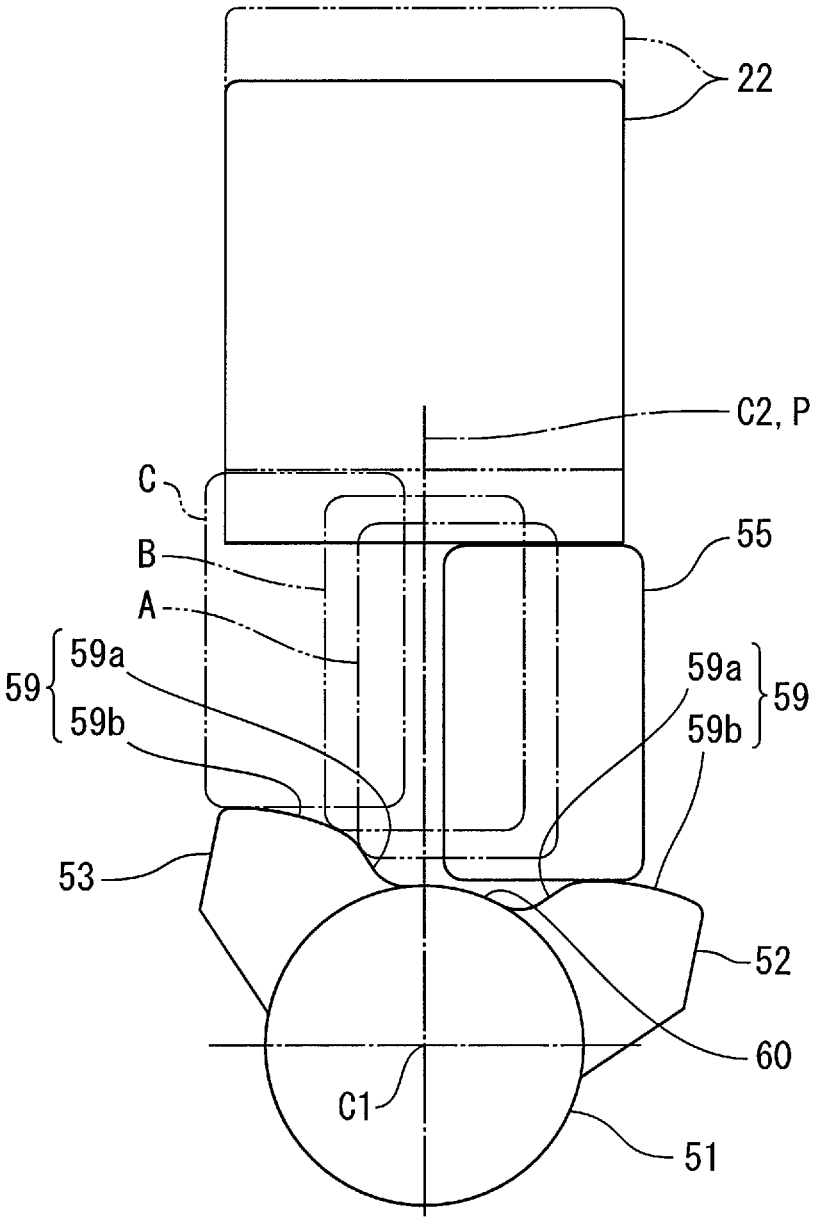
FIG. 16 is an enlarged sectional view of a main portion of the driver according to the first preferred embodiment of the present invention.

The pivot shaft 51 is mounted in the housing 44 in a state in which the first projection 52 and the second projection 53 are arranged in the axial direction of the camshaft 14. The first projection 52 and the second projection 53 are housed in a space S in the housing 44. A side surface of each of the first projection 52 and the second projection 53, which faces the camshaft 14, defines a cam surface 59 that comes into contact with a slide pin 55 (to be described below). As shown in FIG. 16, the cam surface 59 includes a steep slope portion 59*a* and a gentle slope portion 59*b*. The steep slope portion 59*a* is provided on the base side of each of the first and second projections 52 and 53. The gentle slope portion 59*b* is provided on the projecting end of each of the first and second projections 52 and 53.

Figure 17:
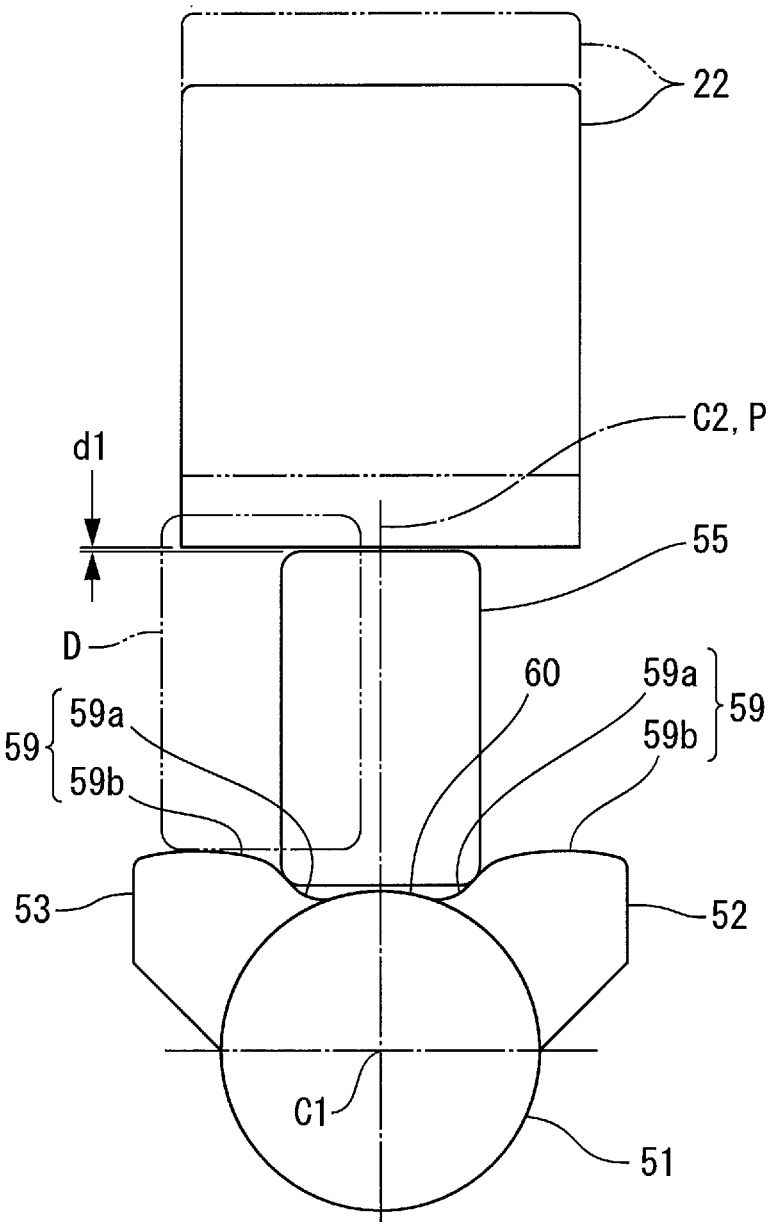
FIG. 17 is an enlarged sectional view of a main portion of the driver according to the first preferred embodiment of the present invention.

As shown in FIG. 17, the steep slope portion 59*a* of the first projection 52 and the steep slope portion 59*a* of the second projection 53 define the inner wall of a concave portion 60 capable of housing the slide pin 55 (to be described below). The concave portion 60 includes the two steep slope portions 59*a* and a portion of the pivot shaft 51. Referring to FIG. 17, an axis C1 of the pivot shaft 51 and an axis C2 of the slide pin 55 are located on the same plane P. In the state shown in FIG. 17, the first projection 52 and the second projection 53 are located so as to be almost symmetrical with respect to the plane P. In FIGS. 16 and 17, the cam follower 22 at a pushing end position is indicated by a solid line, and the cam follower 22 at a pushing start position is indicated by an alternate long and two short dashed line.

The steep slope portion 59*a* of the first projection 52 and the steep slope portion 59*a* of the second projection 53 define a "cam surface."

As shown in FIG. 8, the cam follower 22, a moving member 54, and the slide pin 55 are provided between the synchronous cam 13 and the first projection 52 and the second projection 53.

The cam follower 22 preferably has a columnar shape and is supported by the housing 44 so as to be movable in a first direction that moves close to or away from the axis of the camshaft 14.

The cam follower 22 reciprocally moves between the pushing start position (see FIG. 10) in which the nose 13*b* of the synchronous cam 13 pushes one end surface (the end surface which is opposite to the synchronous cam 13) and the pushing end position (see FIG. 8) in which the pushing by the synchronous cam 13 ends. The period when the nose 13*b* of the synchronous cam 13 pushes the cam follower 22 is the period when the roller 24 of the first rocker arm 25 contacts the circular base 12*a* of the valve drive cam 12 (the period when the intake valves 4 or the exhaust valves 5 are kept closed), in other words, the period when the driving force to drive the intake valves 4 or the exhaust valves 5 is not transmitted to the first to third switch pins 27 to 29 of the switching mechanism 3.

As shown in FIG. 8, the moving member 54 located between the cam follower 22 and the first projection 52 and the second projection 53 preferably has a columnar shape that is long in the second direction perpendicular or substantially perpendicular to the above-described first direction and supported by the housing 44 so as to be movable in the second direction. The second direction is parallel or substantially parallel to the axis of the camshaft 14. The pivot shaft 51 is located at a position opposite to the cam follower 22 across the moving member 54 and supported by the housing 44 so as to be pivotal about an axis extending in a direction perpendicular or substantially perpendicular to the first direction and the second direction.

A cylinder hole 56, which is a non-through hole, extending in the second direction from one side of the housing 44 is provided in the housing 44. The moving member 54 preferably has a columnar shape and is slidably fitted in the cylinder hole 56. One end of the cam follower 22 faces the central portion of the cylinder hole 56 in the axial direction. The cylinder hole 56 communicates with the space S that houses the first projection 52 and the second projection 53. An oil passage 57 is connected to a bottom portion 56*a* located in the innermost location of the cylinder hole 56. The oil passage 57 defines a portion of an actuator 58 that drives the moving member 54.

The actuator 58 according to this preferred embodiment includes a hydraulic device 62 including a piston 61 provided at one end of the moving member 54, and a spring member 63 that biases the other end of the moving member 54 to the side of the one end. The actuator 58 drives the moving member 54 in one direction or the other direction of the second direction. The actuator 58 according to this preferred embodiment corresponds to an "actuator."

The hydraulic device 62 includes a hydraulic pump that is driven by the engine 2 or an electric motor and discharges hydraulic oil, and a switching valve provided between the hydraulic pump and the cylinder hole 56 of the switching mechanism 3. The switching valve is automatically or manually operated to switch between a mode in which an oil pressure is supplied to the cylinder hole 56 and a mode in which the oil pressure in the cylinder hole 56 is canceled or reduced.

The spring member 63 that biases the other end of the moving member 54 includes a compression coil spring and is inserted between the other end of the moving member 54 and a plug member 66 that closes one end of the cylinder hole 56, as shown in FIG. 8.

The moving member 54 reciprocally moves between the plug member 66 and the bottom portion 56*a* of the cylinder hole 56. When the oil pressure is applied to the piston 61 by the hydraulic device 62, the moving member 54 moves to the side of the plug member 66 against the spring force of the spring member 63. When the oil pressure of the hydraulic device 62 is canceled or reduced, the moving member 54 is moved to the side of the bottom portion 56*a* of the cylinder hole 56 by the spring force of the spring member 63.

Figure 12:
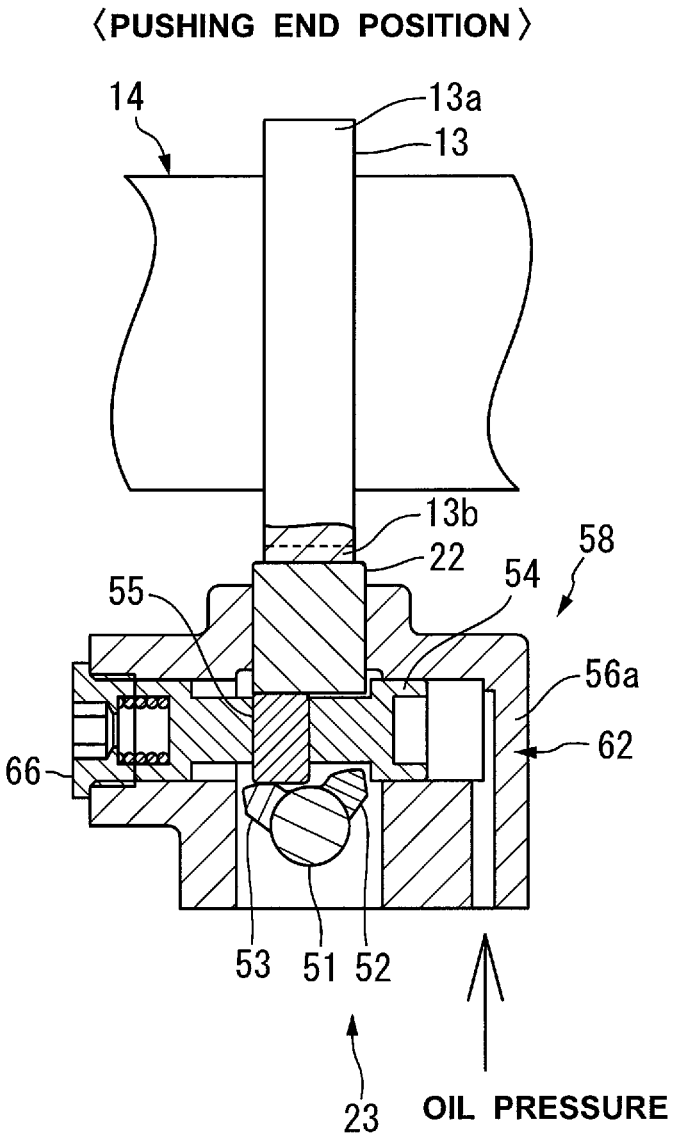
FIG. 12 is a sectional view of the driver according to the first preferred embodiment of the present invention, which is a sectional view of the driver taken along the line A-A in FIG. 5.

At the center of the moving member 54 in the longitudinal direction, two concave grooves 54*a* are provided, and the slide pin 55 is provided. The concave grooves 54*a* extend by a predetermined length in the second direction on the outer surface of the moving member 54. The predetermined length is a length that allows the cam follower 22 to enter the concave grooves 54*a* even when the moving member 54 is located at either of terminating positions on the side of the bottom portion 56*a* and on the side of the plug member 66, as shown in FIGS. 8 and 12. The concave grooves 54*a* are provided on one side and the other side of the moving member 54 in the radial direction. The bottom surface of each concave groove 54*a* is preferably flat.

The slide pin 55 preferably has a columnar shape thinner than the cam follower 22 and is supported by the moving member 54 to be movable in the first direction so as to extend through the central portion of the moving member 54 along the first direction. One end surface of the slide pin 55 always contacts the other end surface of the cam follower 22 during the process of moving the moving member 54 from one end in the cylinder hole 56 to the other end.

Figure 10:
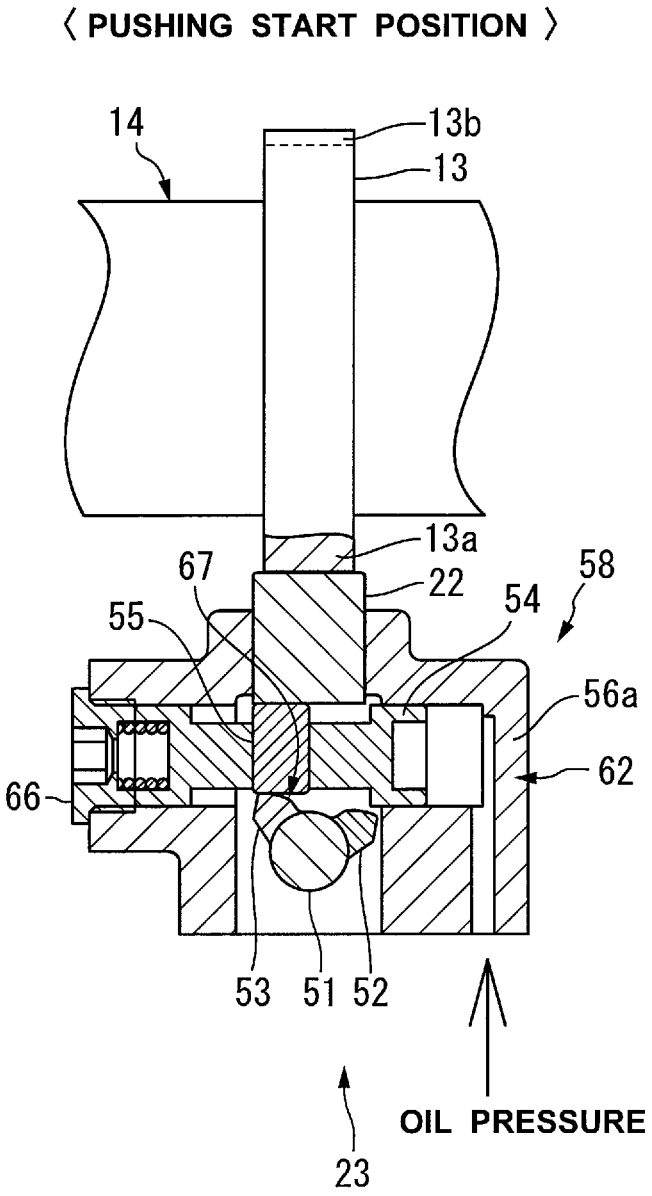
FIG. 10 is a sectional view of the driver according to the first preferred embodiment of the present invention, which is a sectional view of the driver taken along the line A-A in FIG. 5.
Figure 11:
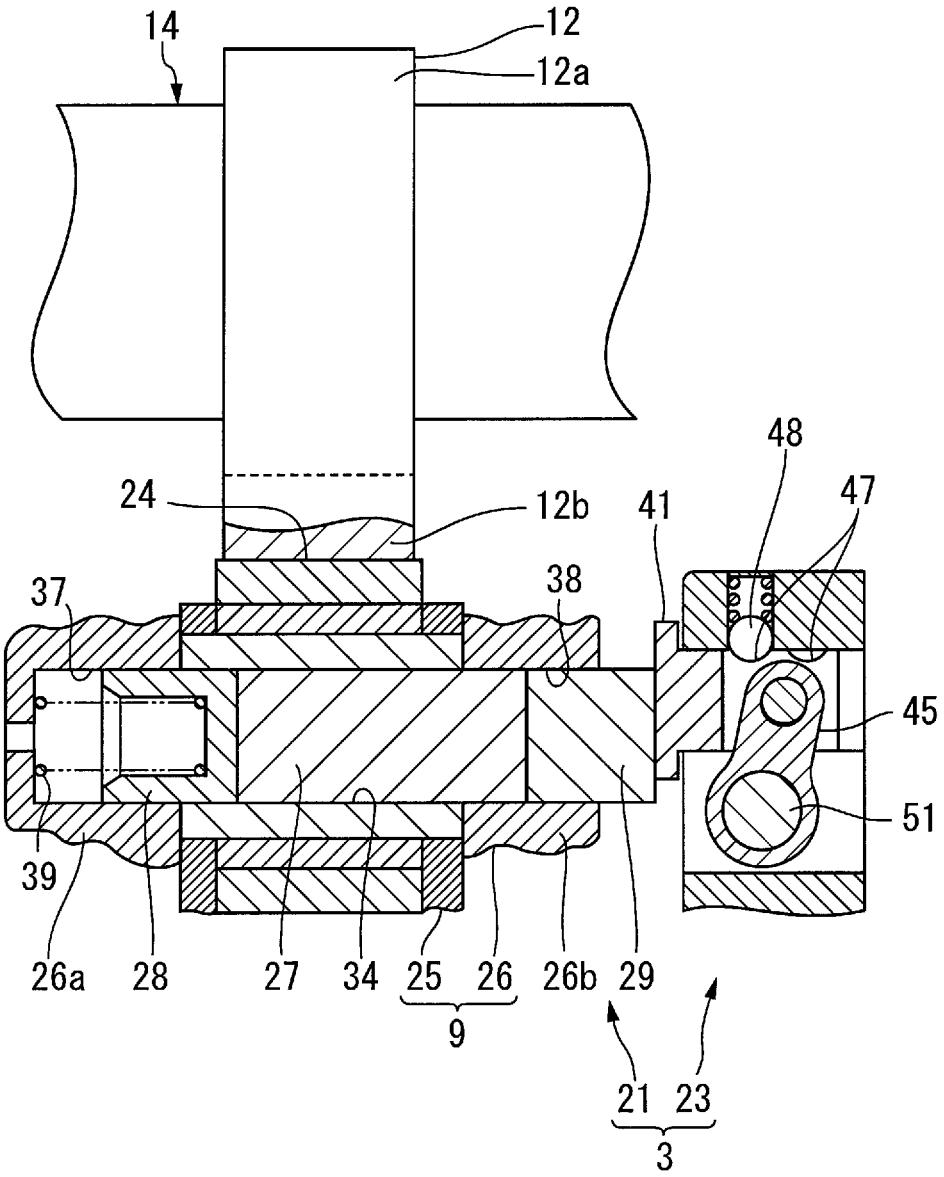
FIG. 11 is a sectional view of the driver according to the first preferred embodiment of the present invention, which is a sectional view of the driver taken along the line B-B in FIG. 5.

When the moving member 54 moves in one direction of the second direction (to the side of the bottom portion 56*a* of the cylinder hole 56), the other end surface of the slide pin 55 faces the first projection 52. When the moving member 54 moves in the other direction of the second direction (to the side of the plug member 66), the other end surface of the slide pin 55 faces the second projection 53, as shown in FIG. 10. When the cam follower 22 presses the slide pin 55 in a state in which the other end surface of the slide pin 55 faces the first projection 52 or the second projection 53, the first projection 52 or the second projection 53 is pushed by the slide pin 55. The length of the slide pin 55 pushes the first projection 52 or the second projection 53 in a direction to move away from the cam follower 22 when the cam follower 22 is pushed by the synchronous cam 13 and moves to the pressing end position.

For this reason, one (the first projection 52 in FIG. 8) of the first projection 52 and the second projection 53, which has the slide pin 55 intervening with respect to the cam follower 22, receives the pushing force, via the slide pin 55, from the cam follower 22 pushed by the synchronous cam 13. The one projection that has received the pushing force makes the pivot shaft 51 pivot to one side where the projection is located (clockwise in FIG. 8).

The first projection 52 and the second projection 53 swing in a so-called seesaw motion about the pivot shaft 51. For this reason, the one projection (the first projection 52 in FIG. 8) pushed by the slide pin 55 tilts in a direction in which the distal end moves away from the cam follower 22. At this time, the other projection (the second projection 53 in FIG. 8) tilts in a direction in which the distal end moves close to the cam follower 22.

That is, the other projection tilts so as to gradually move close to the cam follower 22 from the pivot shaft 51 to the distal end. When the slide pin 55 that has pushed the one projection moves toward the other projection (to the side where the plug member 66 is located in FIG. 8) together with the moving member 54, the other projection that has thus tilted functions as a return cam 67 that pushes the slide pin 55 to the side of the cam follower 22. When the other projection functions as the return cam 67, the slide pin 55 contacts the above-described cam surface 59, and the moving direction of the slide pin 55 changes. This means that the cam surface 59 actually functions as the return cam.

The time when the moving member 54 moves is the time when the slide pin 55 is not pushed by the cam follower 22. This is because when pushed by the cam follower 22, the slide pin 55 cannot move to the side of the cam follower 22 along the return cam 67. For this reason, the moving member 54 stands by without moving until two conditions to be described below are met, and moves after the two conditions are met. The first condition of the two conditions is that an oil pressure or the spring force of the spring member 63 is applied. The second condition is that the cam follower 22 faces the circular base 13*a* of the synchronous cam 13.

When the moving member 54 moves, and the slide pin 55 is pushed by the above-described return cam 67, the slide pin 55 pushes the cam follower 22 upward and returns it from the pushing end position to the pushing start position (see FIG. 10).

The operation of the valve gear 1 for the engine 2 including the above-described arrangement will be described next in detail with reference to FIGS. 8 to 16. An operation performed when the switching mechanism 3 switches the operation mode of the engine 2 from the full cylinder operation mode to the partial cylinder operation mode will be described first. When the full cylinder operation mode is used, the switching mechanism 3 is in the state shown in FIGS. 8 and 9. That is, the moving member 54 of the driver 23 is pushed by the spring force of the spring member 63 and moved to one end (the side of the bottom portion 56*a* of the cylinder hole 56). The drive lever 45 and the pivot shaft 51 are rotated clockwise in FIGS. 8 and 9. When the drive lever 45 is rotated in this way, the pushing element 41 is located at the retreat position, and the first to third switch pins 27 to 29 are located at the connecting positions. The first rocker arm 25 and the second rocker arm 26 are connected and integrally swing.

The valve gear 1 for the engine 2 starts operating when the rotation of a crankshaft (not shown) is transmitted to the camshaft 14. When the rotation of the crankshaft is transmitted to the camshaft 14, the valve drive cam 12 and the synchronous cam 13 rotate. In the full cylinder operation mode, the rotation of the valve drive cam 12 is transmitted from the first rocker arm 25 to the second rocker arm 26 via the first switch pin 27 and the second switch pin 28 to drive the intake valves 4 or the exhaust valves 5. At this time, the synchronous cam 13 idles without pushing the cam follower 22 because the cam follower 22 is located at the pushing end position.

To switch the operation mode from the full cylinder operation mode to the partial cylinder operation mode, first, an oil pressure is supplied to the piston 61 manually or automatically by the hydraulic device 62 of the actuator 58 in an arbitrary period. At this time, the moving member 54 is biased by the oil pressure to the other end (the left side or the side of the plug member 66 in FIG. 8) that is the opposite side of the current position in FIG. 8. When the oil pressure thus acts on the moving member 54, the moving member 54 moves to the side of the plug member 66 against the spring force of the spring member 63. Along with this movement, the slide pin 55 strikes the cam surface 59 of the second projection 53. To further move the moving member 54 by the oil pressure from the state in which the slide pin 55 strikes the second projection 53, the slide pin 55 needs to move upward along the steep slope portion 59*a* of the cam surface 59 and move in the direction to push the cam follower 22.

In a case in which the nose 13*b* of the synchronous cam 13 faces the cam follower 22, as shown in FIG. 8, the movement of the cam follower 22 in the direction to return to the pushing start position is regulated by the synchronous cam 13. For this reason, during the time when the movement of the cam follower 22 is regulated, the moving member 54 does not further move to the side of the plug member 66 from the state in which the slide pin 55 strikes the second projection 53 even if the oil pressure is applied to the moving member 54.

When the synchronous cam 13 further rotates from the above-described state, and the circular base 13*a* faces the cam follower 22 while keeping the oil pressure supplied, or in a case in which the circular base 13*a* of the synchronous cam 13 faces the cam follower 22 when the oil pressure is applied to the moving member 54, the cam follower 22 moves in the direction to return to the pushing start position. For this reason, in this case, when the oil pressure is applied to the moving member 54, the moving member 54 further moves in the cylinder hole 56 to the side of the plug member 66 against the spring force of the spring member 63. In addition, the slide pin 55 is pushed against the steep slope portion 59*a* and slips, and moves in the direction to move close to the synchronous cam 13, as indicated by an alternate long and two short dashed line A in FIG. 16. At this time, the second projection 53 is never pushed by the slide pin 55 and tilts. This is because the ball 48 engages with the concave portion 47, and the pivotal motion of the pivot shaft 51 is regulated. For this reason, the pushing element 41 is held at the retreat position, and the first to third switch pins 27 to 29 are held at the connecting positions.

When the moving member 54 is further moved by the oil pressure, the slide pin 55 moves to a position indicated by an alternate long and two short dashed line C via a position indicated by an alternate long and two short dashed line B in FIG. 16. Here, the position indicated by the alternate long and two short dashed line B is the position at which the slide pin 55 contacts the gentle slope portion 59*b* or the position at which the axis C1 of the pivot shaft 51 and the axis C2 of the slide pin 55 are arranged on the same plane P. The position indicated by the alternate long and two short dashed line C is the position at which the cam follower 22 returns to the moving start position. For this reason, if the moving member 54 moves in the state in which the cam follower 22 faces the circular base 13*a* of the synchronous cam 13, the cam follower 22 is pushed by the slide pin 55 and returns to the pushing start position, and the state shown in FIG. 10 is obtained.

The camshaft 14 is rotating even when the moving member 54 and the slide pin 55 are moving as described above. Hence, in a state in which the slide pin 55 is in contact with the steep slope portion 59*a*, as indicated by the alternate long and two short dashed line A in FIG. 16, the nose 13*b* of the synchronous cam 13 may push the cam follower 22. In this case, the slide pin 55 is pushed by the cam follower 22 and slides down along the steep slope portion 59*a*, and the moving member 54 retreats against the oil pressure.

When the nose 13*b* of the synchronous cam 13 pushes the cam follower 22 in a state in which the slide pin 55 has moved to the position indicated by the alternate long and two short dashed line B in FIG. 16, the second projection 53 is pushed by the slide pin 55, and the pivot shaft 51 rotates counterclockwise, as shown in FIG. 17. The distal end of the slide pin 55 then retracts into the concave portion 60. At this time, a slight gap d1 is provided in the vertical direction of the slide pin 55, and the slide pin 55 does not push the pivot shaft 51. When the circular base 13*a* of the synchronous cam 13 faces the cam follower 22 in this state, the moving member 54 is pushed by the oil pressure and further moves. The slide pin 55 moves to a position overlapping the gentle slope portion 59*b* of the second projection 53, as indicated by an alternate long and two short dashed line D in FIG. 17, and pushes the cam follower 22 toward the pushing start position.

After being returned from the pushing end position to the pushing start position (FIG. 10), the cam follower 22 is pushed again by the nose 13*b* of the synchronous cam 13 that is continuously rotating. The time when the cam follower 22 is pushed by the nose 13*b* of the synchronous cam 13 is the time when the intake valves 4 or the exhaust valves 5 are kept closed or the time when the first to third switch pins 27 to 29 of the switching mechanism 3 move. The cam follower 22 is pushed by the nose 13*b* of the synchronous cam 13 and thus moves to the pushing end position, as shown in FIG. 12. When the cam follower 22 moves in this way, the slide pin 55 pushes the second projection 53 up to the final position, and the pivot shaft 51 rotates in a direction (counterclockwise in FIG. 12) reverse to that in the previous time. When the second projection 53 is pushed by the slide pin 55, and the pivot shaft 51 rotates, the state in which the ball 48 engages with the concave portion 47 of the pushing element 41 is temporarily canceled. That is, the ball 48 leaves one concave portion 47 and enters the other concave portion 47. Note that the phenomenon in which the engaging state of the ball 48 is temporarily canceled also occurs when the first projection 52 is pushed by the slide pin 55.

Figure 13:
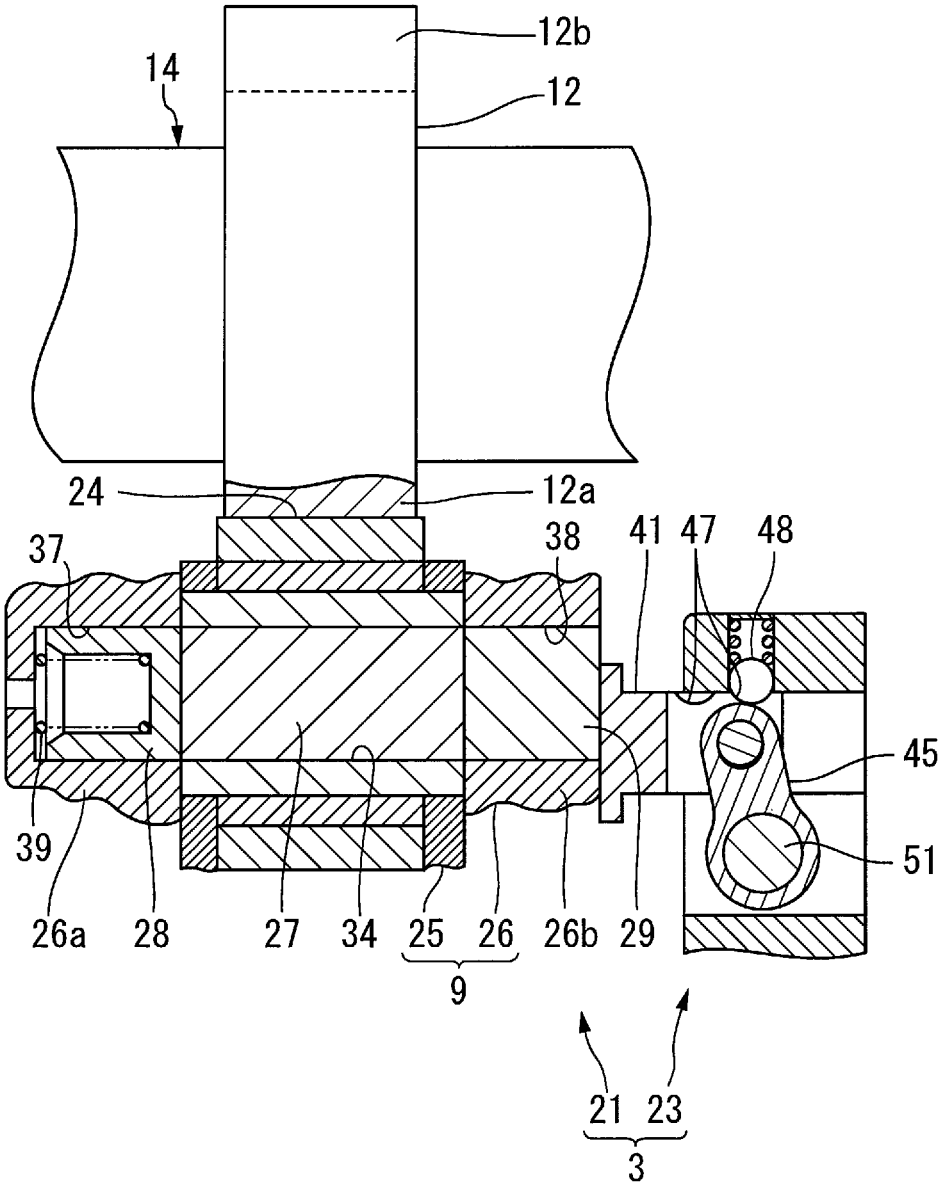
FIG. 13 is a sectional view of the driver according to the first preferred embodiment of the present invention, which is a sectional view of the driver taken along the line B-B in FIG. 5.

When the pivot shaft 51 rotates in this way, the drive lever 45 swings in the same direction, the pushing element 41 moves to the advance position, and the first to third switch pins 27 to 29 move to the non-connecting positions, as shown in FIG. 13. At this time, the first to third switch pins 27 to 29 are in a movable state, and therefore smoothly move when pushed by the pushing element 41. As a result, the connected state between the first rocker arm 25 and the second rocker arm 26 is canceled. In this case, only the first rocker arm 25 swings along with the rotation of the valve drive cam 12, and the second rocker arm 26 stops. When the second rocker arm 26 stops, the intake valves 4 or the exhaust valves 5 are closed and held in the stop state (rest state). For this reason, the operation mode of the engine 2 is switched from the full cylinder operation mode to the partial cylinder operation mode by the switching mechanism 3.

Figure 14:
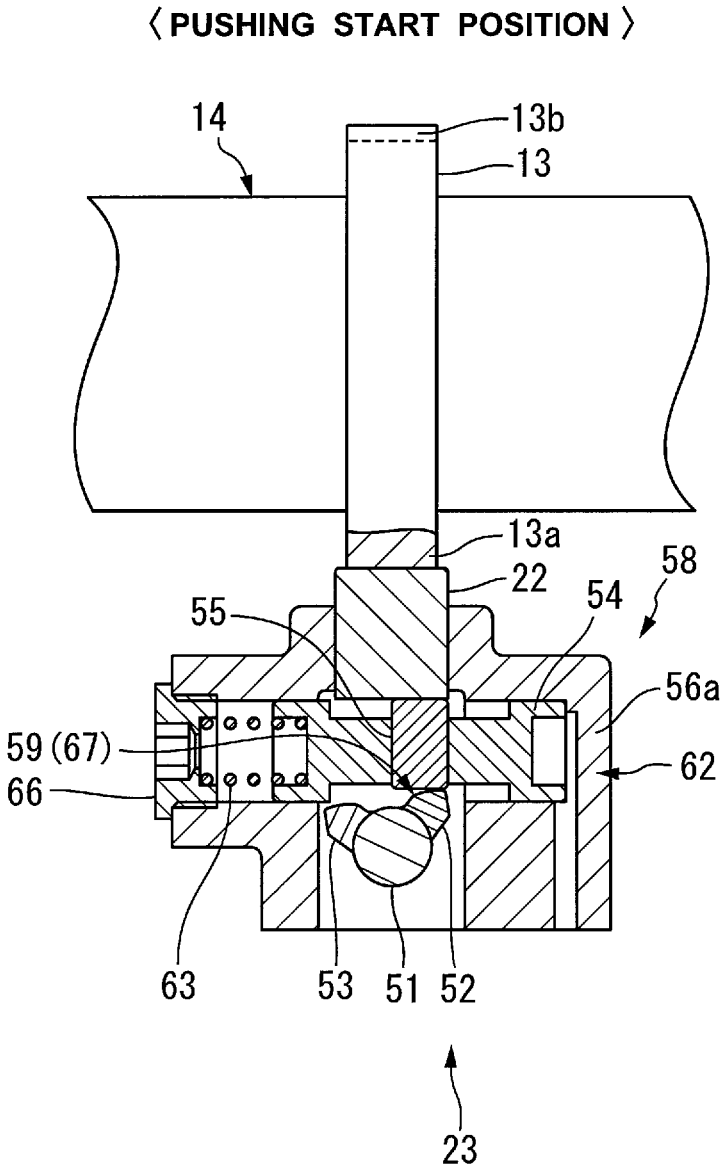
FIG. 14 is a sectional view of the driver according to the first preferred embodiment of the present invention, which is a sectional view of the driver taken along the line A-A in FIG. 5.

To switch the operation mode of the engine 2 from the partial cylinder operation mode in which the intake valves 4 or the exhaust valves 5 are at rest to the full cylinder operation mode, the oil pressure supply by the hydraulic device 62 of the actuator 58 is manually or automatically stopped in an arbitrary period. When the oil pressure supply stops, the moving member 54 is moved to the side of the bottom portion 56*a* of the cylinder hole 56 by the spring force of the spring member 63 when the circular base 13*a* of the synchronous cam 13 faces the cam follower 22, as shown in FIG. 14.

Along with the movement of the moving member 54, the slide pin 55 slips while being pushed against the tilted first projection 52, and moves in the direction to move close to the synchronous cam 13. When the slide pin 55 moves in this way, the cam follower 22 is returned from the pushing end position to the pushing start position.

Figure 15:
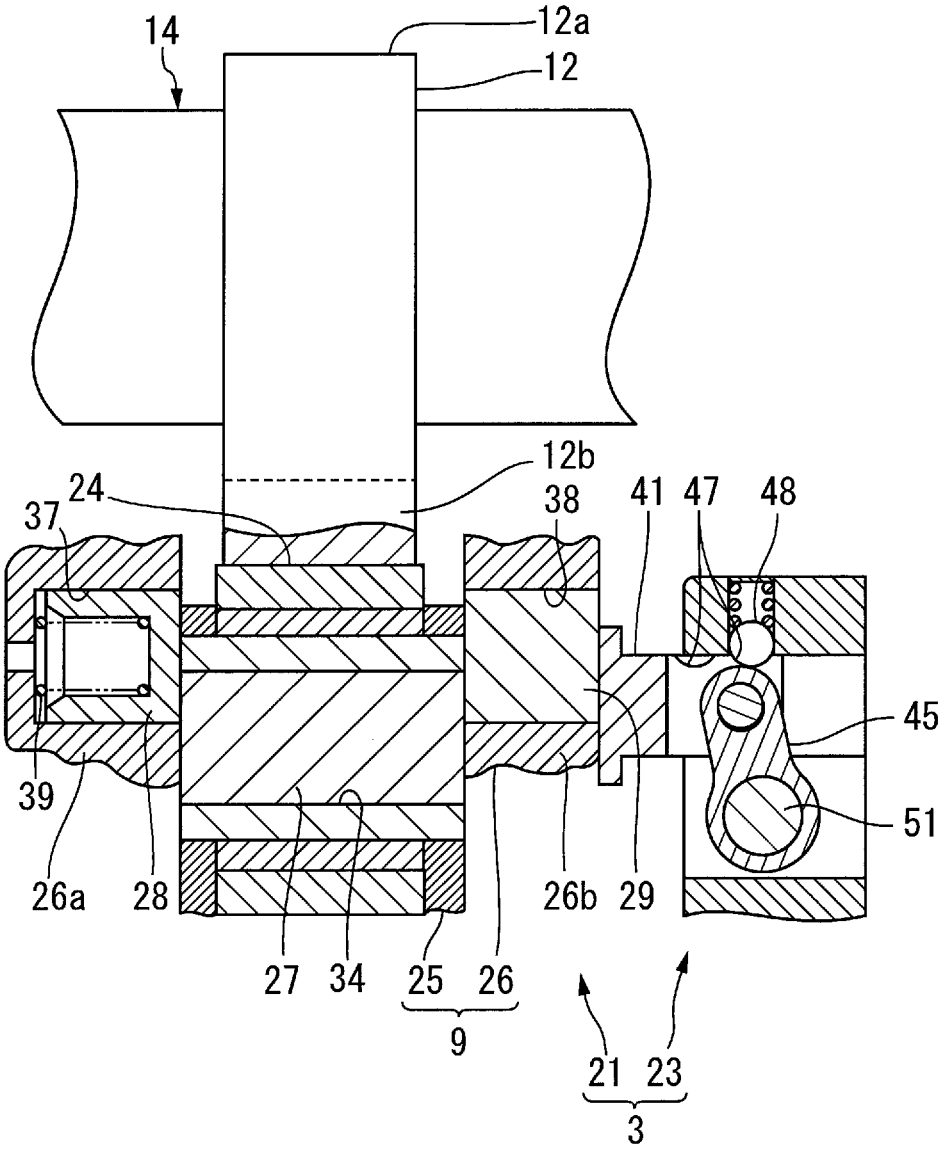
FIG. 15 is a sectional view of the driver according to the first preferred embodiment of the present invention, which is a sectional view of the driver taken along the line B-B in FIG. 5.

At this time, since the pivot shaft 51 does not rotate, the pushing element 41 is held at the advance position, and the first to third switch pins 27 to 29 are held at the non-connecting positions, as shown in FIG. 15.

When the synchronous cam 13 rotates in a state in which the cam follower 22 is located at the pushing start position (see FIG. 14), the nose 13*b* of the synchronous cam 13 comes into contact with the cam follower 22, and the cam follower 22 is pushed toward the pushing end position. The cam follower 22 then moves to the pushing end position shown in FIG. 8. The time when the nose 13*b* of the synchronous cam 13 pushes the cam follower 22 is the time when the circular base 12*a* of the valve drive cam 12 is in contact with the roller 24, as shown in FIG. 9.

Along with the movement of the cam follower 22, the slide pin 55 moves in the same direction as the cam follower 22 and is pushed against the first projection 52. When the first projection 52 shown in FIG. 14 is pushed by the slide pin 55, the pivot shaft 51 rotates clockwise from the position shown in FIG. 14 to the position shown in FIG. 8. Note that at this time as well, the ball 48 leaves one concave portion 47 and enters the other concave portion 47.

When the pivot shaft 51 rotates in this way, the drive lever 45 swings clockwise from the position shown in FIG. 15 to the position shown in FIG. 9. The time when the drive lever 45 swings in this way is the time when the intake valves 4 or the exhaust valves 5 are kept closed, and the driving force is not transmitted to the first arm main body 26*a* and the second arm main body 26*b* (the time when the movement of the first to third switch pins 27 to 29 is not regulated).

When the drive lever 45 swings in this way, the pushing element 41 moves to the retreat position shown in FIG. 9, and the first to third switch pins 27 to 29 are moved to the connecting positions by the spring force of the spring member 39.

When the first to third switch pins 27 to 29 move to the connecting positions in this way, the first rocker arm 25 and the second rocker arm 26 are connected. As a result, the intake valves 4 or the exhaust valves 5 are driven by the valve drive cam 12, and the operation mode of the engine 2 shifts to the full cylinder operation mode.

Hence, according to this preferred embodiment, when the intake valves 4 or the exhaust valves 5 are kept closed, and the first to third switch pins 27 to 29 of the switching mechanism 3 move, the switching mechanism 3 is driven by a pushing force generated when the synchronous cam 13 pushes the cam follower 22. Hence, since the time when the intake valves 4 or the exhaust valves 5 are kept closed, and the first to third pin holes 34, 37, and 38 are located on the same axis synchronizes with the time when the first to third switch pins 27 to 29 move, the first to third switch pins 27 to 29 always smoothly move in an optimum period.

It is consequently possible to reliably prevent the first to third switch pins 27 to 29 from being flicked by the rocker arm 9 when the intake valves 4 or the exhaust valves 5 are open.

Since the flick phenomenon does not occur, the intake valves 4 or the exhaust valves 5 are never abruptly closed and damaged, or the first to third switch pins 27 to 29 are never damaged by an excessive load.

Hence, according to this preferred embodiment, it is possible to provide a valve gear for an engine, which reliably prevents damage to elements and implements a reliable operation of switching the drive mode of an intake valve or an exhaust valve.

One of the first projection 52 and the second projection 53 according to this preferred embodiment, which has the slide pin 55 intervening with respect to the cam follower 22, receives the pushing force, via the slide pin 55, from the cam follower 22 pushed by the synchronous cam 13, thus rotating the pivot shaft 51 to one side where the one projection is located.

The other projection functions as the return cam 67 that pushes the slide pin 55 to the side of the cam follower 22 and returns the cam follower 22 to the pushing start position when the slide pin 55 that has pushed the one projection moves toward the other projection together with the moving member 54.

According to this preferred embodiment, the cam follower 22 is returned to the pushing start position using the first and second projections 52 and 53 that convert the reciprocating motion of the cam follower 22 into a pivotal motion. For this reason, since a mechanism that exclusively returns the cam follower 22 to the pushing start position is unnecessary, it is possible to reduce the number of elements and to provide a compact driver 23.

The actuator 58 according to this preferred embodiment includes the hydraulic device 62 with the piston 61 provided at one end of the moving member 54, and the spring member 63 that biases the other end of the moving member 54 to the one end.

Hence, when an oil pressure is applied to the piston 61, the moving member 54 moves in the other direction (to the side of the plug member 66) of the second direction against the spring force of the spring member 63. When the oil pressure applied to the piston 61 is canceled or reduced, the moving member 54 moves in one direction (to the side of the bottom portion 56*a* of the cylinder hole 56) in the second direction by the spring force of the spring member 63. That is, the moving member 54 reciprocally moves as the state in which the oil pressure is supplied and the state in which the oil pressure is canceled or reduced are alternately repeated.

Hence, according to this preferred embodiment, since the switching operation of the switch 21 is controlled by the oil pressure, the hydraulic pump or switching valve of the hydraulic device 62 is able to be arranged at a position spaced apart from the switching mechanism 3. For this reason, as compared to an arrangement in which the switching operation of the switch 21 is mechanically controlled by, for example, a solenoid or the like, the degree of freedom of layout of the switching mechanism 3 is high.

The concave portion 60 capable of housing the distal end of the slide pin 55 pushed by the cam follower 22 and moved is located between the first projection 52 and the second projection 53 according to this preferred embodiment. The inner wall of the concave portion 60 is defined by the cam surfaces 59 (steep slope portions 59*a*) that function as the return cam 67 in the first projection 52 and the second projection 53.

Hence, if a pushing force is applied from the cam follower 22 to the slide pin 55 during movement along the cam surface 59, the slide pin 55 retracts into the concave portion 60 without forcibly pushing the first and second projections 52 and 53 or the pivot shaft 51. Hence, according to this preferred embodiment, it is possible to provide a valve gear for an engine which operates more smoothly.

The rocker arm 9 according to this preferred embodiment includes the first rocker arm 25 and the second rocker arm 26. The first rocker arm 25 is pushed by the valve drive cam 12 and swings. The second rocker arm 26 is swingably provided at a position adjacent to the first rocker arm 25 in the axial direction of the camshaft 14, and the pushers 36 that push the intake valves 4 or the exhaust valves 5 are provided at the swinging ends.

In the first rocker arm 25 and the second rocker arm 26, the first to third pin holes 34, 37, and 38 extending in the axial direction of the camshaft 14 are arranged across the members. In this preferred embodiment, the members driven by the driver 23 are the first to third switch pins 27 to 29 movably fitted in the first to third pin holes 34, 37, and 38 and arranged in the axial direction of the camshaft 14. When the pivot shaft 51 rotates in one direction, the first to third switch pins 27 to 29 move to connecting positions across the first rocker arm 25 and the second rocker arm 26 and connect the two rocker arms 9. When the pivot shaft 51 rotates in the other direction, the first to third switch pins 27 to 29 move from the positions across the first rocker arm 25 and the second rocker arm 26 and cancel the connected state between the two rocker arms 25 and 26.

In the connected state in which the two rocker arms 9 are connected by the first to third switch pins 27 to 29, the pushing force generated when the valve drive cam 12 pushes the first rocker arm 25 is transmitted from the first rocker arm 25 to the second rocker arm 26 via the first switch pin 27 and the second switch pin 28 to drive the intake valves 4 or the exhaust valves 5. In the non-connected state in which the connected state between the two rocker arms 25 and 26 is canceled, the pushing force is not transmitted from the first rocker arm 25 to the second rocker arm 26 even if the valve drive cam 12 pushes the first rocker arm 25. In this case, the intake valves 4 or the exhaust valves 5 are kept in the closed state.

Hence, according to this preferred embodiment, it is possible to provide a valve gear for an engine which correctly switches between the first drive mode in which the intake valves 4 or the exhaust valves 5 are driven and the second drive mode in which the intake valves 4 or the exhaust valves 5 are stopped.

The engine 2 according to this preferred embodiment is preferably a multi-cylinder (four-cylinder) engine, for example. In this preferred embodiment, the first drive mode is a drive mode in which the intake valves 4 or the exhaust valves 5 are driven as usual. The second drive mode is a drive mode in which the intake valves 4 or the exhaust valves 5 keep the closed state. The switching mechanism 3 according to this preferred embodiment switches the drive mode of the intake valves 4 or the exhaust valves 5 in cylinders that are selectively put at rest.

According to this preferred embodiment, it is possible to provide a valve gear for an engine which selectively puts some of a plurality of cylinders at rest.

Second Preferred Embodiment

Figure 18:
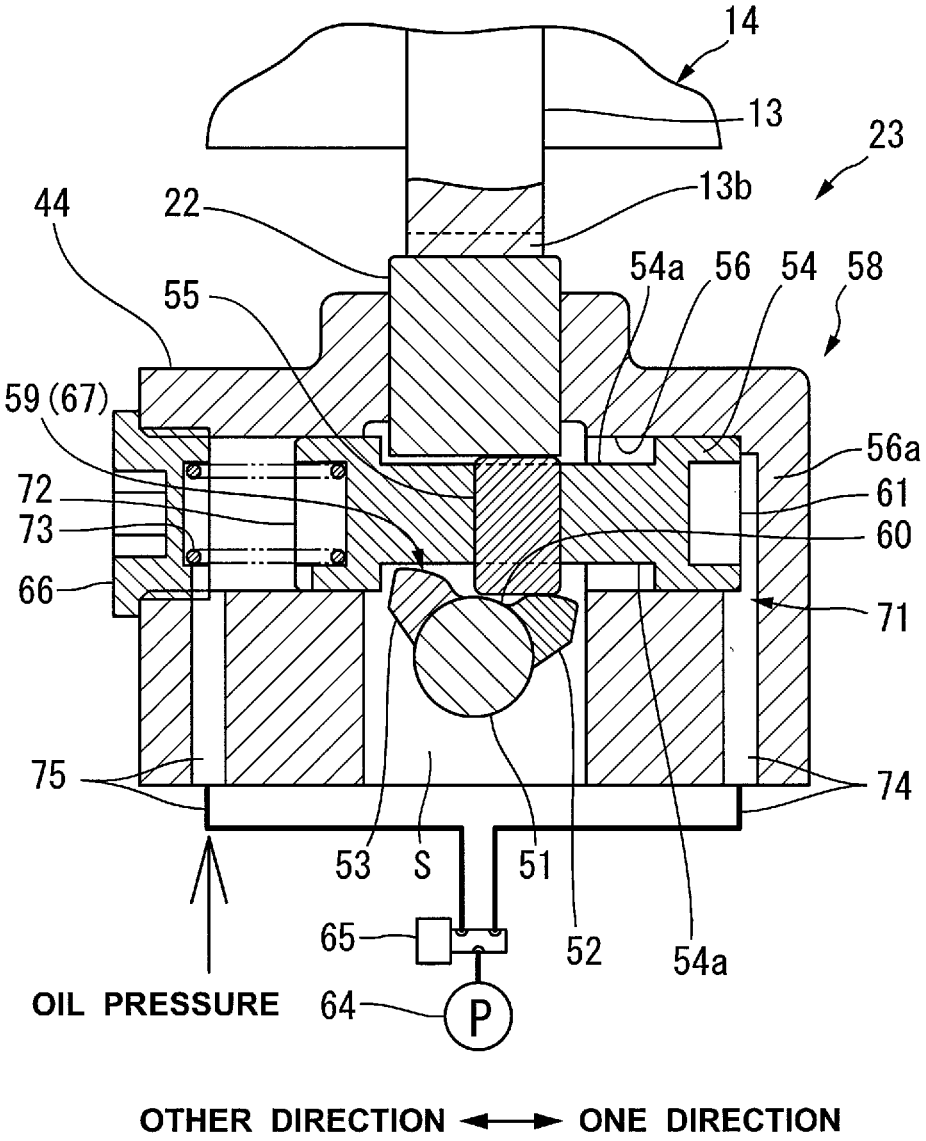
FIG. 18 is a sectional view of a driver according to a second preferred embodiment of the present invention.
Figure 19:
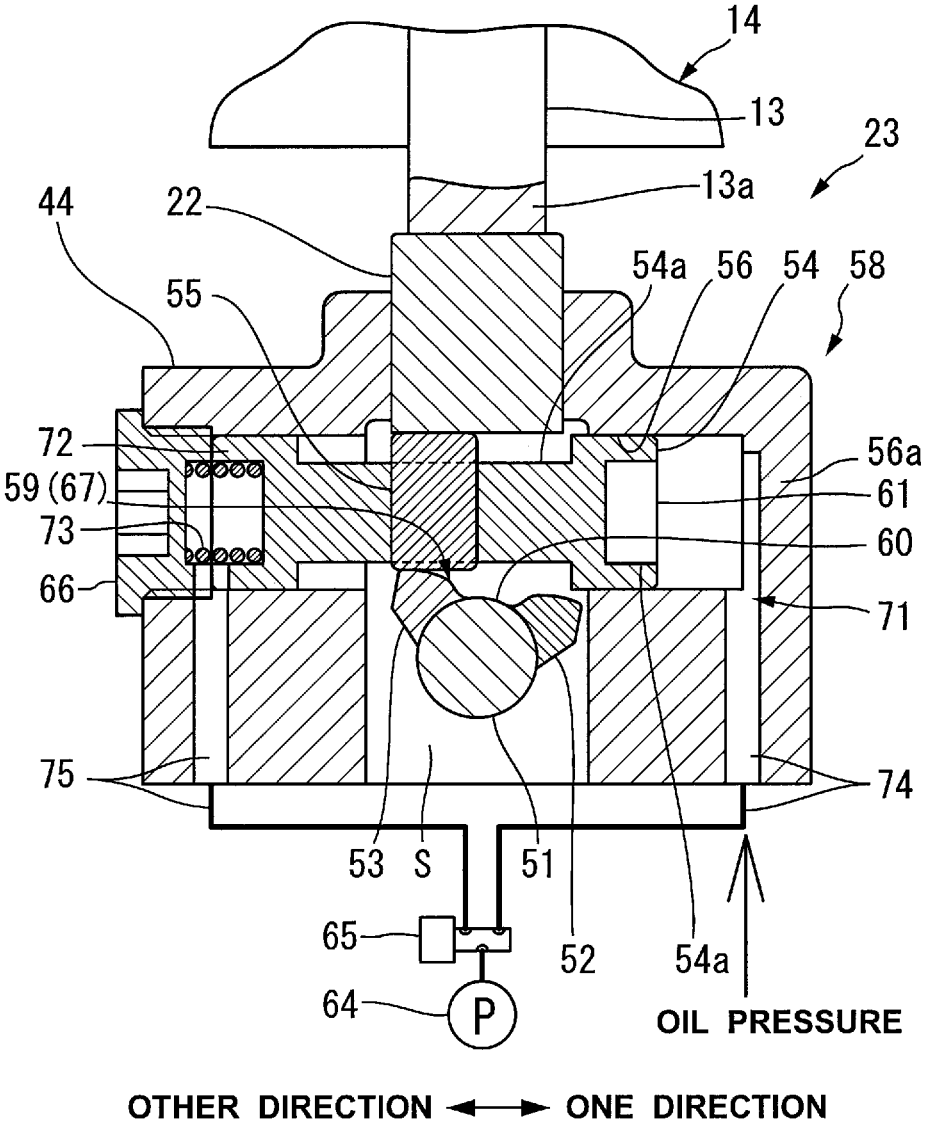
FIG. 19 is a sectional view of the driver according to the second preferred embodiment of the present invention.

The actuator provided in the driver of the switching mechanism may be configured as shown in FIGS. 18 and 19. The same reference numerals as those of the members described with reference to FIGS. 1 to 17 denote the same or similar members in FIGS. 18 and 19, and a detailed description thereof will appropriately be omitted.

An actuator 58 shown in FIG. 18 includes a hydraulic device 71. The hydraulic device 71 according to this preferred embodiment includes a piston (to be referred to as a first piston hereinafter) 61 provided at one end of a moving member 54 and a second piston 72 provided at the other end of the moving member 54.

When an oil pressure is applied to the second piston 72, the moving member 54 according to this preferred embodiment moves to the side of a bottom portion 56*a* of a cylinder hole 56, as shown in FIG. 18. When an oil pressure is applied to the first piston 61, the moving member 54 moves to the side of a plug member 66, as shown in FIG. 19. The moving member 54 moves in the second direction when a cam follower 22 faces a circular base 13*a* of a synchronous cam 13.

A compression coil spring 73 that biases the moving member 54 in one direction of the second direction is provided between the second piston 72 and the plug member 66. The compression coil spring 73 corresponds to a "spring member," and is structured to avoid uncontrollability caused by cutoff of the oil pressure supply. The spring load of the compression coil spring 73 is preferably lower than that of the spring member 63 used in the first preferred embodiment because the purpose is different from that of the spring member 63.

When the moving member 54 is pushed by the spring force of the compression coil spring 73 and moved to the side of the bottom portion 56*a* of the cylinder hole 56, a pushing element 41 moves to the retreat position, and first to third switch pins 27 to 29 move to the connecting positions, as shown in FIG. 9 in a case in which the first preferred embodiment is used. For this reason, even if the oil pressure is cut off due to some reason, a valve gear 1 is set in the above-described first drive mode, and therefore, an engine 2 is operated as usual. The first drive mode is the full cylinder operation mode which is a drive mode advantageous in starting the engine 2 or a drive mode used at the time of idling.

The bottom portion 56*a* of the cylinder hole 56 communicates with a switching valve 65 via a first oil passage 74. The other end (a side end of the plug member 66) of the cylinder hole 56 communicates with the switching valve 65 via a second oil passage 75. The switching valve 65 automatically or manually performs a switching operation to implement two modes to be described below. The first mode is a mode in which the oil pressure supplied from a hydraulic pump 64 is supplied to the first oil passage 74, and the oil pressure in the second oil passage 75 is canceled or reduced. The second mode is a mode in which the oil pressure supplied from the hydraulic pump 64 is supplied to the second oil passage 75, and the oil pressure in the first oil passage 74 is canceled or reduced.

The first oil passage 74 and the second oil passage 75 connect the cylinder holes 56 of the switching mechanisms 3 for the intake valves and the exhaust valves of all cylinders with the switching mechanisms 3 to the switching valve 65, although not illustrated.

The moving member 54 according to this preferred embodiment moves in the other direction (to the side of the plug member 66) of the second direction when the oil pressure is applied to the first piston 61, and moves in one direction (to the side of the bottom portion 56*a* of the cylinder hole 56) of the second direction when the oil pressure is applied to the second piston 72.

Hence, according to this preferred embodiment, since the switching operation of the switch 21 in both directions is controlled by the oil pressure, the degree of freedom in setting the magnitude of the oil pressure becomes higher than in a case in which the first preferred embodiment with the spring member 63 is used. In this preferred embodiment, the moving member 54 need not be pushed against a large spring force like that of the spring member 63 according to the first preferred embodiment, and therefore, the oil pressure is able to be set lower. This means that the normal rotation speed of the hydraulic pump 64 is relatively low, and the switching operation is performed even if the rotation speed of the engine 2 is low.

The valve gear 1 according to this preferred embodiment includes the compression coil spring 73 that biases the moving member 54 in one direction of the second direction. The direction in which the compression coil spring 73 biases the moving member 54 is the direction in which the drive mode is switched to the drive mode that is advantageous in starting the engine out of the first drive mode and the second drive mode.

For this reason, even if the oil pressure is cut off due to some reason, the engine 2 is operated without any trouble. It is therefore possible to provide a reliable valve gear for an engine.

Third Preferred Embodiment

Figure 20:
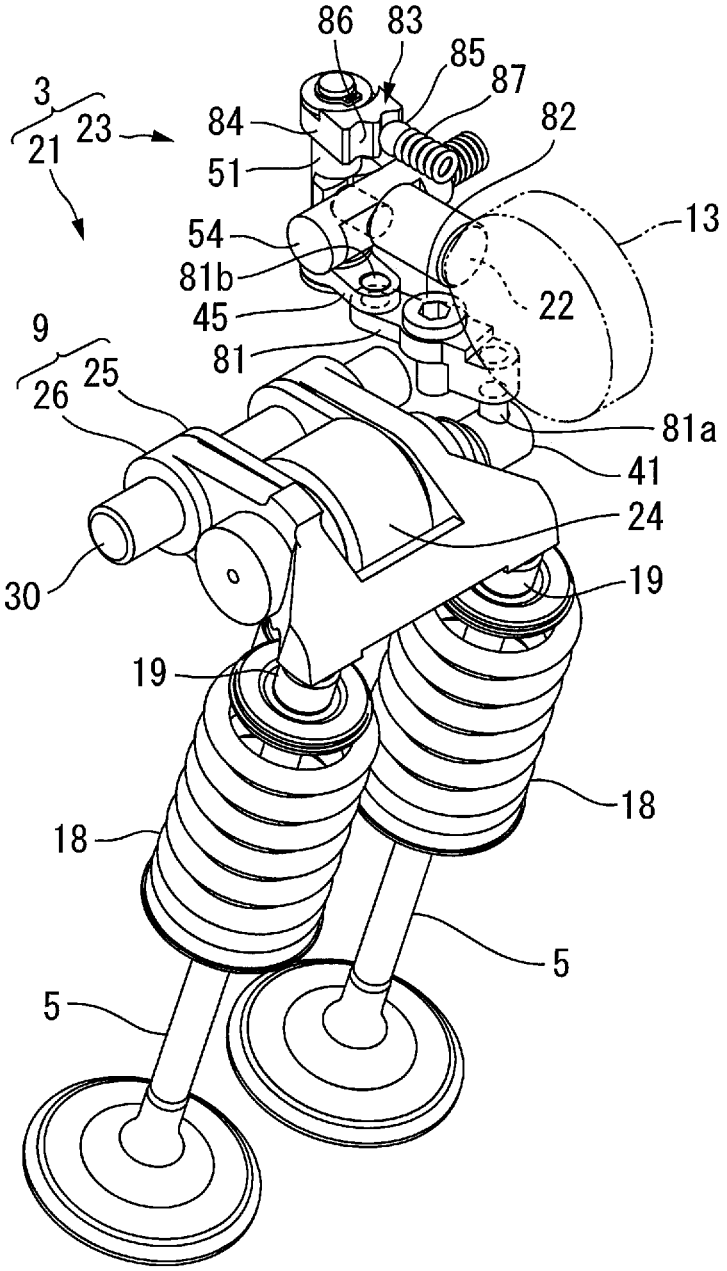
FIG. 20 is a perspective view of a main portion according to a third preferred embodiment of the present invention.
Figure 21:
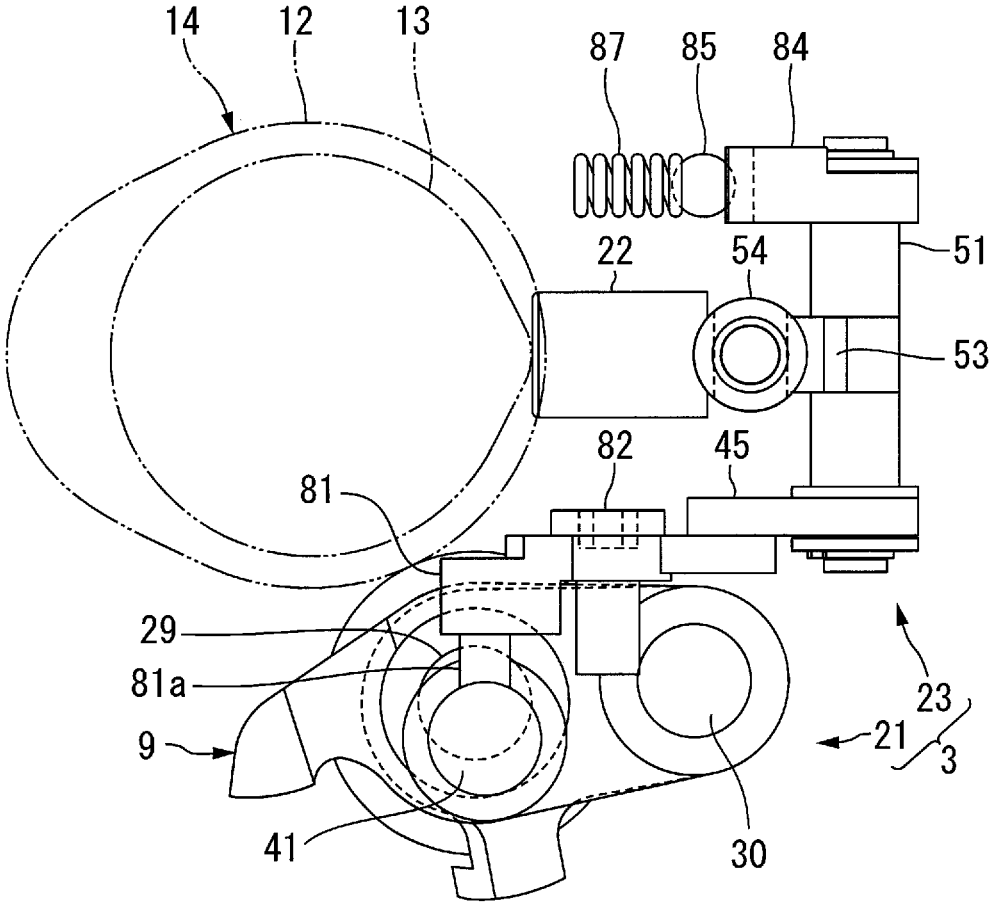
FIG. 21 is a side view of a main portion according to the third preferred embodiment of the present invention.
Figure 22:
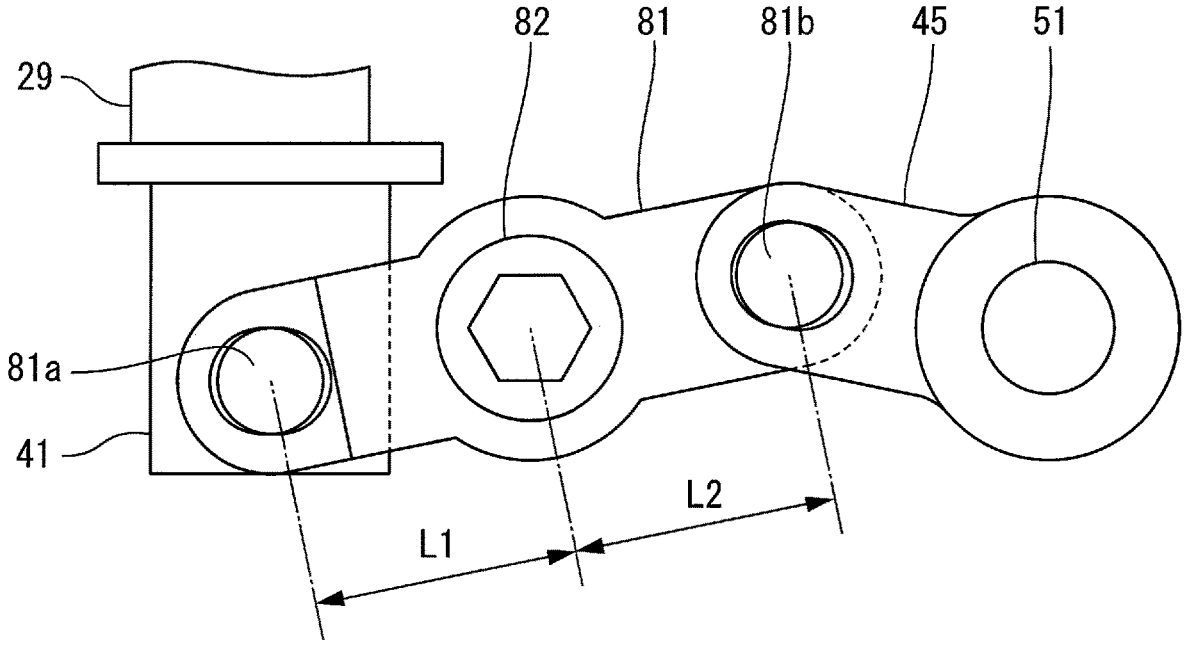
FIG. 22 is a plan view for explaining the arrangement of a connecting lever according to the third preferred embodiment of the present invention.

The transmission provided in the switching mechanism may include a structure as shown in FIGS. 20 to 22. The same reference numerals as those of the members described with reference to FIGS. 1 to 19 denote the same or similar members in FIGS. 20 to 22, and a detailed description thereof will appropriately be omitted.

The transmission of the switching mechanism 3 shown in FIGS. 20 to 22 includes a drive lever 45 that is fixed to one end of a pivot shaft 51 and pivots integrally with the pivot shaft 51, a pushing element 41 facing a third switch pin 29, and a connecting lever 81 that connects the pushing element 41 to the drive lever 45. The drive lever 45 corresponds to a "first lever." The connecting lever 81 corresponds to a "second lever."

The connecting lever 81 is pivotally supported by a support shaft 82 on a housing 44 (not shown). The support shaft 82 extends through the central portion of the connecting lever 81 in the longitudinal direction, and is fixed to the housing 44. The axis of the support shaft 82 is parallel or substantially parallel to the axis of the pivot shaft 51.

One end of the connecting lever 81 is pivotally connected to the pushing element 41 via a first connecting shaft 81*a*, and is connected to some of the elements which define the above-described valve gear system via the pushing element 41. The other end of the connecting lever 81 is pivotally connected to the pivotal end of the drive lever 45 via a second connecting shaft 81*b*. The axes of the first connecting shaft 81*a* and the second connecting shaft 81*b* are parallel or substantially parallel to the axes of the pivot shaft 51 and the support shaft 82.

In FIG. 22, a length L1 of the connecting lever 81 on one end is equal or substantially equal to a length L2 on the other end. When the ratio of the lengths L1 and L2 is changed, the operation amount of the lever is appropriately changed. The length L1 is the distance between the axis of the support shaft 82 and the axis of the first connecting shaft 81*a*. The length L2 is the distance between the axis of the support shaft 82 and the axis of the second connecting shaft 81*b*.

A click mechanism 83 is connected to the other end of the pivot shaft 51 to define the magnitude of a pushing force necessary to rotate the pivot shaft 51. The click mechanism 83 includes a pressure receiving member 84 fixed to the pivot shaft 51, and a ball 85 held by the housing 44 (not shown). Two concave portions 86 arranged in the pivotal direction of the pivot shaft 51 are provided in the pressure receiving member 84. The ball 85 is pushed by a compression coil spring 87 and engages with one concave portion 86.

For this reason, when a rotation torque of such a magnitude that makes the ball 85 move across the boundary between the concave portions 86 is applied to the pivot shaft 51, the pivot shaft 51 rotates. The rotation torque is applied to the pivot shaft 51 when a synchronous cam 13 pushes a cam follower 22, and a slide pin 55 accordingly pushes a first projection 52 or a second projection 53.

According to this preferred embodiment, the distance between the pivot shaft 51 and a camshaft 14 becomes longer by the length of the connecting lever 81, as compared to a case in which the arrangement shown in FIG. 1 is used. For this reason, as shown in FIG. 21, the pivot shaft 51 is able to be arranged at a position spaced apart from a rocker shaft 30. It is therefore possible to increase the degree of freedom of layout of a driver 23 and facilitate an operation of assembling the members of the driver 23 to the housing 44.

The length L1 of the connecting lever 81 according to this preferred embodiment on one end is equal or substantially equal to the length L2 on the other end. If L1>L2, the operation of the drive lever 45 is enlarged by a lever ratio corresponding to the ratio of the length L1 to the length L2 and transmitted to the pushing element 41. The operation amount of the drive lever 45 depends on the operation amount of the cam follower 22 pushed by a nose 13*b* of the synchronous cam 13 and moved to rotate the pivot shaft 51. When the operation is enlarged by the lever ratio, the pushing element 41 is moved a sufficiently large amount without making the nose 13*b* of the synchronous cam 13 very high.

Fourth Preferred Embodiment

A valve gear for an engine according to a preferred embodiment of the present invention may be configured as shown in FIGS. 23 to 26. The same reference numerals as those of the members described with reference to FIGS. 1 to 22 denote the same or similar members in FIGS. 23 to 26, and a detailed description thereof will appropriately be omitted. The valve gear for an engine according to this preferred embodiment is different from the valve gears according to the above-described preferred embodiments in the arrangements of the camshaft 14 and the switch 21 of the switching mechanism 3, and the rest of the elements are preferably the same.

Figure 23:
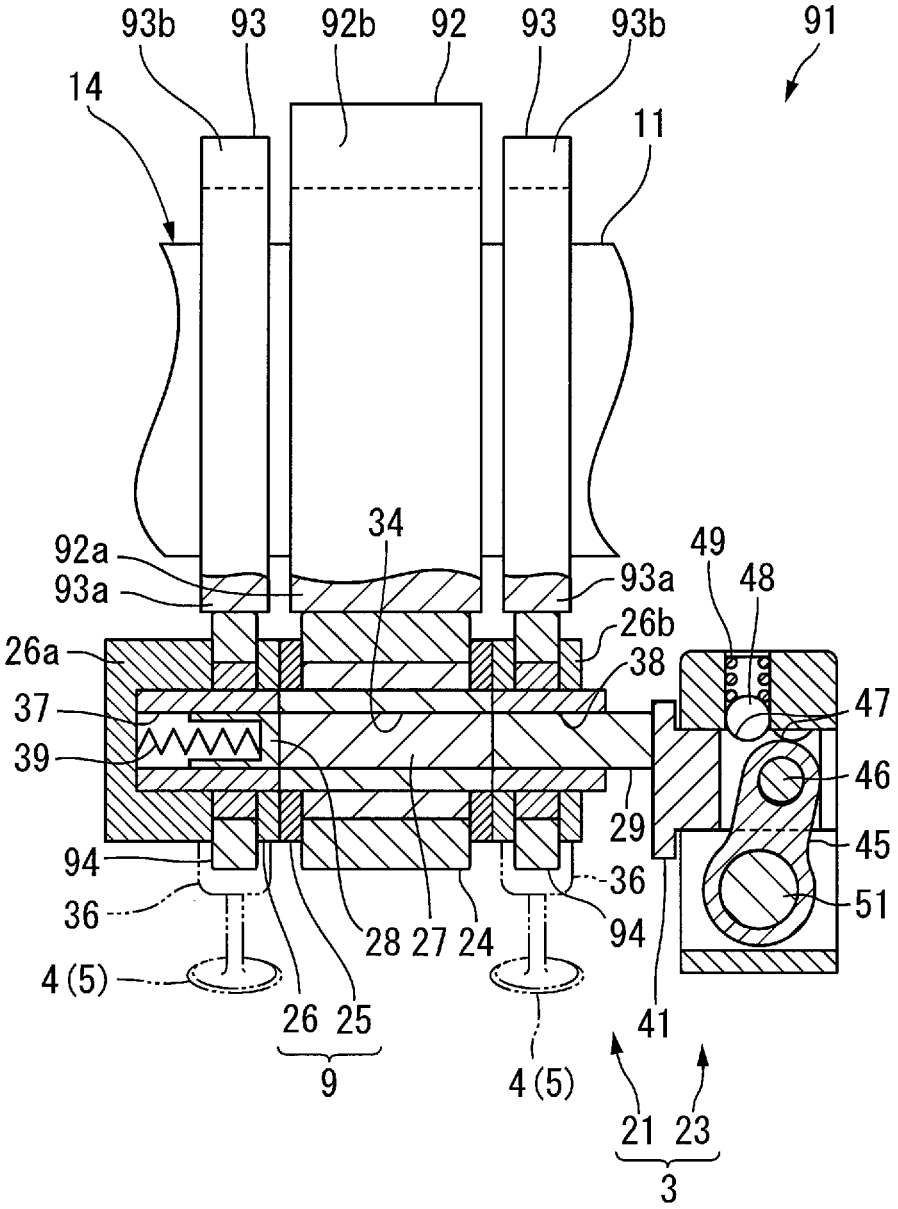
FIG. 23 is a plan view for explaining the arrangement of a camshaft and a switch according to a fourth preferred embodiment of the present invention in which a sectional view of a driver is also illustrated.

A valve gear 91 for an engine 2 shown in FIG. 23 includes two types of valve drive cams to perform two types of drive modes. The two types of valve drive cams are a first cam 92 and second cams 93, which have different valve lift amounts for the intake valves 4 or the exhaust valves 5. The first cam 92 and the second cams 93 are arranged in the axial direction of a camshaft main body 11. The second cams 93 according to this preferred embodiment are provided on both sides of the first cam 92. The first cam 92 and the second cam 93 include circular bases 92*a* and 93*a* and noses 92*b* and 93*b*, respectively.

The outer diameter of the circular base 92*a* of the first cam 92 equals the outer diameter of the circular base 93*a* of the second cam 93. The nose 92*b* of the first cam 92 preferably has a shape that obtains a larger valve lift amount of the intake valves 4 or the exhaust valves 5 than the valve lift amount of the nose 93*b* of the second cam 93.

A rocker arm 9 used in the valve gear 1 includes a first rocker arm 25 that is pushed by the first cam 92 and swings, and a second rocker arm 26 arranged at a position adjacent to the first rocker arm 25 in the axial direction of the camshaft 14. The first rocker arm 25 includes, at its swinging end, a roller 24 that contacts the first cam 92 and rotates, and is swingably supported by a rocker shaft 30 (not shown), similar to the first rocker arm 25 shown in FIGS. 6 and 7.

The second rocker arm 26 includes a first arm main body 26*a* and a second arm main body 26*b* which are located on both sides of the first rocker arm 25, and a connector (not shown) that connects the swinging ends of the first arm main body 26*a* and the second arm main body 26*b*, similar to the second rocker arm 26 shown in FIGS. 6 and 7. The first arm main body 26*a* and the second arm main body 26*b* are located at positions where they are pushed by the second cams 93, and swingably supported by the rocker shaft 30. The second rocker arm 26 includes rollers 94 that contact the second cams 93 and rotate, and pushers 36 that push the intake valves 4 or the exhaust valves 5. The pushers 36 are provided at the swinging ends of the second rocker arm 26.

The first rocker arm 25 and the second rocker arm 26 are preferably connected by the same connecting structure as that shown in FIGS. 6 and 7. In the first rocker arm 25 and the second rocker arm 26, first to third pin holes 34, 37, and 38 extending in the axial direction of the camshaft 14 are arranged across these rocker arms.

First to third switch pins 27 to 29 are movably fitted in first to third pin holes 34, 37, and 38.

Figure 25:
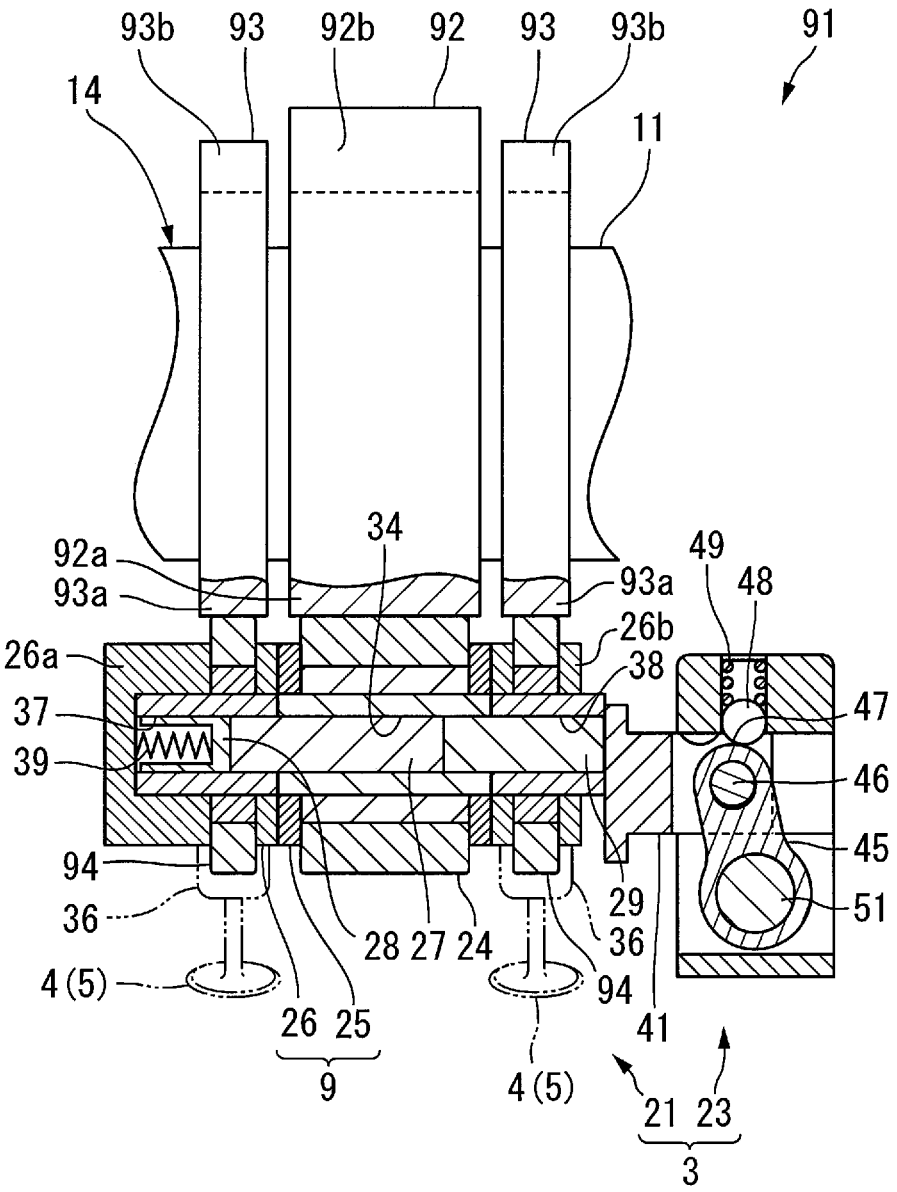
FIG. 25 is a plan view for explaining the arrangement of the camshaft and the switch according to the fourth preferred embodiment of the present invention in which a sectional view of the driver is also illustrated.

As shown in FIG. 23, when a pivot shaft 51 of a driver 23 rotates in one direction, the first to third switch pins 27 to 29 move to non-connecting positions at which the first to third switch pins 27 to 29 are not located across the first rocker arm 25 and the second rocker arm 26 to set the first rocker arm 25 and the second rocker arm 26 in a non-connected state. As shown in FIG. 25, when the pivot shaft 51 rotates in the other direction, the first to third switch pins 27 to 29 move to connecting positions at which the first to third switch pins 27 to 29 are located across the first rocker arm 25 and the second rocker arm 26 to set the first rocker arm 25 and the second rocker arm 26 in a connected state.

In this preferred embodiment, the first to third switch pins 27 to 29 define "some of the elements which define a valve gear system from the valve drive cam to the rocker arm."

Figure 26:
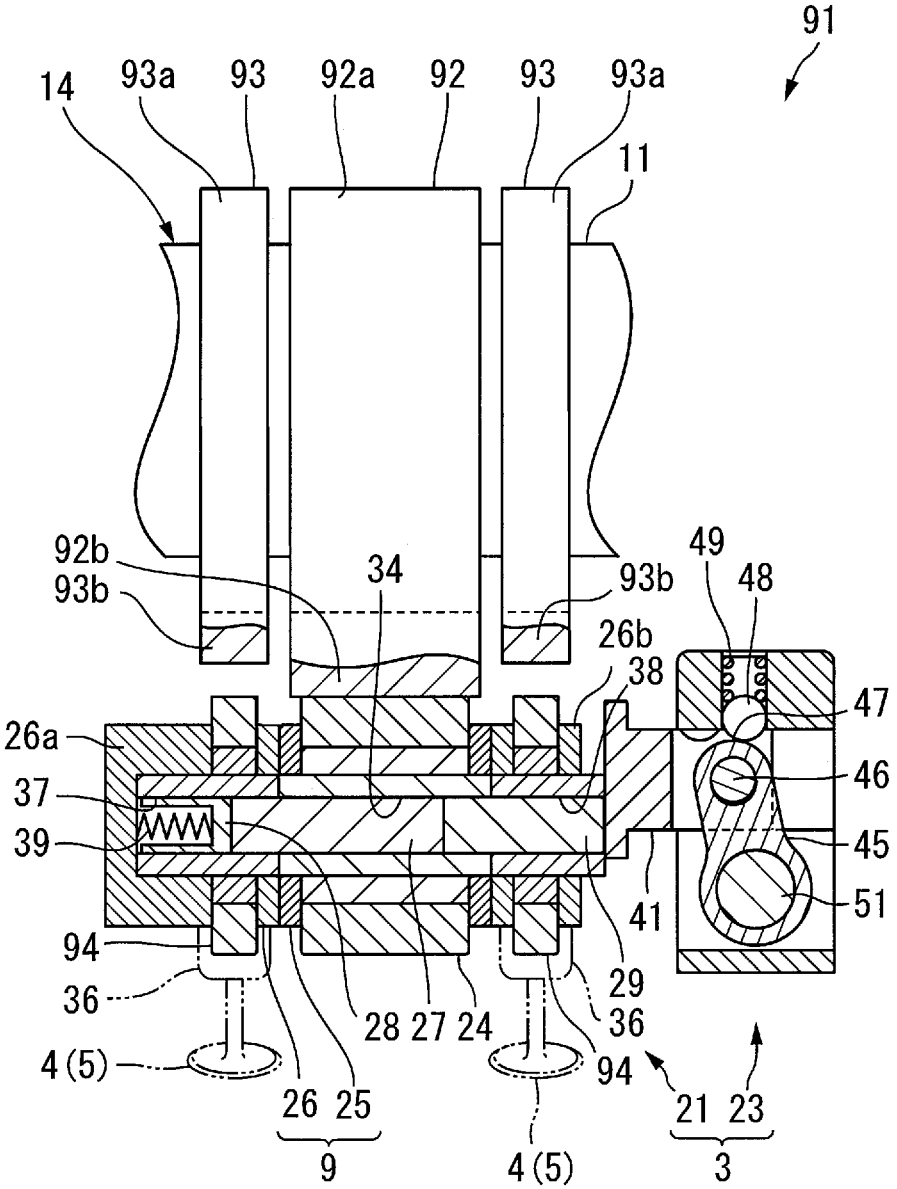
FIG. 26 is a plan view for explaining the arrangement of the camshaft and the switch according to the fourth preferred embodiment of the present invention in which a sectional view of the driver is also illustrated.

The first rocker arm 25 is pushed by the first cam 92 whose valve lift amount is relatively large. For this reason, when the camshaft 14 rotates in a state in which the first to third switch pins 27 to 29 are located at the connecting positions (see FIG. 25), the rollers 94 of the second rocker arm 26 separate from the second cams 93, as shown in FIG. 26. At this time, the valve lift amount of the intake valves 4 or the exhaust valves 5 is larger than in a case in which the second rocker arm 26 is pushed by the second cams 93 and swings.

Figure 24:
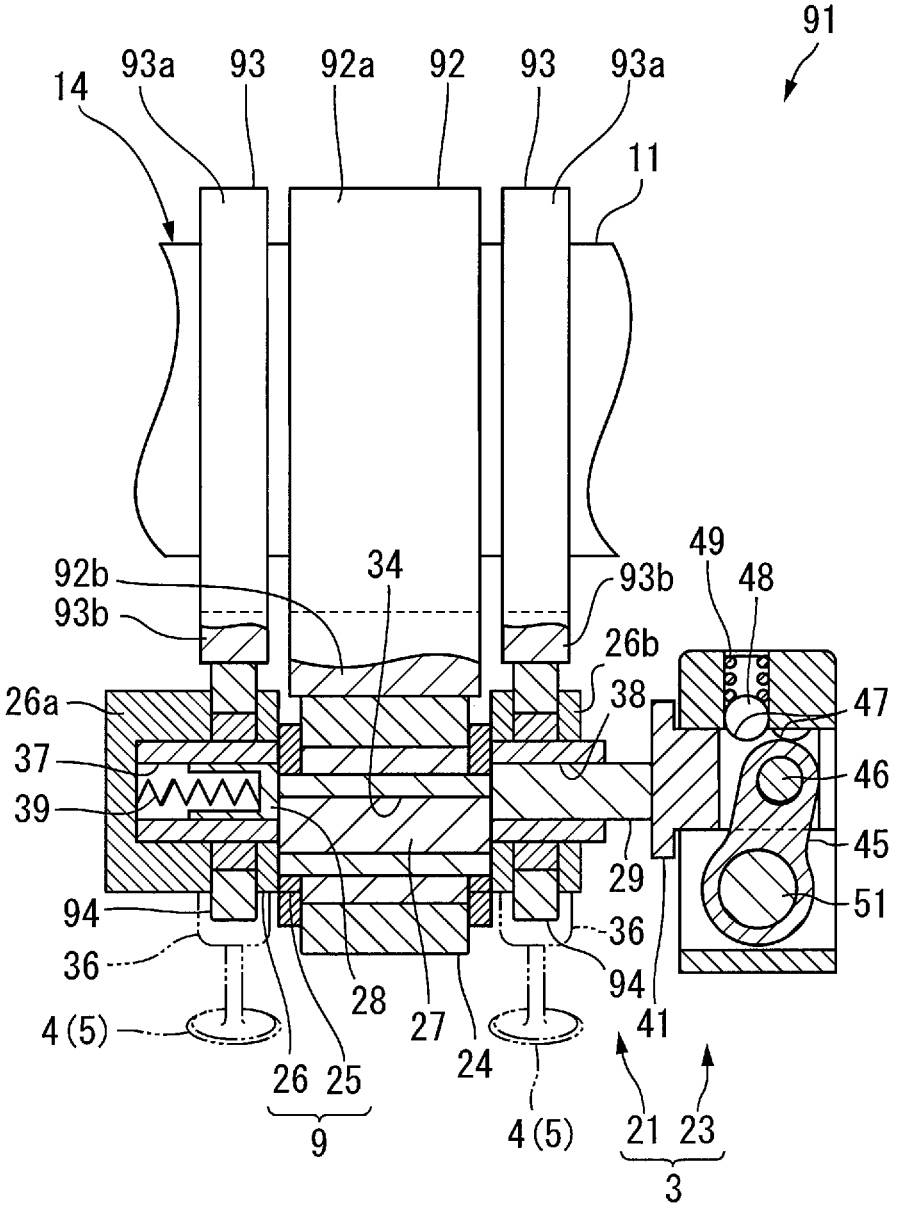
FIG. 24 is a plan view for explaining the arrangement of the camshaft and the switch according to the fourth preferred embodiment of the present invention in which a sectional view of the driver is also illustrated.

On the other hand, when the camshaft 14 rotates in a state in which the first to third switch pins 27 to 29 are located at the non-connecting positions (see FIG. 23), the first rocker arm 25 and the second rocker arm 26 individually swing, as shown in FIG. 24. The intake valves 4 or the exhaust valves 5 open/close along with the swing of the second rocker arm 26. In this case, the valve lift amount of the intake valves 4 or the exhaust valves 5 is relatively small.

Hence, according to this preferred embodiment, it is possible to provide a valve gear for an engine which correctly switches between the first drive mode in which the valve lift amount of the intake valves 4 or the exhaust valves 5 is large and the second drive mode in which the valve lift amount of the intake valves 4 or the exhaust valves 5 is small.

When the engine 2 according to this preferred embodiment is a multi-cylinder engine, the drive mode is preferably switched in all cylinders. Hence, when applying the valve gear 91 according to this preferred embodiment to a multi-cylinder engine, the switching mechanisms 3 are provided in all cylinders. As the hydraulic device of the switching mechanism 3 in this case, the hydraulic device 62 described in the first preferred embodiment or the hydraulic device 71 described in the second preferred embodiment may be used.

When using the hydraulic device 62 or the hydraulic device 71 in the switching mechanism 3 according to this preferred embodiment, an arrangement that supplies an oil pressure from one hydraulic pump via two switching valves may be used. The two switching valves include a first switching valve that supplies the oil pressure to a cylinder hole 56 of the switching mechanism 3 for an intake valve, and a second switching valve that supplies the oil pressure to the cylinder hole 56 of the switching mechanism 3 for an exhaust valve.

To switch a plurality of drive modes in which the valve lift amounts of the intake valves 4 or the exhaust valves 5 are different, the switching mechanism 3 is provided on at least one of the side of the intake valves 4 and the side of the exhaust valves 5. For example, the switching mechanism 3 may be provided only on the side of the intake valves 4, or the switching mechanism 3 may be provided only on the side of the exhaust valves 5.

In the valve gear 91 for the engine 2 according to this preferred embodiment, the plurality of drive modes are switched to change the valve lift amount of the intake valves 4, thus facilitating control of the output, fuel consumption, and exhaust gas amount of the engine 2. In addition, the plurality of drive modes are switched to change the valve lift amount of the exhaust valves 5, thus similarly facilitating control of the output, fuel consumption, and exhaust gas amount.

Hence, when the valve gear 91 according to this preferred embodiment is mounted, the degree of freedom in controlling the operation of the engine 2 becomes high, and a high-performance engine is obtained.

Fifth Preferred Embodiment

A valve gear for an engine according to a preferred embodiment of the present invention may include a structure as shown in FIGS. 27 to 30. The same reference numerals as those of the members described with reference to FIGS. 1 to 26 denote the same or similar members in FIGS. 27 to 30, and a detailed description thereof will appropriately be omitted. The valve gear for an engine according to this preferred embodiment is different from the valve gears according to the above-described preferred embodiments in the arrangements of the camshaft 14 and the switch 21 of the switching mechanism 3, and the rest of the elements are preferably the same.

Figure 27:
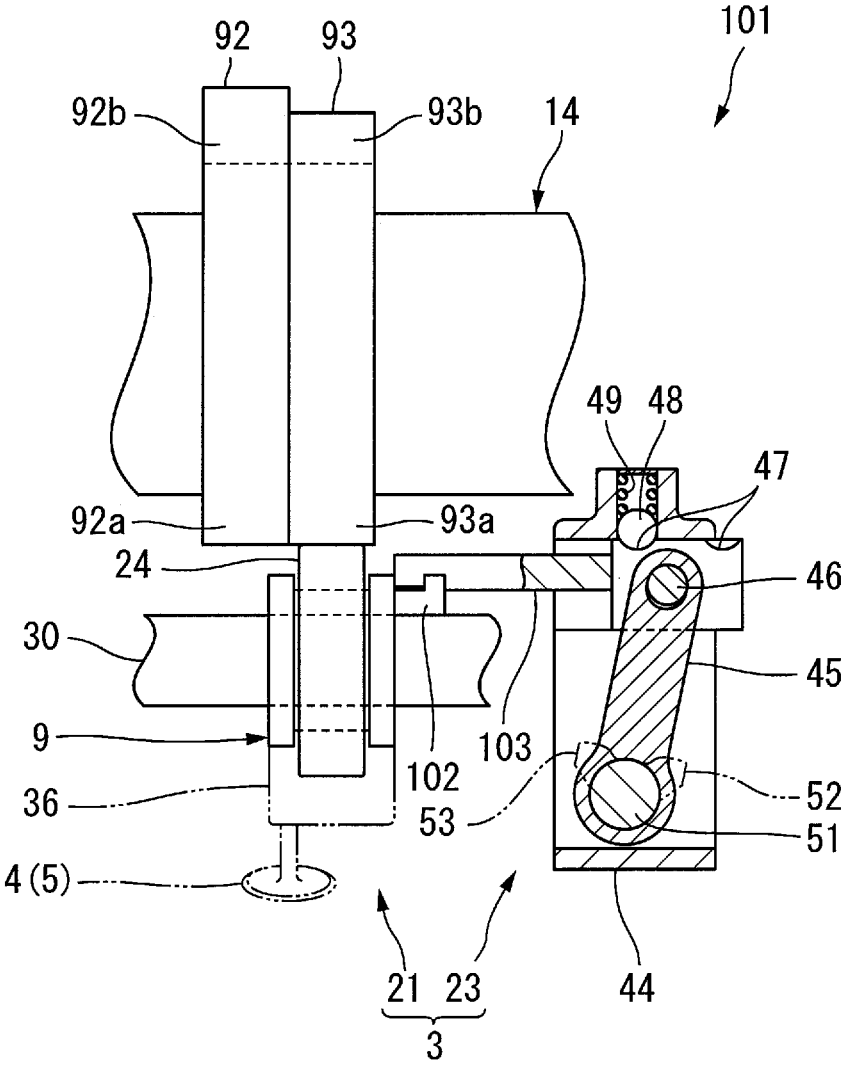
FIG. 27 is a plan view for explaining the arrangement of a camshaft and a switch according to a fifth preferred embodiment of the present invention in which a sectional view of a driver is also illustrated.

A valve gear 101 shown in FIG. 27 includes a first cam 92 and a second cam 93, which have different valve lift amounts of intake valves 4 or exhaust valves 5 to perform two types of drive modes. The first cam 92 and the second cam 93 are the same as those shown in FIG. 23. The second cam 93 according to this preferred embodiment is arranged on only one side of the first cam 92 and is in contact with the first cam 92.

A rocker arm 9 used in the valve gear 101 is supported by a rocker shaft 30 so as to be movable in the axial direction and also swingably supported by the rocker shaft 30. A pusher 36 that pushes the intake valve 4 or the exhaust valve 5 is provided at the swinging end of the rocker arm 9. The pusher 36 has a shape including a predetermined length in the axial direction of the rocker shaft 30. The length of the pusher 36 is equal to or more than the interval (formation pitch) between the first cam 92 and the second cam 93.

The rocker arm 9 includes a roller 24 that contacts the first cam 92 or the second cam 93 and rotates, and also includes a connector 102 that projects in the axial direction of the rocker shaft 30. The connector 102 is connected to a connector 103 of a driver 23. The connector 103 is pivotally connected to a drive lever 45 of the driver 23 and movably supported by a housing 44 so as to move back and forth with respect to the rocker arm 9. A plurality of concave portions 47 that engage with a ball 48 are provided in the connector 103.

Figure 29:
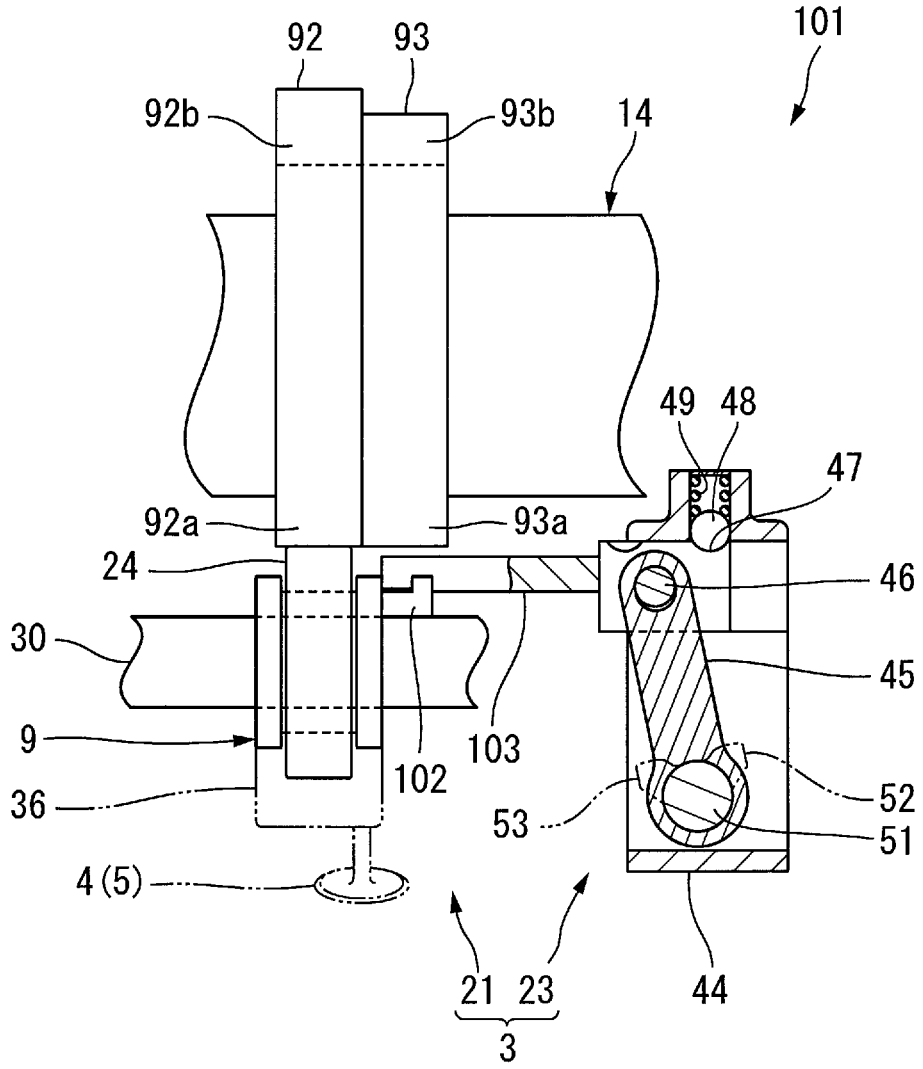
FIG. 29 is a plan view for explaining the arrangement of the camshaft and the switch according to the fifth preferred embodiment of the present invention in which a sectional view of the driver is also illustrated.

As shown in FIG. 27, when a pivot shaft 51 of the driver 23 rotates in one direction, and the connector 103 moves to a retreat position shown in FIG. 27, the rocker arm 9 moves to a position corresponding to one (the second cam 93 in FIG. 27) of the first cam 92 and the second cam 93. As shown in FIG. 29, when a pivot shaft 51 rotates in the other direction, and the connector 103 moves to an advance position, the rocker arm 9 moves to a position corresponding to the other (the first cam 92 in FIG. 29) of the first cam 92 and the second cam 93.

Figure 28:
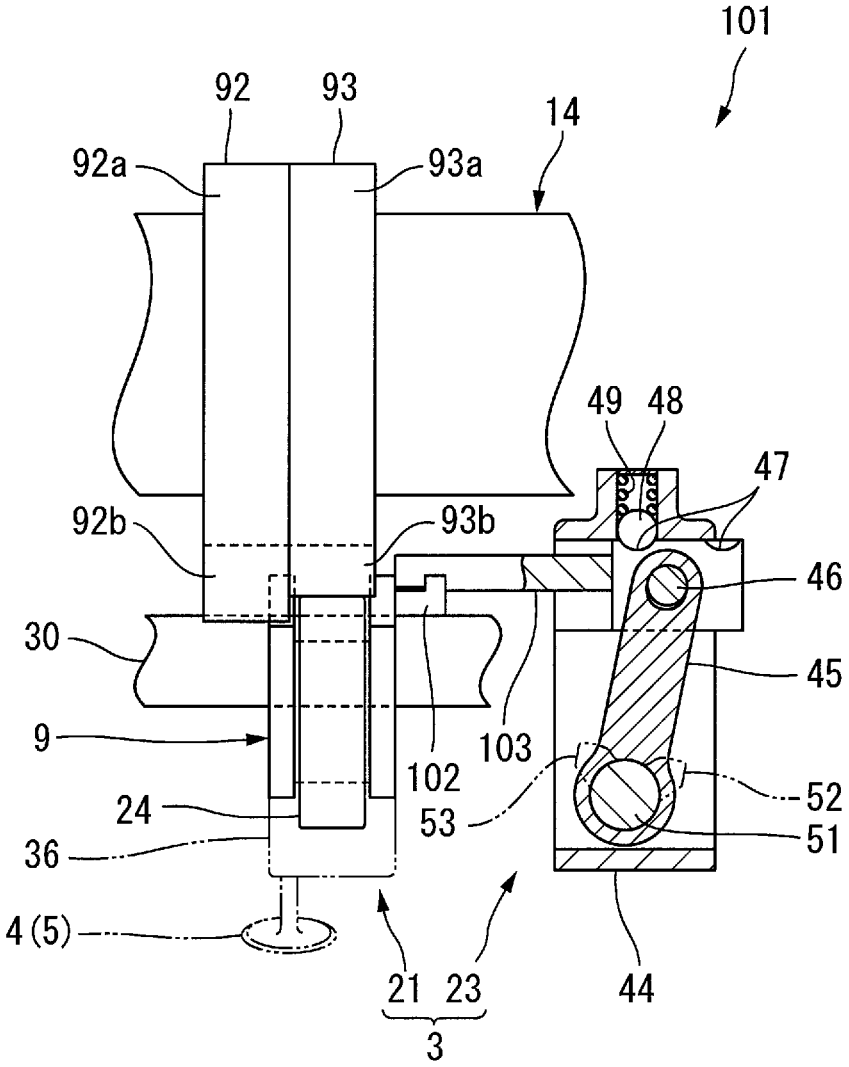
FIG. 28 is a plan view for explaining the arrangement of the camshaft and the switch according to the fifth preferred embodiment of the present invention in which a sectional view of the driver is also illustrated.
Figure 30:
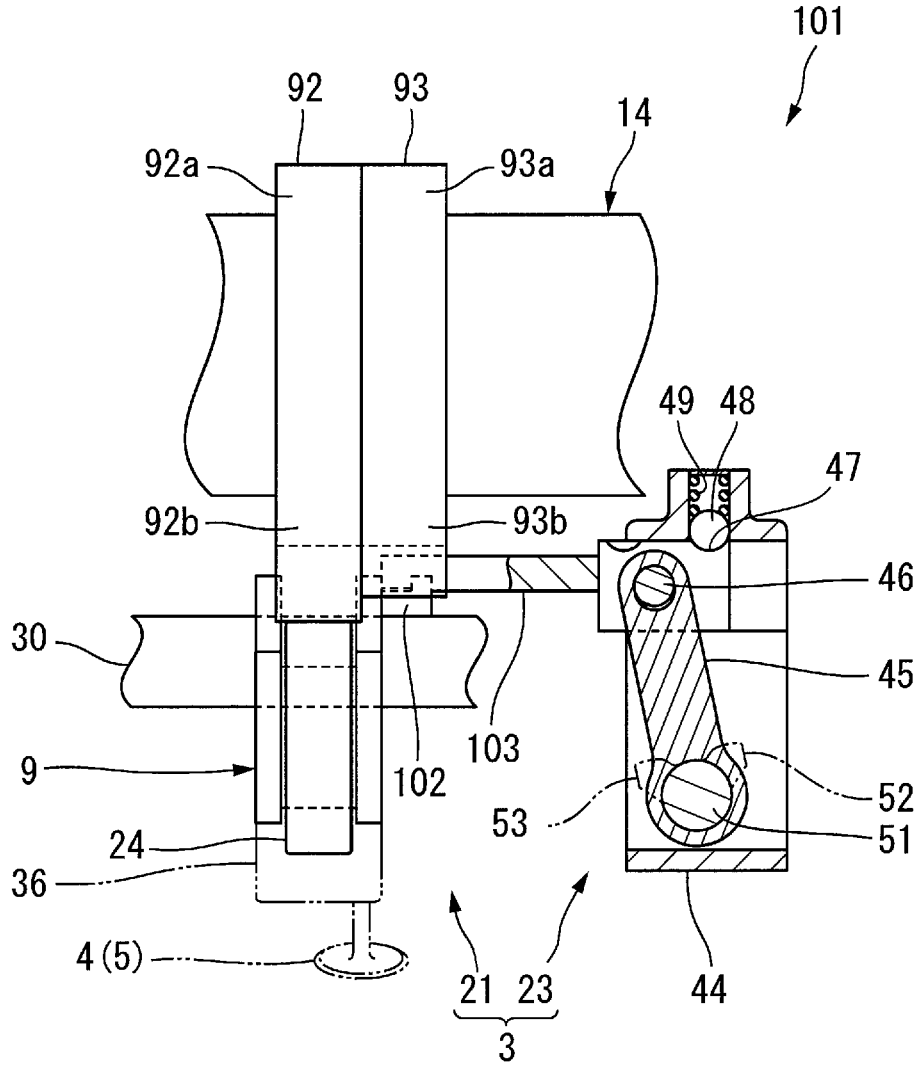
FIG. 30 is a plan view for explaining the arrangement of the camshaft and the switch according to the fifth preferred embodiment of the present invention in which a sectional view of the driver is also illustrated.

When the camshaft 14 rotates in a state in which the roller 24 of the rocker arm 9 is in contact with the second cam 93 (see FIG. 27), the rocker arm 9 is pushed by the second cam 93 and swings, as shown in FIG. 28. On the other hand, when the camshaft 14 rotates in a state in which the roller 24 of the rocker arm 9 is in contact with the first cam 92 (see FIG. 29), the rocker arm 9 is pushed by the first cam 92 and swings, as shown in FIG. 30. Hence, when the rocker arm 9 moves from the position where it is pushed by the second cam 93 to the position where it is pushed by the first cam 92, the valve lift amount of the intake valve 4 or the exhaust valve 5 becomes relatively large.

In this preferred embodiment, the rocker arm 9 corresponds to "some of the elements which define a valve gear system from the valve drive cam to the rocker arm."

According to this preferred embodiment, it is possible to provide a valve gear for an engine which correctly switches between the first drive mode in which the valve lift amount of the intake valve 4 or the exhaust valve 5 is relatively large and the second drive mode in which the valve lift amount of the intake valve 4 or the exhaust valve 5 is relatively small.

First Modification of the Fifth Preferred Embodiment

The valve gear including the switch to move the rocker arm may include a structure as shown in FIGS. 31 to 34. The same reference numerals as those of the members described with reference to FIGS. 1 to 30 denote the same or similar members in FIGS. 31 to 34, and a detailed description thereof will appropriately be omitted.

The camshaft 14 of the valve gear 101 according to this preferred embodiment includes two cam portions 104 per cylinder. A synchronous cam 13 according to this preferred embodiment is provided between the two cam portions 104. Each of the cam portions 104 includes the first cam 92 and the second cam 93, which have different valve lift amounts of the intake valves 4 or the exhaust valves 5. The second cam 93 according to this preferred embodiment preferably has a cylindrical shape having the same diameter as a circular base 92*a* of the first cam 92. That is, the second cam 93 has no nose.

Figure 31:
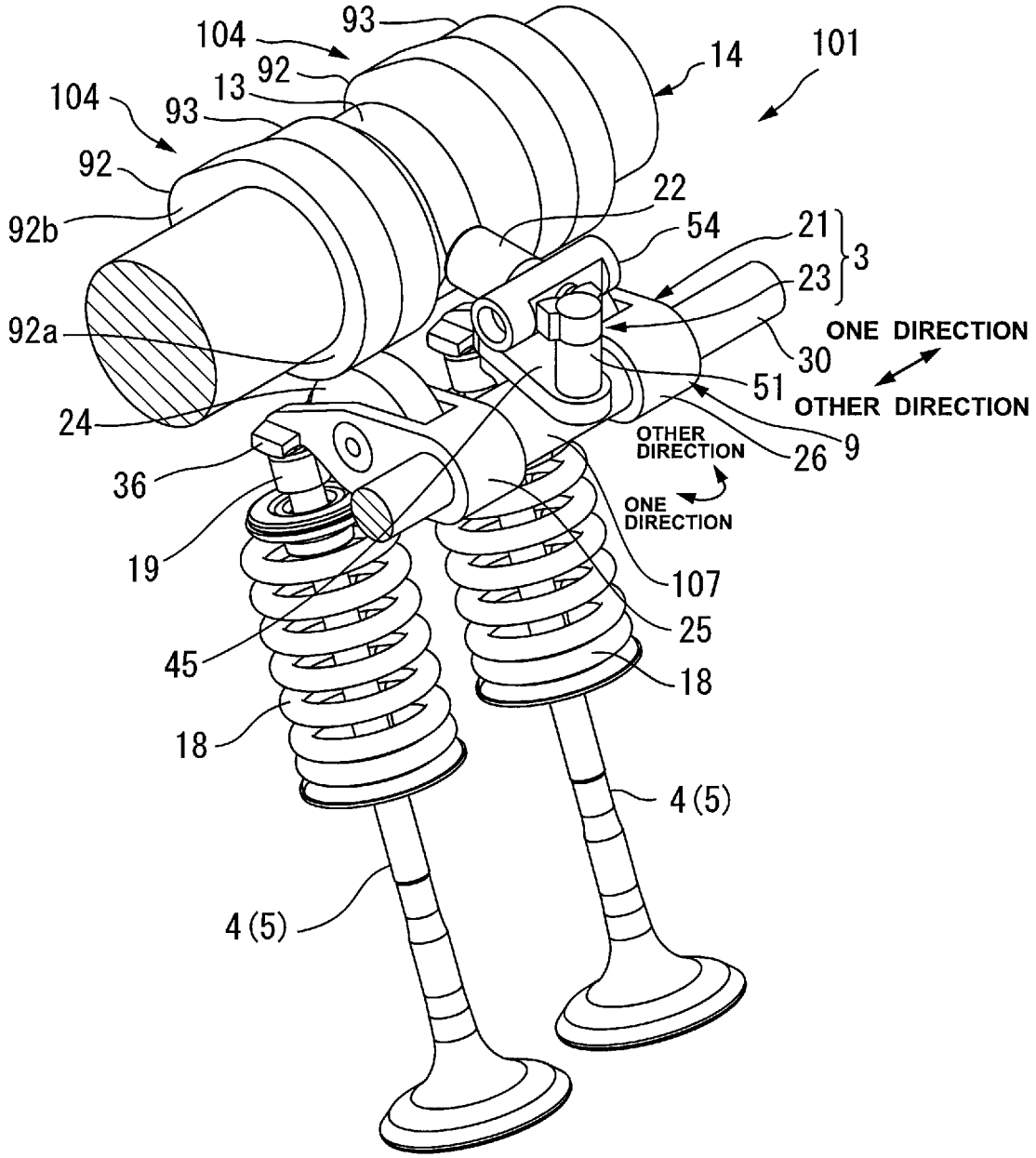
FIG. 31 is a perspective view of a main portion according to a first modification of the fifth preferred embodiment of the present invention.
Figure 32:
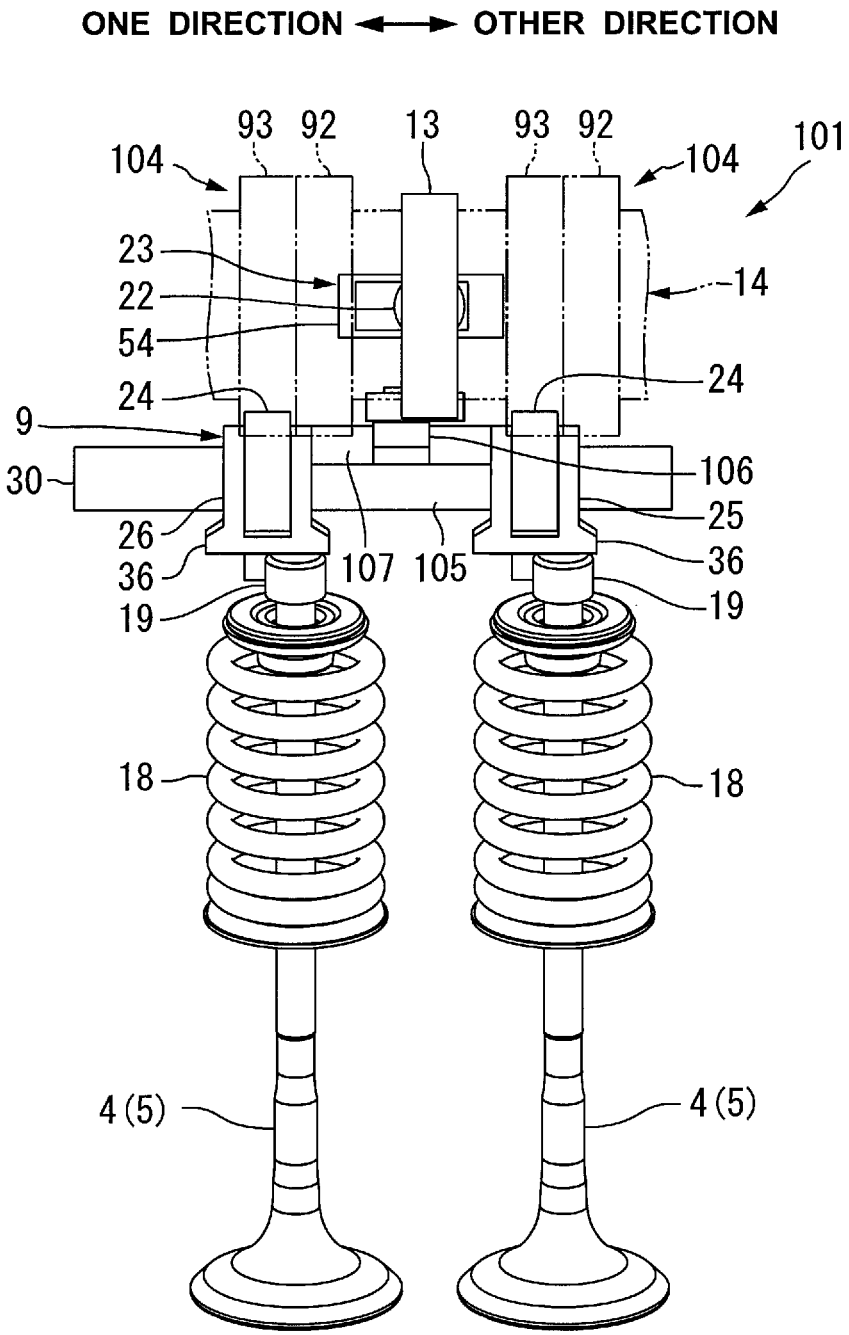
FIG. 32 is a front view of a main portion according to the first modification of the fifth preferred embodiment of the present invention.

The rocker arm 9 shown in FIG. 31 includes a first rocker arm 25, a second rocker arm 26, and a semi-tubular shaft 105 (see FIG. 32). The first rocker arm 25 drives one of the two intake valves 4 or the two exhaust valves 5 per cylinder. The second rocker arm 26 drives the other of the two intake valves 4 or the two exhaust valves 5 per cylinder. The semi-tubular shaft 105 connects the second rocker arm 26 to the first rocker arm 25.

The first rocker arm 25, the second rocker arm 26, and the semi-tubular shaft 105 are supported by the rocker shaft 30 to be movable in the axial direction and also pivotally supported by the rocker shaft 30.

The roller 24 is rotatably provided in the middle of each of the first rocker arm 25 and the second rocker arm 26. The roller 24 of the first rocker arm 25 contacts the first cam 92 or the second cam 93 of one of the two cam portions 104 and rotates. The roller 24 of the second rocker arm 26 contacts the first cam 92 or the second cam 93 of the other cam portion 104 and rotates.

A pusher 36 that pushes a shim 19 of the intake valve 4 or the exhaust valve 5 is provided at the swinging end of each of the first rocker arm 25 and the second rocker arm 26. As shown in FIG. 32, the pusher preferably has a shape including a predetermined length in the axial direction of the rocker shaft 30. The length of the pusher 36 is equal to or more than the interval (formation pitch) between the first cam 92 and the second cam 93.

The semi-tubular shaft 105 preferably has a semi-circular sectional shape fitted on the rocker shaft 30 to be pivotal and movable in the axial direction. The two ends of the semi-tubular shaft 105 are connected to the first rocker arm 25 and the second rocker arm 26 by, for example, welding, and the semi-tubular shaft 105 pivots integrally with the first rocker arm 25 and the second rocker arm 26. In addition to the semi-tubular shaft 105, a slider 107 having a semi-cylindrical shape with a connector 106 is fitted between the first rocker arm 25 and the second rocker arm 26, as shown in FIG. 32.

Figure 34:
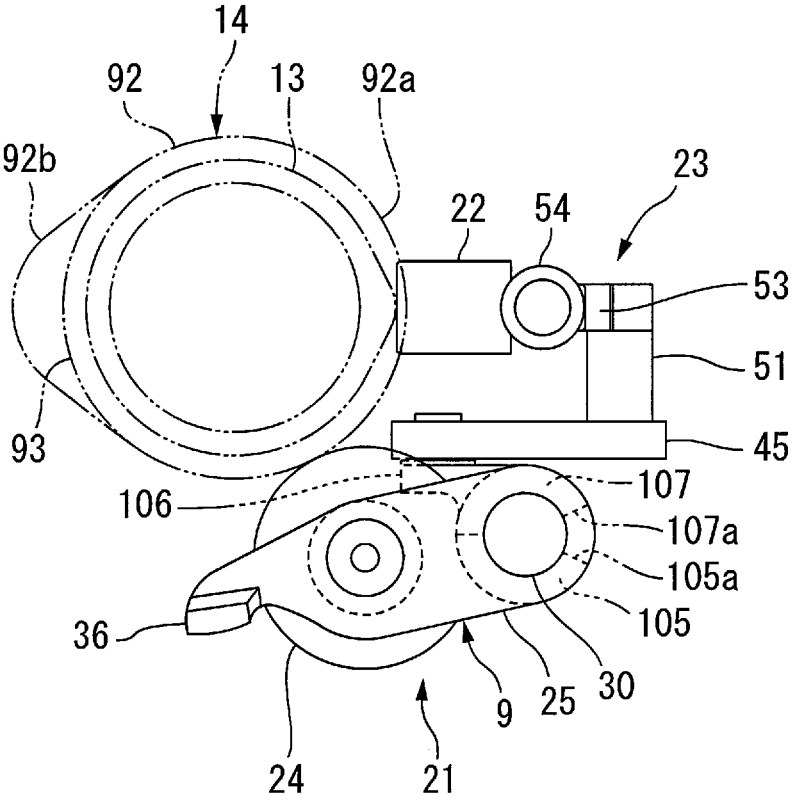
FIG. 34 is a side view of a main portion according to the first modification of the fifth preferred embodiment of the present invention.

The slider 107 preferably has a semi-circular sectional shape fitted on the rocker shaft 30 to be pivotal and movable in the axial direction, and is arranged on the opposite side of the semi-tubular shaft 105 across the rocker shaft 30. The two ends of the slider 107 are disconnected from the first rocker arm 25 and the second rocker arm 26 so as not to regulate the swing of the first rocker arm 25 and the second rocker arm 26. One end 107*a* (see FIG. 34) of the slider 107 in the circumferential direction and one end 105*a* of the semi-tubular shaft 105 in the circumferential direction, which is close to the end 107*a*, are spaced apart at an interval to allow the first rocker arm 25 and the second rocker arm 26 to swing, as shown in FIG. 34.

The connector 106 is provided at the center of the slider 107 in the axial direction and pivotally connected to the drive lever 45 of the driver 23.

For this reason, when the drive lever 45 swings about the pivot shaft 51, the slider 107 with the connector 106 moves in the axial direction of the rocker shaft 30, and the rocker arm 9 moves in the same direction as the slider 107. More specifically, when the synchronous cam 13 of the driver 23 pushes a cam follower 22, and the pivot shaft 51 rotates at a predetermined angle together with the drive lever 45, the rocker arm 9 moves to one side or the other side in the axial direction of the rocker shaft 30.

When the rocker arm 9 is driven by the driver 23 and moved to one side in the axial direction of the rocker shaft 30, the rollers 24 contact the second cams 93. When the rocker arm 9 is driven by the driver 23 and moved to the other side in the axial direction of the rocker shaft 30, the rollers 24 contact the first cams 92. In the state in which the rollers 24 contact the second cams 93, the rocker arm 9 does not swing. For this reason, the intake valves 4 or the exhaust valves 5 are held at fully closed positions.

Hence, according to this preferred embodiment, it is possible to provide a valve gear for an engine which correctly switches between the first drive mode in which the intake valves 4 or the exhaust valves 5 maintain a closed state and the second drive mode in which the intake valves 4 or the exhaust valves 5 are driven as usual. Note that as the second cam 93, a cam including a nose 93*b* (see FIG. 27) may be used. In this case, it is possible to implement a valve gear capable of switching between the first drive mode in which the valve lift amount of the intake valves 4 or the exhaust valves 5 is relatively large and the second drive mode in which the valve lift amount of the intake valves 4 or the exhaust valves 5 is relatively small.

Second Modification of the Fifth Preferred Embodiment

Figure 35:
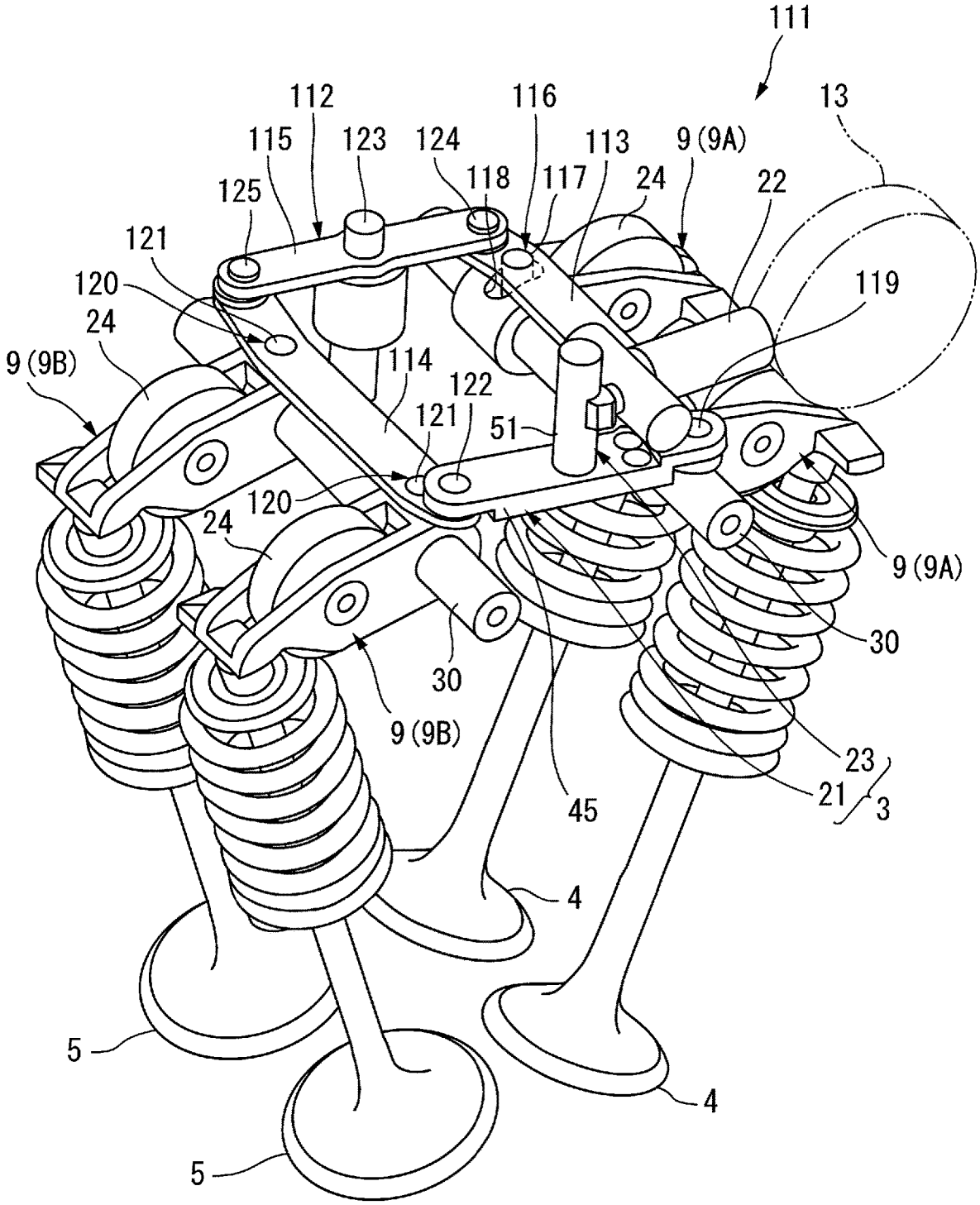
FIG. 35 is a perspective view of a main portion according to a second modification of the fifth preferred embodiment of the present invention.

The valve gear including the switch to move the rocker arm may include a structure as shown in FIG. 35. The same reference numerals as those of the members described with reference to FIGS. 1 to 34 denote the same or similar members in FIG. 35, and a detailed description thereof will appropriately be omitted.

Figure 33:
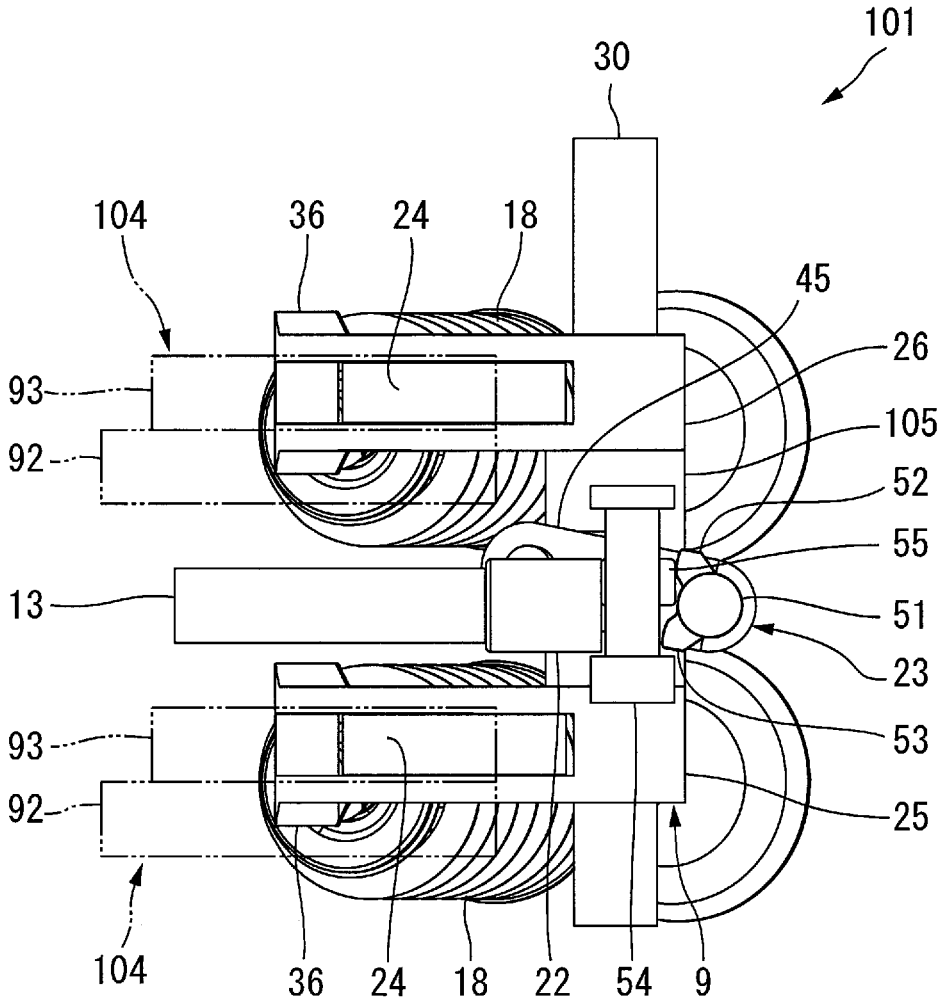
FIG. 33 is a plan view of a main portion according to the first modification of the fifth preferred embodiment of the present invention.

In a valve gear 111 shown in FIG. 35, the two intake valves 4 or exhaust valves 5 per cylinder are driven by an intake camshaft 7 (not shown) or an exhaust camshaft 8 (not shown). Although not illustrated, each of the intake camshaft 7 and the exhaust camshaft 8 includes the two cam portions 104 as shown in FIG. 33. That is, the intake camshaft 7 includes the first cams 92 and the second cams 93, whose valve lift amounts change between the intake valves 4. The exhaust camshaft 8 includes the first cams 92 and the second cams 93, whose valve lift amounts change between the exhaust valves 5.

The four rocker arms 9 shown in FIG. 35 are swingably supported by the rocker shafts 30 and also supported to be movable in the axial directions of the rocker shafts 30. The four rocker arms 9 are connected to the drive lever 45 of the driver 23 by a link 112 (to be described below).

The roller 24 is provided in the middle of each rocker arm 9. Each roller 24 contacts the first cam 92 or the second cam 93 and rotates, as will be described below.

Only one driver 23 of the switching mechanism 3 according to this preferred embodiment is provided near one of the intake camshaft 7 and the exhaust camshaft 8. That is, one driver 23 is provided per cylinder. The synchronous cam 13 which also functions as the power source for the driver 23 is provided on the one camshaft. The driver 23 shown in FIG. 35 is disposed near the intake camshaft 7.

The drive lever 45 of the driver 23 according to this preferred embodiment preferably has a shape extending to one side and the other side of the pivot shaft 51. The link 112 is connected to the two ends of the drive lever 45.

The link 112 includes a first link 113 that connects two rocker arms 9A to drive the intake valves, a second link 114 that connects two rocker arms 9B to drive the exhaust valves, and a third link 115 that connects the first link 113 and the second link 114.

One end of the first link 113 is connected to one of the two rocker arms 9A to drive the intake valves via a connecting structure 116. The connecting structure 116 includes a connecting pin 117 fixed to the first link 113, and a long hole 118 in the rocker arm 9A. The long hole 118 extends along directions in which the rocker arm 9A swings so the swing of the rocker arm 9A is not regulated by the connecting pin 117. The connecting pin 117 is movably fitted in the long hole 118.

The other end of the first link 113 is connected to the other rocker arm 9A to drive the intake valve via the above-described connecting structure 116, although not illustrated.

One end of the drive lever 45 is pivotally connected to the other end of the first link 113 via a connecting pin 119.

One end of the second link 114 is connected to one of the two rocker arms 9B to drive the intake valves via a connecting structure 120. The connecting structure 120 is preferably the same as the above-described connecting structure 116, and includes a connecting pin 121 fixed to the second link 114, and a long hole (not shown) extending along the swing directions of the rocker arm 9B.

The other end of the second link 114 is connected to the other rocker arm 9B to drive the exhaust valve via the above-described connecting structure 120. The other end of the drive lever 45 is pivotally connected to the other end of the second link 114 via a connecting pin 122.

The third link 115 is pivotally supported by a cylinder head 6 (not shown) via a support shaft 123. The length of the third link 115 is equal or substantially equal to the length of the drive lever 45. The support shaft 123 extends through the central portion of the third link 115 in the longitudinal direction. The axis of the support shaft 123 is parallel or substantially parallel to the axis of the pivot shaft 51.

One end of the third link 115 is pivotally connected to one end of the first link 113 via a connecting pin 124. The other end of the third link 115 is connected to one end of the second link 114 via a connecting pin 125. The axes of the above-described connecting pins 117, 121, 119, 122, 124, and 125 are parallel or substantially parallel to the axis of the pivot shaft 51.

According to this preferred embodiment, a driving force is transmitted from the drive lever 45 of the driver 23 to the four rocker arms 9 via the link 112, and the four rocker arms 9 simultaneously move in the axial directions of the rocker shafts 30. Hence, according to this preferred embodiment, switching of the drive mode of the intake valves 4 and the exhaust valves 5, which include two valves per cylinder, is performed by one driver 23. It is therefore possible to reduce the manufacturing cost.

Sixth Preferred Embodiment

A valve gear for an engine according to a preferred embodiment of the present invention may include a structure shown in FIGS. 36 to 39. The same reference numerals as those of the members described with reference to FIGS. 1 to 35 denote the same or similar members in FIGS. 36 to 39, and a detailed description thereof will appropriately be omitted.

The valve gear is different from the valve gears according to the above-described preferred embodiments in the arrangements of the camshaft 14 and the switch 21 of the switching mechanism 3, and the rest of the elements are preferably the same.

Figure 36:
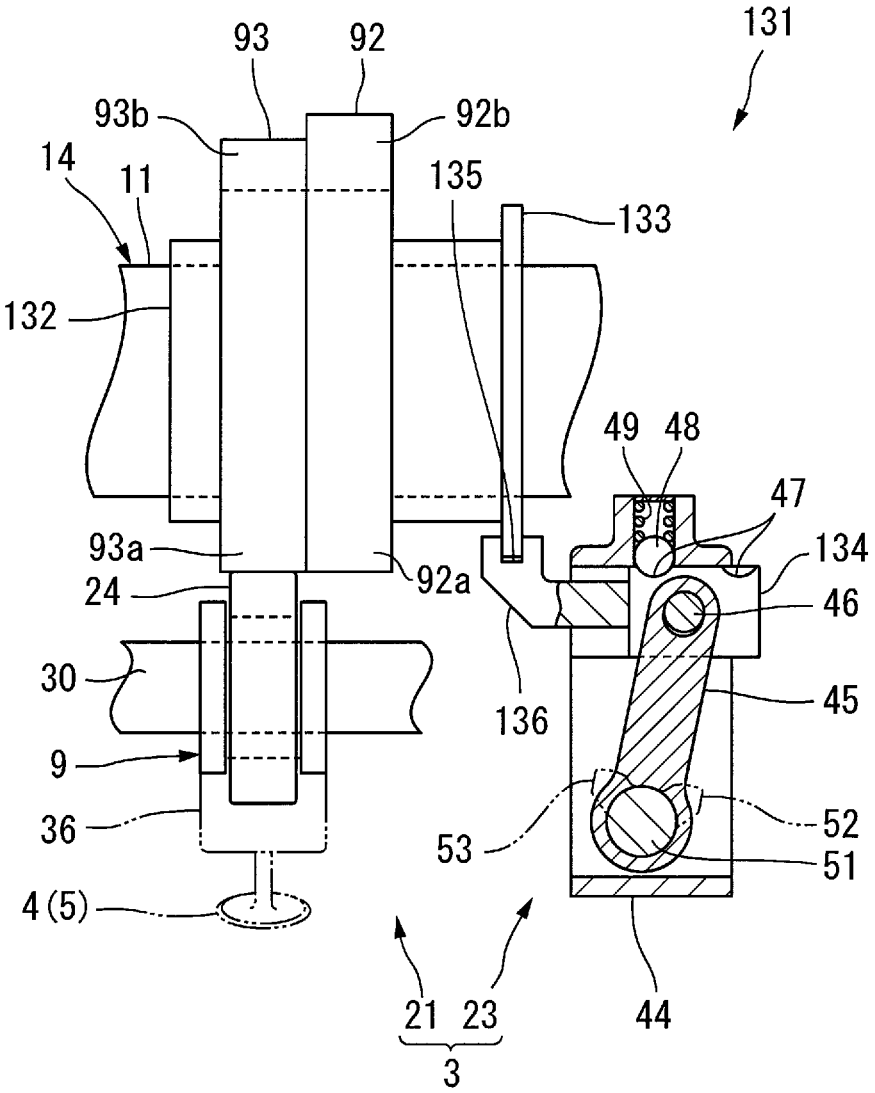
FIG. 36 is a plan view for explaining the arrangement of a camshaft and a switch according to a sixth preferred embodiment of the present invention in which a sectional view of a driver is also illustrated.

A valve gear 131 shown in FIG. 36 includes a first cam 92 and a second cam 93, which have different valve lift amounts for the intake valves 4 or the exhaust valves 5, that perform two types of drive modes. The first cam 92 and the second cam 93 are arranged in the axial direction of a camshaft main body 11.

The first cam 92 and the second cam 93 according to this preferred embodiment are mounted on the camshaft main body 11 via a tubular slider 132. The slider 132 is fitted on the outer surface of the camshaft main body 11 by, for example, a spline (not shown) so as to have the camshaft main body 11 inserted into the hollow portion. In other words, the slider 132 is supported by the camshaft main body 11 to be movable in the axial direction in a state in which the relative movement in the rotation direction is regulated. Each of the first cam 92 and the second cam 93 is fixed to the slider 132 so as to have the slider 132 extending through the axial portion.

An annular plate-shaped flange 133 is provided at one end of the slider 132 in the axial direction. The flange 133 is located on the same axis as the slider 132. The flange 133 is connected to a connecting member 134 of the switching mechanism 3. The connecting member 134 is pivotally connected to a drive lever 45 of a driver 23 and movably supported by a housing 44 so as to move back and forth with respect to the first cam 92 and the second cam 93.

Figure 38:
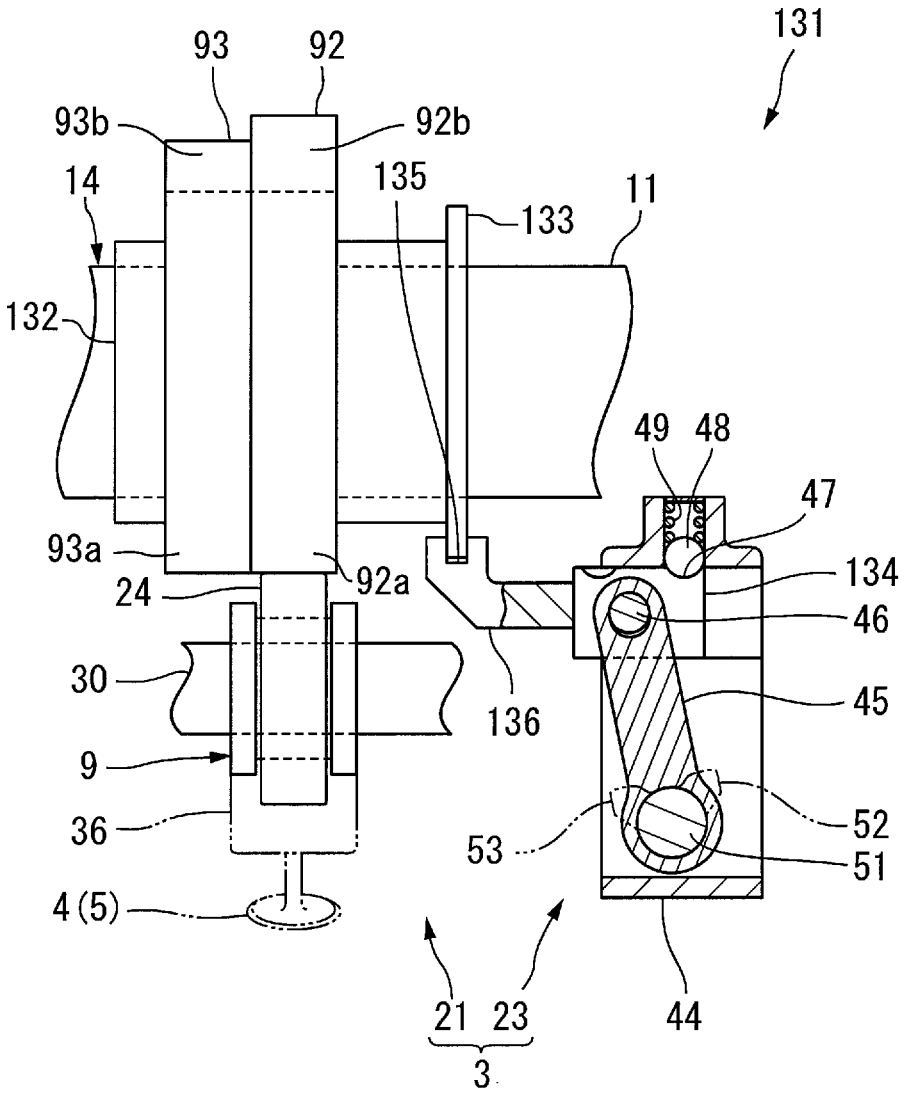
FIG. 38 is a plan view for explaining the arrangement of the camshaft and the switch according to the sixth preferred embodiment of the present invention in which a sectional view of the driver is also illustrated.

A connector 136 is provided at the distal end of the connecting member 134. The connector 136 includes a groove 135 in which the above-described flange 133 is slidably fitted. For this reason, when a pivot shaft 51 of the driver 23 rotates, and the drive lever 45 swings to one side, the connecting member 134 moves to a retreat position, and the slider 132, the first cam 92, and the second cam 93 move to one side (rightward in FIG. 36) in the axial direction with respect to the camshaft main body 11, as shown in FIG. 36. When the drive lever 45 swings in a direction reverse to the above-described direction, the connecting member 134 moves to an advance position, and the slider 132, the first cam 92, and the second cam 93 move in the other direction along the axial direction with respect to the camshaft main body 11, as shown in FIG. 38.

A rocker arm 9 according to this preferred embodiment is swingably supported by a rocker shaft 30 in a state in which the movement in the axial direction is regulated. A roller 24 that contacts the first cam 92 or the second cam 93 and rotates is provided in the middle of the rocker arm 9. A pusher 36 that pushes a shim 19 of the intake valve 4 or the exhaust valve 5 is provided at the swinging end of the rocker arm 9. The number of intake valves 4 or exhaust valves 5 to be driven by the rocker arm 9 is not restricted by the arrangement of the switch 21. The rocker arm 9 according to this preferred embodiment may use an arrangement that drives one intake valve 4 or exhaust valve 5 per cylinder or an arrangement that drives two intake valves 4 or exhaust valves 5 per cylinder.

In this preferred embodiment, the first cam 92 and the second cam 93 correspond to "some of the elements which define a valve gear system from the valve drive cam to the rocker arm."

Figure 37:
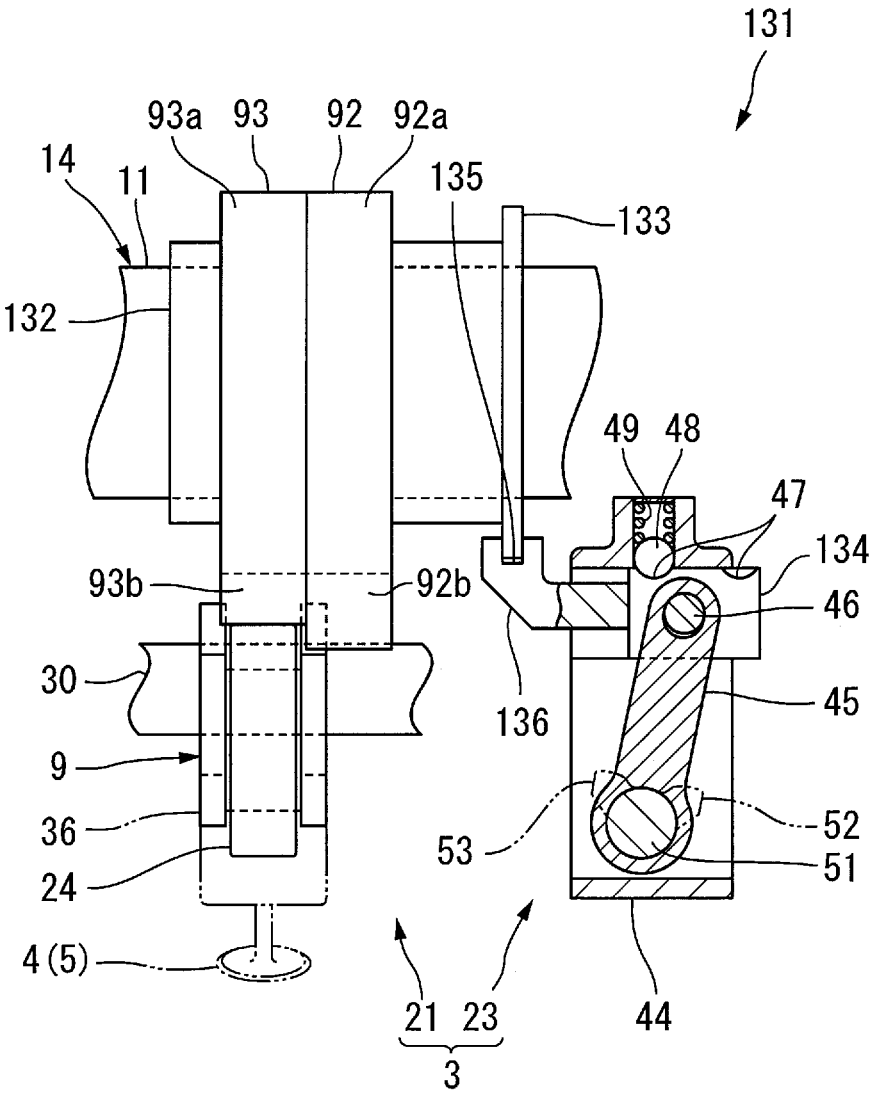
FIG. 37 is a plan view for explaining the arrangement of the camshaft and the switch according to the sixth preferred embodiment of the present invention in which a sectional view of the driver is also illustrated.

In the valve gear 131 according to this preferred embodiment, when the pivot shaft 51 of the switching mechanism 3 rotates in one direction, the second cam 93 contacts the roller 24, and the first cam 92 separates from the roller 24, as shown in FIG. 36. When the camshaft 14 rotates in this state, the rocker arm 9 is pushed by the second cam 93 and swings, as shown in FIG. 37.

Figure 39:
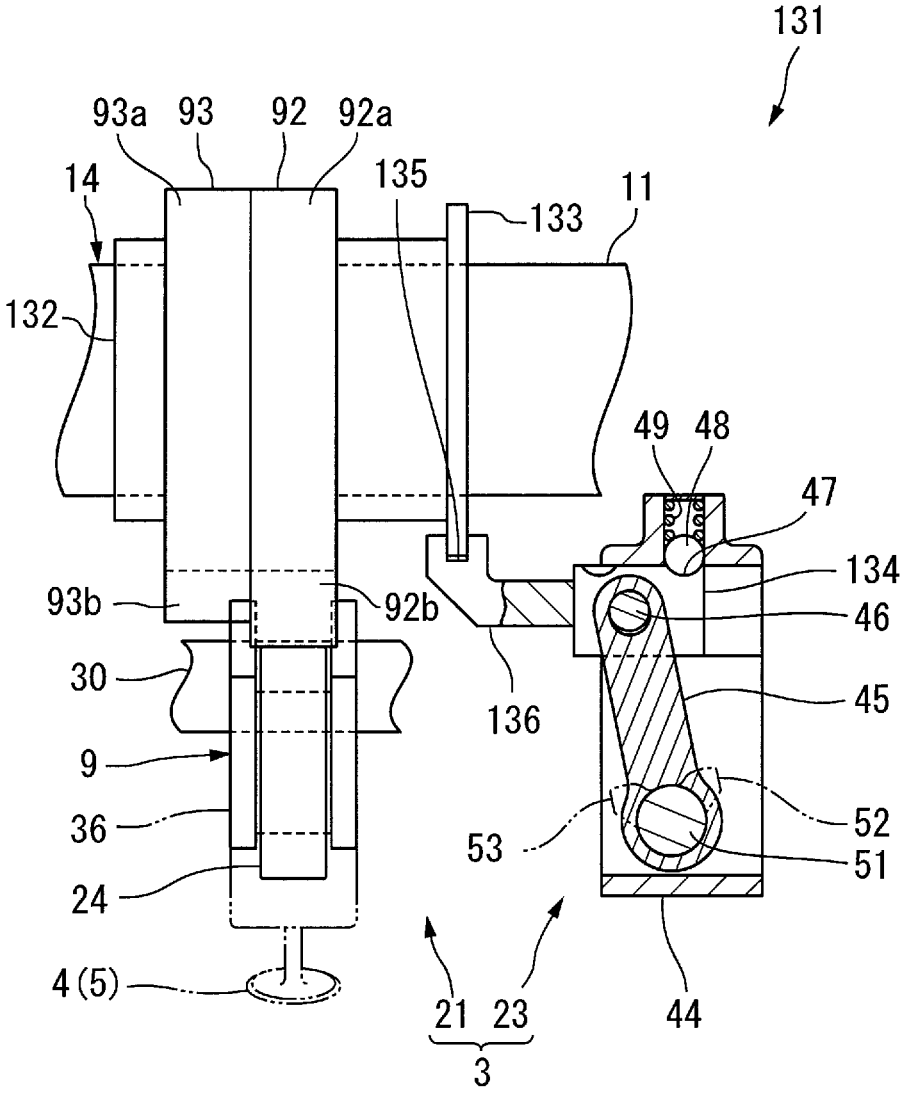
FIG. 39 is a plan view for explaining the arrangement of the camshaft and the switch according to the sixth preferred embodiment of the present invention in which a sectional view of the driver is also illustrated.

When the pivot shaft 51 rotates in the other direction, the second cam 93 separates from the roller 24, and the first cam 92 contacts the roller 24, as shown in FIG. 38. When the camshaft 14 rotates in this state, the rocker arm 9 is pushed by the first cam 92 and swings, as shown in FIG. 39.

Hence, according to this preferred embodiment, it is possible to provide a valve gear for an engine which switches the drive mode of the intake valve 4 or the exhaust valve 5 by moving the first cam 92 and the second cam 93.

First Modification of the Sixth Preferred Embodiment

The valve gear including the switch to move the first cam and the second cam may include a structure as shown in FIGS. 40 to 44. The same reference numerals as those of the members described with reference to FIGS. 1 to 39 denote the same or similar members in FIGS. 40 to 44, and a detailed description thereof will appropriately be omitted.

Figure 40:
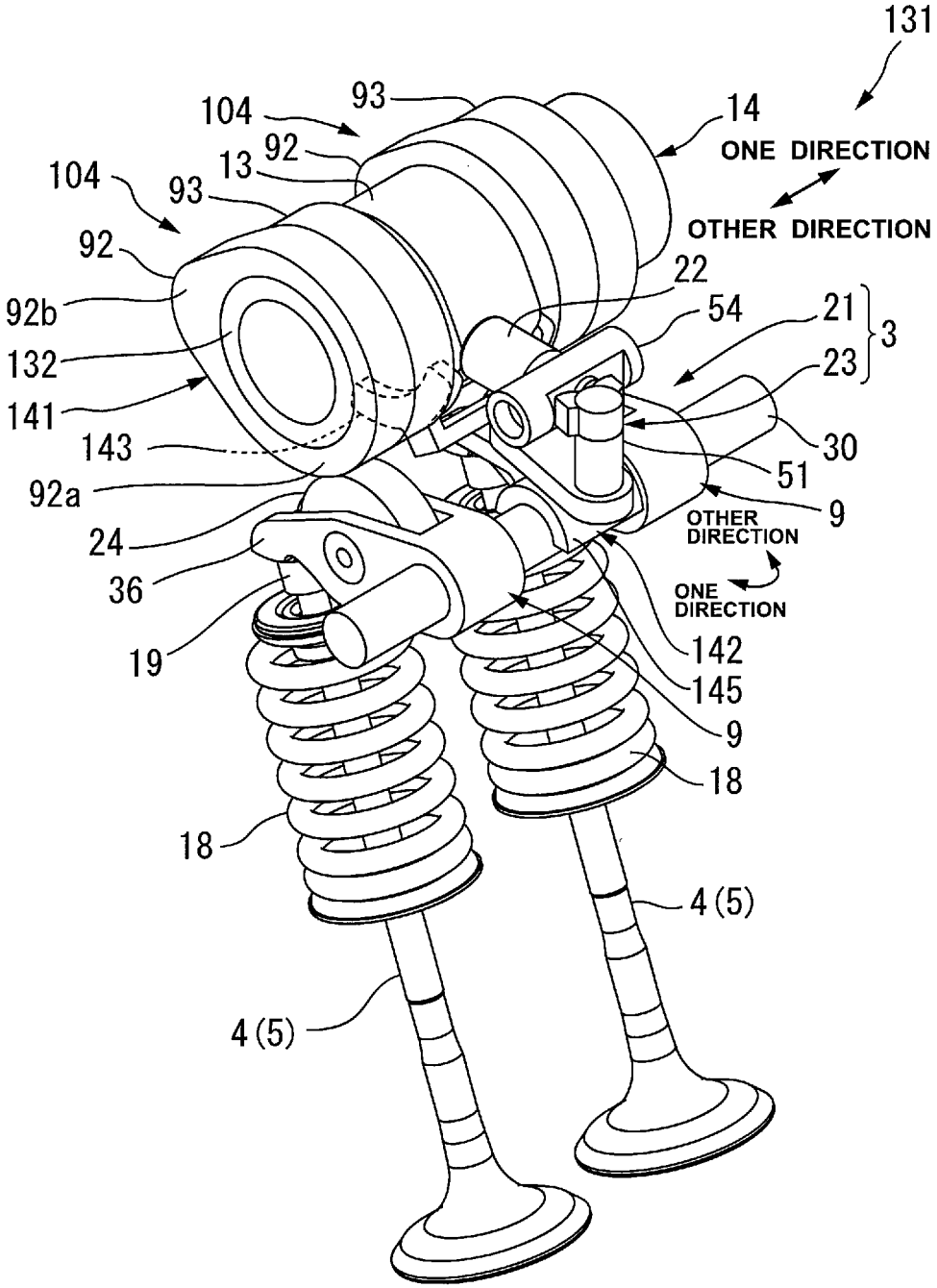
FIG. 40 is a perspective view of a main portion according to a modification of the sixth preferred embodiment of the present invention.

In the valve gear 131 shown in FIG. 40, the two intake valves 4 or exhaust valves 5 per cylinder are driven by the camshaft 14 and the rocker arms 9.

The camshaft 14 according to this preferred embodiment includes two cam portions 104 per cylinder. A synchronous cam 13 is arranged between the cam portions 104. A gap d2 (see FIG. 41) having a predetermined width is provided between each cam portion 104 and the synchronous cam 13.

Each of the two cam portions 104 includes the first cam 92 and the second cam 93, which have different valve lift amounts for the intake valves 4 or the exhaust valves 5.

The length of the synchronous cam 13 according to this preferred embodiment in the axial direction is more than the interval (formation pitch) between the first cam 92 and the second cam 93.

The second cam 93 according to this preferred embodiment preferably has a cylindrical shape having the same diameter as a circular base 92*a* of the first cam 92. That is, the second cam 93 has no nose.

The first cam 92 and the second cam 93 of one of the two cam portions 104, the first cam 92 and the second cam 93 of the other cam portion 104, and the synchronous cam 13 are mounted on the camshaft main body 11 via the tubular slider 132. The slider 132 is supported by the camshaft main body 11 to be movable in the axial direction in a state in which the relative movement in the rotation direction is regulated.

Each of the first cam 92, the second cam 93, and the synchronous cam 13 is fixed to the slider 132 so as to have the slider 132 extending through the axial portion. The four first cams 92 and second cams 93, the synchronous cam 13, and the slider 132 define one cam assembly 141. The cam assembly 141 rotates integrally with the camshaft main body 11 in a state in which the cam assembly 141 is supported by the camshaft main body 11 to be movable in the axial direction.

A pushing member 142 that pushes the cam assembly 141 to one side or the other side in the axial direction of the camshaft main body 11 is arranged near the cam assembly 141. The pushing member 142 includes a pair of pawls 143 to be inserted into the two gaps d2 provided between the synchronous cam 13 and the two cam portions 104. Each pawl 143 preferably has an arc shape when viewed from the axial direction of the camshaft main body 11 and inserted into the gap d2 in a state in which the rotation of the synchronous cam 13, the first cams 92, and the second cams 93 is not regulated.

Figure 44:
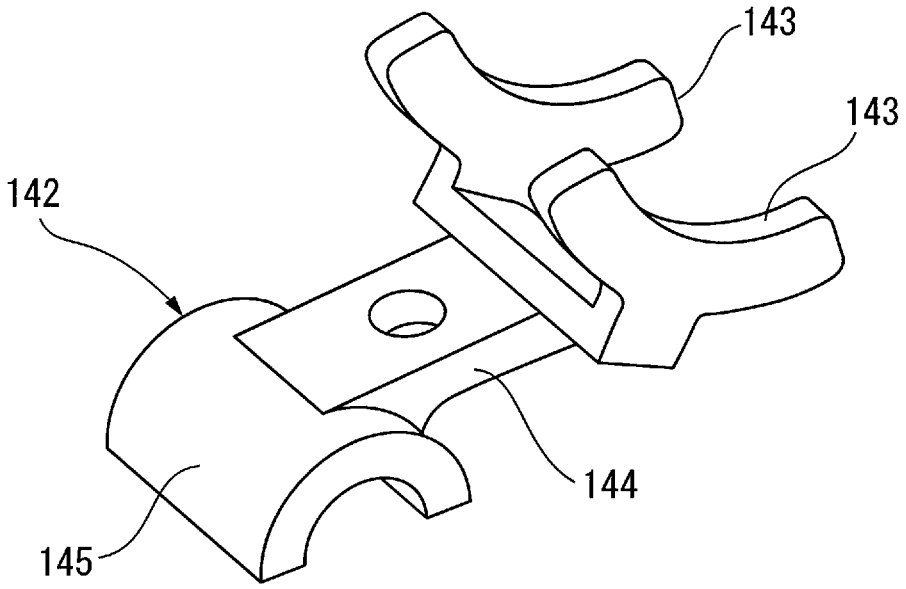
FIG. 44 is a perspective view of a pushing member according to the modification of the sixth preferred embodiment of the present invention.

As shown in FIG. 44, the pushing member 142 includes a support portion 144 that supports the pair of pawls 143 at one end, and a slide portion 145 including a semi-circular section and provided at the other end of the support portion 144. The support portion 144 is pivotally connected to the drive lever 45 of the driver 23 via a connecting pin 146. The axis of the connecting pin 146 is parallel or substantially parallel to the axis of the pivot shaft 51.

As shown in FIG. 40, the slide portion 145 is slidably fitted on the rocker shaft 30.

Figure 41:
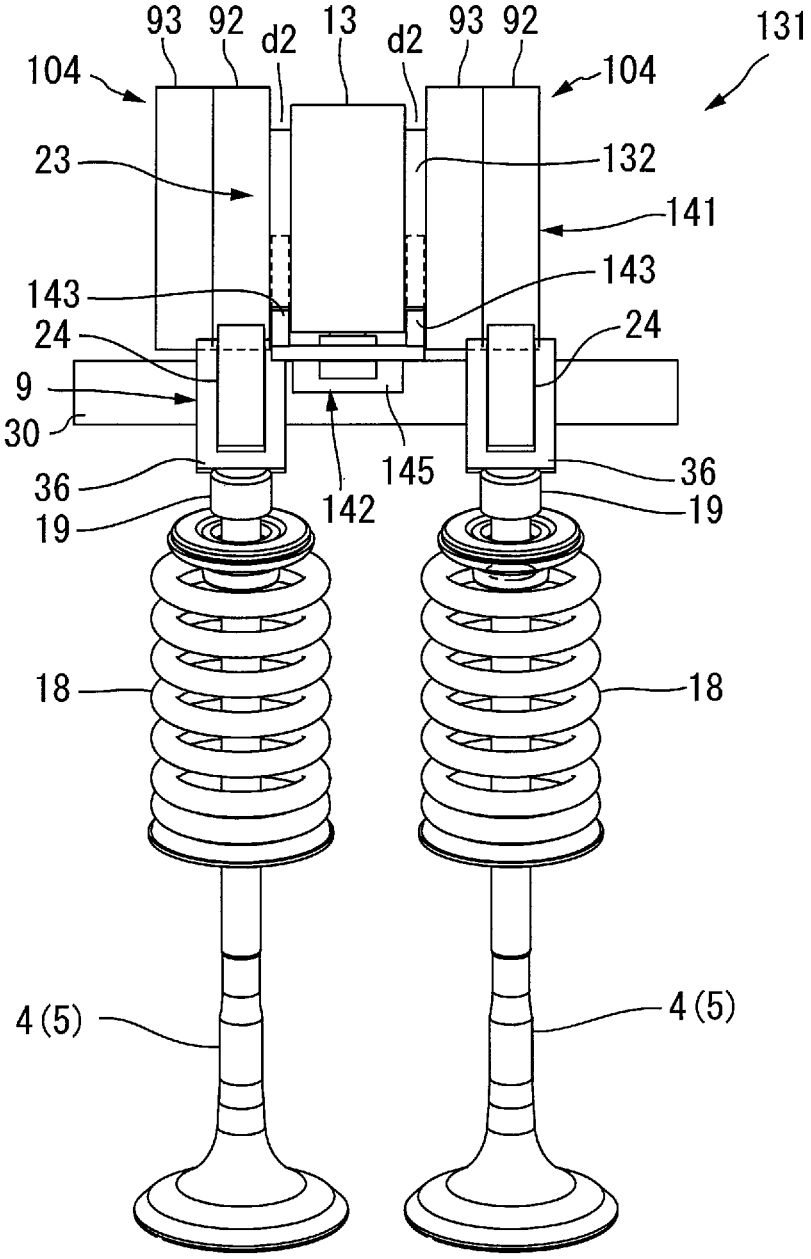
FIG. 41 is a front view of a main portion according to the modification of the sixth preferred embodiment of the present invention.
Figure 42:
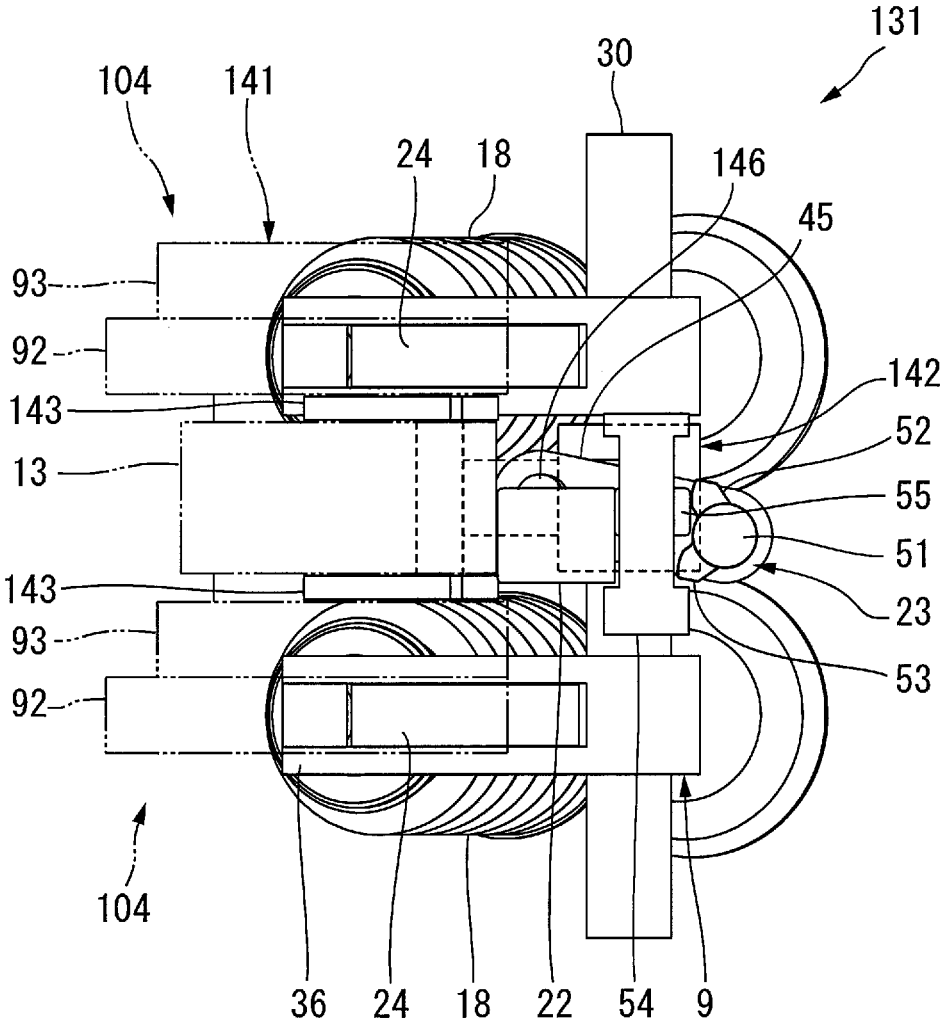
FIG. 42 is a plan view of a main portion according to the modification of the sixth preferred embodiment of the present invention.
Figure 43:
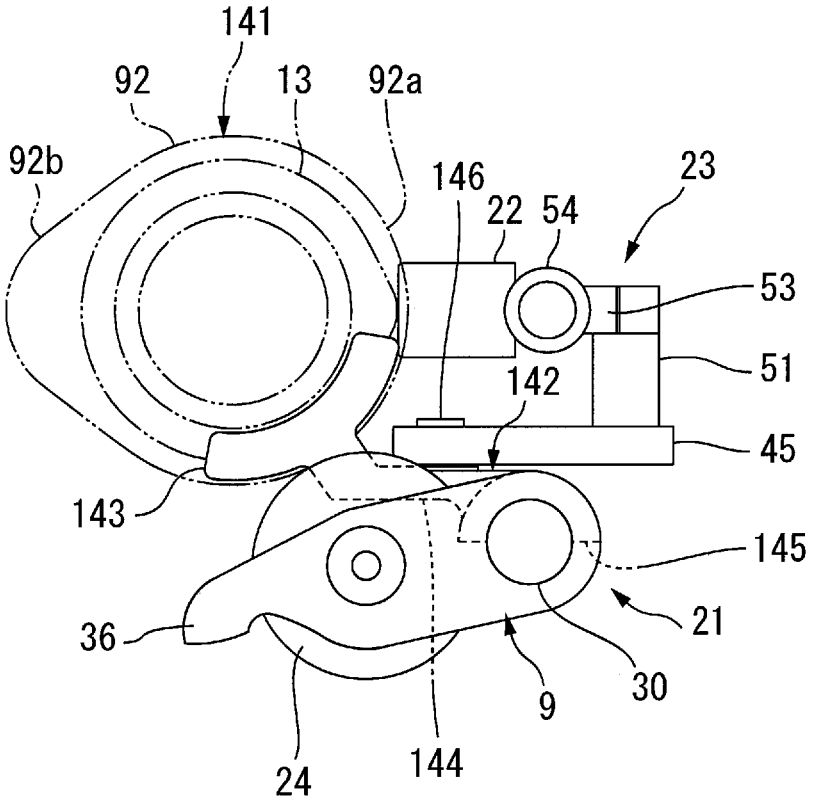
FIG. 43 is a side view of a main portion according to the modification of the sixth preferred embodiment of the present invention.

According to the switching mechanism 3 of this preferred embodiment, when the drive lever 45 of the driver 23 swings to one side in a state in which the intake valves 4 or the exhaust valves 5 are kept closed, the pushing member 142 moves along the rocker shaft 30 to one side (rightward in FIG. 40) in the axial direction, and the pawls 143 push the cam assembly 141 in the same direction. At this time, for example, in a case in which the first cams 92 contact the rollers 24 of the rocker arms 9, as shown in FIG. 41, when the camshaft 14 rotates, the rocker arms 9 are pushed by the first cams 92 and swing. On the other hand, when the drive lever 45 swings in a direction reverse to that described above, the pawls 143 push the cam assembly 141 in a direction reverse to that described above, and the second cams 93 contact the rollers 24. In this case, even when the camshaft 14 rotates, the rocker arms 9 do not swing, and the intake valves 4 or the exhaust valves 5 are maintained in a closed state.

Hence, according to this preferred embodiment, it is possible to provide a valve gear for an engine which switches the drive mode of the intake valves 4 or the exhaust valves 5 by moving the first cams 92, the second cams 93, and the synchronous cam 13.

Each second cam 93 of the valve gear 131 according to this preferred embodiment may include a nose 93*b* whose valve lift amount is different from that of a nose 92*b* of the first cam 92. When this arrangement is used, it is possible to provide a valve gear for an engine which correctly switches between the first drive mode in which the valve lift amount of the intake valves 4 or the exhaust valves 5 is large and the second drive mode in which the valve lift amount of the intake valves 4 or the exhaust valves 5 is small.

In the above-described preferred embodiments, an example in which the valve gear for an engine is applied to a four-cylinder engine has been explained. However, the present invention is not limited to this. Preferred embodiments of the present invention are also applicable to an engine of any other arrangement such as a single-cylinder engine, a two-cylinder engine, a V-shaped four-cylinder engine, a V-shaped six-cylinder engine, or a V-shaped eight-cylinder engine.

The switching mechanism 3 described in the above preferred embodiments preferably includes the hydraulic actuator 58. However, the present invention is not limited to this. For example, as the power source for the actuator 58, a solenoid may be used, although not illustrated. When using this structure, the solenoid is mounted on the housing 44, and the plunger of the solenoid is connected to the moving member 54. In addition, the plunger of the solenoid may define the moving member 54.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. A valve gear for an engine, the valve gear comprising:

a camshaft including a valve drive cam that drives one of an intake valve and an exhaust valve;

a rocker arm that converts a rotation of the valve drive cam into a reciprocating motion and transmits the reciprocating motion to the one of the intake valve and the exhaust valve;

a synchronous cam that rotates in synchronism with the valve drive cam; and a switching mechanism that switches a drive mode of the one of the intake valve and the exhaust valve to one of a first drive mode and a second drive mode in a period defined by the synchronous cam, the switching mechanism including:

a switch that switches between the first drive mode and the second drive mode by moving elements of a valve gear system from the valve drive cam to the rocker arm; and a driver including a cam follower that is pushed by the synchronous cam, and that drives the elements of the valve gear system in directions to switch between the first drive mode and the second drive mode by a force received from the cam follower; and a period when the synchronous cam pushes the cam follower is a period when the one of the intake valve and the exhaust valve is kept closed; wherein the cam follower reciprocally moves between a pushing start position in which the synchronous cam pushes a first end of the cam follower and a pushing end position after the pushing by the synchronous cam ends;

the driver includes:

the cam follower;

a slide pin, a first end of which contacts a second end of the cam follower;

a moving member that supports the slide pin movably back and forth along a first axis which corresponds to a moving direction of the cam follower, and that is movable along a second axis, which includes a one direction and an other direction opposite to the one direction, perpendicular or substantially perpendicular to the first axis;

an actuator that drives the moving member in one of the one direction and the other direction along the second axis;

a pivot shaft located opposite to the cam follower across the moving member and that pivots about a third axis extending perpendicular or substantially perpendicular to the second axis;

a transmission that moves the elements of the valve gear system to switch between the first drive mode and the second drive mode in synchronism with a pivoting operation of the pivot shaft;

a first projection that projects from the pivot shaft in a direction perpendicular or substantially perpendicular to an axial direction of the pivot shaft and that faces a second end of the slide pin in a state in which the moving member has moved in the one direction along the second axis; and a second projection that projects from the pivot shaft in a direction opposite to the first projection and that faces the second end of the slide pin in a state in which the moving member has moved in the other direction along the second axis;

one of the first projection and the second projection with the slide pin intervening with respect to the cam follower, receives, via the slide pin, a pushing force from the cam follower pushed by the synchronous cam and rotates the pivot shaft to one side where the one of the first projection and the second projection is located; and the other one of the first projection and the second projection is a return cam that pushes the slide pin to a side of the cam follower and returns the cam follower to the pushing start position when the slide pin, which has pushed the one of the first projection and the second projection, moves in a direction toward the other one of the first projection and the second projection together with the moving member.

2. The valve gear according to claim 1, wherein the actuator includes:

a hydraulic device including a hydraulic piston provided at a first end of the moving member; and a spring that biases a second end of the moving member toward the first end of the moving member.

3. The valve gear according to claim 1, wherein the actuator includes a hydraulic device including:

a first hydraulic piston provided at a first end of the moving member; and a second hydraulic piston provided at a second end of the moving member.

4. The valve gear according to claim 3, further comprising a spring that biases the moving member in the one direction along the second axis; wherein the direction in which the spring biases the moving member is a direction in which a drive mode is one of the first drive mode and the second drive mode that is used to start the engine.

5. The valve gear according to claim 1, wherein the transmission includes:

a first lever that pivots integrally with the pivot shaft; and a second lever including a first end connected to the elements of the valve gear system and a second end connected to a pivoting end of the first lever and that pivots about an axis parallel or substantially parallel to the third axis of the pivot shaft.

6. The valve gear according to claim 1, wherein a concave portion that houses a distal end of the slide pin pushed by the cam follower is provided between the first projection and the second projection; and an inner wall of the concave portion includes cam surfaces that function as the return cam in the first projection and the second projection.

7. The valve gear according to claim 1, wherein the rocker arm includes:

a first rocker arm that swings when pushed by the valve drive cam; and a second rocker arm swingably provided at a location adjacent to the first rocker arm in the axial direction of the camshaft and including, at a swinging end, a pusher that pushes one of the intake valve and the exhaust valve;

a pin hole in the first rocker arm and the second rocker arm extending in the axial direction of the camshaft so as to extend across the first rocker arm and the second rocker arm;

the elements of the valve gear system include a plurality of switch pins arranged in the axial direction of the camshaft and movably fitted in the pin hole in the first rocker arm and the second rocker arm; and when the pivot shaft rotates in one pivot direction, the plurality of switch pins move to positions at which the plurality of switch pins are located across the first rocker arm and the second rocker arm and connect the first rocker arm and the second rocker arm, and when the pivot shaft rotates in another pivot direction, the plurality of switch pins move from the positions at which the plurality of switch pins are located across the first rocker arm and the second rocker arm and cancel a connected state between the first rocker arm and the second rocker arm.

8. The valve gear according to claim 1, wherein the valve drive cam includes a first cam and a second cam having different valve lift amounts and that are arranged in the axial direction of the camshaft;

the rocker arm includes;

a first rocker arm that swings when pushed by one of the first cam and the second cam; and a second rocker arm swingably provided at a location adjacent to the first rocker arm in the axial direction of the camshaft, at which the other of the first cam and the second cam pushes the second rocker arm, and including, at a swinging end, a pusher that pushes one of the intake valve and the exhaust valve;

a pin hole in the first rocker arm and the second rocker arm extending in the axial direction of the camshaft so as to extend across the first rocker arm and the second rocker arm; and the elements of the valve gear system include a plurality of switch pins arranged in the axial direction of the camshaft and movably fitted in the pin hole in the first rocker arm and the second rocker arm; and when the pivot shaft rotates in one pivot direction, the plurality of switch pins move to positions at which the plurality of switch pins are located across the first rocker arm and the second rocker arm and connect the first rocker arm and the second rocker arm, and when the pivot shaft rotates in another pivot direction, the plurality of switch pins move from the positions at which the plurality of switch pins are located across the first rocker arm and the second rocker arm and cancel a connected state between the first rocker arm and the second rocker arm.

9. The valve gear according to claim 1, wherein the rocker arm is supported by a rocker shaft extending in a direction parallel or substantially parallel to the axial direction of the camshaft so as to be swingable and movable in the axial direction;

the valve drive cam includes a first cam and a second cam having different valve lift amounts and are arranged in the axial direction of the camshaft;

the elements of the valve gear system include the rocker arm; and when the pivot shaft rotates in one pivot direction, the rocker arm contacts one of the first cam and the second cam, and when the pivot shaft rotates in another pivot direction, the rocker arm contacts the other of the first cam and the second cam.

10. The valve gear according to claim 1, wherein the valve drive cam includes a first cam and a second cam having different valve lift amounts and being arranged in the axial direction of the camshaft, and the valve drive cam is supported by the camshaft to be movable in the axial direction in a state in which a relative movement in a rotation direction is regulated;

the elements of the valve gear system include the valve drive cam;

when the pivot shaft rotates in one pivot direction, the first cam contacts the rocker arm, and the second cam separates from the rocker arm; and when the pivot shaft rotates in another pivot direction, the first cam separates from the rocker arm, and the second cam contacts the rocker arm.

11. The valve gear according to claim 1, wherein the engine is a multi-cylinder engine;

the first drive mode is when the one of the intake valve and the exhaust valve maintains a closed state;

the second drive mode is when the one of the intake valve and the exhaust valve is opened and closed; and the switching mechanism switches between the first drive mode and the second drive mode of the intake valve and the exhaust valve in a cylinder selectively put at rest.

12. The valve gear according to claim 1, wherein the engine is a multi-cylinder engine;

the first drive mode is when a valve lift amount of the one of the intake valve and the exhaust valve is a first value;

the second drive mode is when the valve lift amount of the one of the intake valve and the exhaust valve is a second value smaller than the first value; and the switching mechanism switches between the first drive mode and the second drive mode of at least one of the intake valve and the exhaust valve in all cylinders in the multi-cylinder engine.

* * * * *